US007796110B2

(12) United States Patent
Abe

(10) Patent No.: US 7,796,110 B2
(45) Date of Patent: Sep. 14, 2010

(54) SEMICONDUCTOR DEVICE FOR DRIVING A CURRENT LOAD DEVICE AND A CURRENT LOAD DEVICE PROVIDED THEREWITH

(75) Inventor: Katsumi Abe, Tokyo (JP)

(73) Assignee: NEC Corporation, Tokyo (JP)

( * ) Notice: Subject to any disclaimer, the term of this patent is extended or adjusted under 35 U.S.C. 154(b) by 787 days.

(21) Appl. No.: 11/801,513

(22) Filed: May 10, 2007

(65) Prior Publication Data

US 2007/0217275 A1 Sep. 20, 2007

Related U.S. Application Data

(62) Division of application No. 10/230,935, filed on Aug. 29, 2002, now Pat. No. 7,256,756.

(30) Foreign Application Priority Data

Aug. 29, 2001 (JP) ..... 2001-259677

(51) Int. Cl.
*G09G 3/36* (2006.01)

(52) U.S. Cl. ..... 345/98; 345/204

(58) Field of Classification Search ..... 345/87–102, 345/204, 76–79; 359/645
See application file for complete search history.

(56) References Cited

U.S. PATENT DOCUMENTS 4,121,256 A 10/1978 Lorteije et al.
4,967,192 A 10/1990 Hirane et al.
5,138,310 A 8/1992 Hirane et al.
5,309,151 A 5/1994 Aoki
5,552,677 A 9/1996 Pagones
5,903,246 A 5/1999 Dingwall
6,067,061 A 5/2000 Friedman
6,332,661 B1 12/2001 Yamaguchi (Continued)

FOREIGN PATENT DOCUMENTS

CN 1234654 A 11/1999

(Continued)

OTHER PUBLICATIONS

Extended European Search Report dated Jan. 22, 2010.

(Continued)

*Primary Examiner*—Nitin Patel
(74) *Attorney, Agent, or Firm*—Scully, Scott, Murphy & Presser, P.C.

(57) ABSTRACT

In a D/I conversion section of the semiconductor device for driving a light emission display device, a precharge circuit is provided at the rear of each 1-output D/I conversion section. A precharge signal PC is input into the precharge circuit. The D/I conversion section has two output blocks internally thereof, and a role for storing and outputting current is changed every frame to enable securing a period for driving a pixel longer. Further, at the time of driving, in the precharge circuit, current driving is carried out after a voltage corresponding to output current has been applied to the pixel, and therefore, the pixel can be driven at high speed. Thereby, output current of high accuracy can be supplied to digital image data to be input, and even where an output current value is low, the current load device can be driven at high speed.

15 Claims, 35 Drawing Sheets

U.S. PATENT DOCUMENTS

| | | | |
|---|---|---|---|
| 6,707,438 | B1 | 3/2004 | Ishizuka et al. |
| 6,756,962 | B1 | 6/2004 | Akimoto et al. |
| 6,943,760 | B2 | 9/2005 | Bae et al. |
| 2002/0044110 | A1 | 4/2002 | Prache |
| 2003/0011625 | A1 | 1/2003 | Kellis |

FOREIGN PATENT DOCUMENTS

| | | | |
|---|---|---|---|
| EP | 0 359 315 | A1 | 3/1990 |
| EP | 0 449 342 | A1 | 10/1991 |
| EP | 1 039 440 | A1 | 9/2000 |
| JP | 62-122488 | | 4/1987 |
| JP | 02-105907 | | 4/1990 |
| JP | 10-045653 | | 2/1998 |
| JP | 10-093436 | | 4/1998 |
| JP | 2000-039926 | | 2/2000 |
| JP | 2000-081920 | | 3/2000 |
| JP | 2000-105574 | | 4/2000 |
| JP | 2000-122608 | | 4/2000 |
| JP | 2000-340842 | | 12/2000 |
| JP | 2001/042823 | | 2/2001 |
| JP | 2002-152565 | | 5/2002 |
| JP | 2003-195815 | | 7/2003 |
| WO | WO 98/11554 | | 3/1998 |
| WO | 99/05667 | | 2/1999 |
| WO | WO 99/38148 | | 7/1999 |
| WO | WO 01/06484 | A1 | 7/2000 |
| WO | WO 01/26088 | A1 | 4/2001 |
| WO | WO 01/59750 | A1 | 8/2001 |

OTHER PUBLICATIONS

Nicolas Moneclaey n et al., "Measurements of the Main Limitations of Current Memory Cells", Proceedings of the Midwest Symposium on Circuits and Systems. Lafayette, Aug. 3-5, 1994, IEEE, Us, vol. 1 SYMP 37.

Groeneveld, D.W.J., et al. "A Self-Calibration Technique for Monolithic High-Resolution D/A Converters", IEEE Journal of Solid-State Circuits, IEEE Service Center, Piscataway, NJ, US, vol. 24, No. 6, Dec. 1, 1999; pp. 1517-1522.

SEMICONDUCTOR DEVICE FOR DRIVING A CURRENT LOAD DEVICE AND A CURRENT LOAD DEVICE PROVIDED THEREWITH

CROSS REFERENCE TO RELATED APPLICATION

The present application is a divisional application of U.S. Ser. No. 10/230,935 filed on Aug. 29, 2002, now U.S. Pat. No. 7,256,756 the contents of which is fully incorporated herein by reference.

BACKGROUND OF THE INVENTION

1. Technical Field of the Invention

The present invention relates to a semiconductor device for driving a current load device provided with a plurality of cells including a current load element and a current load device provided therewith, and particularly relates to a semiconductor device for driving a current load device for carrying out a gradation display by a current value to which a current load element is supplied and a current load device provided therewith.

2. Description of the Related Art

There has been developed a current load device provided with a plurality of cells, in the form of a matrix, including a current load element of which operation is decided by current supplied. Its application is, for example, a light emission display device in which a current load element is a luminous element, and an organic EL (Electro Luminescence) display device in which an organic EL element is used as a luminous element.

In the following, as a current load device, a light emission display device will be explained by way of an example. FIG. 1 shows the constitution of a matrix type light emission display device.

The display device comprises a horizontal driving circuit 200, a vertical scanning circuit 300 and a display portion 400. The gradation display is realized by adjusting current flowing in a luminous element within a 1-pixel display portion 100 of the display portion 400. In a luminous element whose brightness is decided by various current, current and brightness are in a proportional relation. By combination of the constitution of the 1-pixel display portion 100 and current or voltage applied from the horizontal driving circuit 200 and the vertical scanning circuit 300, the driving method of the light emission display device is classified into a simple matrix drive and an active matrix drive.

FIG. 2 is a circuit view showing the constitution of the 1-pixel display portion in case of the simple matrix drive. In the 1-pixel display portion 101 in case of the simple matrix drive, at each point of intersection between a control line 110 and a signal line 120, a luminous element 130 is connected between the control line 110 and the signal line 120. As shown in FIG. 1, the control line 110 is driven by the vertical driving circuit 300, and the signal line 120 is driven by the horizontal driving circuit 200. And, the control lines 110 are sequentially selected one by one by the vertical scanning circuit 300, and when current or voltage is output to the Lth signal line 120 from the horizontal driving circuit 200 during the scanning of the Kth control line 110, current flowing in the Kth line and the Lth column luminous element is decided, and the luminous element emits with intensity corresponding to the current. Thereafter, when the (K+1)th scanning is started, emitting of the Kth luminous element terminates.

FIG. 3 is a circuit view showing the constitution of the 1-pixel display portion in case of the active matrix drive. In the 1-pixel display portion 102 in case of the active matrix drive, at each point of intersection between the control line 110 and the signal line 120, a switch SW100 controlled by a potential of the control line 110 is connected to the signal line 110, and a gate of a TFT (Thin Film Transistor) T100 and one end of a capacity element C100 are connected to the other end of the switch SW100. A source of the TFT T100 and the other end of the capacity element C100 are grounded, and a luminous element 130 is connected between a drain of the TFT T100 and a signal line whose potential is VEL.

And, when the control lines 110 are sequentially selected one by one by the vertical scanning circuit SW300 and the Kth control line 110 is then selected, the switch 100 in the 1-pixel display portion 102 is turned on. At this time, the Lth output voltage of the horizontal driving circuit 200 is a gate voltage of the TFT T100, and when a gate voltage such that the TFT T100 is operated in a saturated area is applied, impedance of the TFT T100 is decided. As a result, current flowing in the luminous element 130 is decided, and the luminous element 130 emits with intensity corresponding to the current.

In the case of the active matrix drive, the 1-pixel display portion may sometimes take the other constitution. FIGS. 4A and 4B are respectively circuit views showing the other constitution of the 1-pixel display portion in the case of the active matrix drive. As shown in FIG. 4A, in a 1-pixel display portion 103 of the other constitution, a switch SW102 controlled by a potential of the control line 110 is connected to the signal line 110, and a gate and a drain of a P channel TFT T102 are connected to the other end of the switch SW102. A switch SW101 controlled by a potential of the control line 110 is connected to the gate and the drain, and a gate of the P channel TFT T101 and one end of a capacity element C100 are connected to the other end thereof. A constant potential VEL is supplied to sources of the TFT T101 and T102 and the other end of the capacity element C100. A luminous element 130 is connected between the drain of the TFT T101 and a ground potential GND. And, when the Kth control line 110 is selected by the vertical scanning circuit 300, and the switches SW101 and SW102 are turned on, a gate voltage of the TFT T102 is determined so as to cause the Lth output current of the horizontal driving circuit 200 to flow from the signal line 120. Since the TFT T102 and TFT T101 employ the current mirror constitution, where the current abilities of the TFT T102 and TFT T101 are equal to each other, the same current as the output current value of the horizontal driving circuit 200 flows to the luminous element 130 through the TFT T101, and the luminous element 130 emits with intensity according to the current value.

As shown in FIG. 4B, also in the case where N channel TFT T103 and T104 are used in place of the P channel TFT T101 and T102, the similar operation is carried out.

Comparing the simple matrix drive with the active matrix drive, in case of the active matrix drive, a voltage is stored in the capacity element even after next line is selected, and therefore, it is possible to continue to flow current. Accordingly, current allowed to flow to the luminous element is small as compared with the case of the simple matrix drive which merely emits momentarily.

As described above, even if the absolute value of current or voltage is different, where the gradation display is carried out, irrespective of the kinds of the driving methods of the simple matrix drive and the active matrix drive, the horizontal driving circuit 200 has a function to convert digital gradation data into current or voltage. In case of voltage output, since unevenness of threshold of a transistor and unevenness of voltage-current characteristics and current-brightness characteristics of the luminous element are present in a pixel circuit (1-pixel display portion), even if the same voltage is applied, there is a high possibility that brightness is uneven. On the other hand, in case of current output, being influenced merely by the unevenness of the current-brightness characteristics of the luminous element, unevenness of brightness is small, and high brightness can be displayed.

FIG. 5 is a block diagram showing one example of the constitution of a horizontal scanning circuit 200 for outputting current to a display portion 400. In this constitution, digital gradation data are developed to the number of output by a data logic portion 201, and afterwards, the digital gradation data are input into a digital voltage signal to analog current signal (digital-to-current) conversion portion 210 to thereby obtain a current output for the number of output.

FIG. 6 is a circuit view showing a first conventional example of a digital-to-current conversion portion for 1-output. Where gradation data are 3 bits (D0 to D2), switches SW110, SW111, and SW112 controlled thereby connected in common to an output end for outputting current I data. N channels TFT T110, T111, and T112 in which an input voltage VA is supplied to a gate are connected between the switches SW110, SW111, and SW112 and a ground wire at a ground potential VG. It is assumed that the current-brightness characteristics of the luminous element are in a proportional relation. Further, it is supposed that both the horizontal driving circuit 200 and the vertical driving circuit 300 are formed on a glass substrate, and all transistors are TFT. Even where gradation data are not less than 3 bits, the similar constitution is employed.

Further, in the first conventional example, it is designed so that with respect to the TFT T110, T111 and T112, the channel length (L) is constant, and the ratio of the channel width (W) is 1:2:4. Since TFT T110 to T112 are common such that the gate voltage is voltage VA and the source voltage is voltage VG, where TFT T110 to T112 are operated in a saturated area, the current ratio is 1:2:4. So, if a suitable input voltage VA is selected, switches SW110 to SW112 are turned on/off on the basis of gradation data D0 to D2 whereby with respect to the output current I data, current output of 8 gradations whose current ratio is 0 to 7 becomes enabled. Further, the absolute value of current can be regulated by changing the input voltage VA.

FIG. 7 is a circuit view showing a second conventional example of a digital-to-current conversion portion for 1-output. In the conventional second example, digital gradation data D0 to D2 are input into gates of N channels TFT T110 to T112. Drains of the TFT T110 to T112 are connected in common to output ends and a power supply voltage VD is supplied to sources thereof. The ratio of the channel width of the TFT T110 to T112 is set to 1:2:4 similarly to the first conventional example.

In the second conventional example as described above, a high level of digital gradation data input is set in advance to a suitable voltage, and a low level is made to be a level turned off by a thin film transistor, whereby current output of 8 gradations whose current ratio is 0 to 7 becomes enabled similarly to the first conventional example. Further, the absolute value of current can be regulated by changing a high level of digital gradation data input.

However, in a transistor, particularly in TFT, since unevenness of current abilities where the same gate voltage is applied between different TFTs is great, there poses a problem that it is difficult to issue a current output of high accuracy. In the conventional digital-to-current conversion portion, when there is a characteristic unevenness of TFT in substantially the whole width area of the display device, even the size of TFT is uniform and a voltage between the gate and the source is uniform, an uneven display occurs because the current value is different from that in other areas in the uneven portion. Further, current abilities become uneven even between TFTs as in a close area, and when such an unevenness becomes large, a display unevenness appears between close pixels, and when the characteristics of TFTs used for the same output become uneven, monotony of gradation is not satisfied.

Further, in the conventional digital-to-current conversion portion, particularly in the active matrix drive, there is a problem that where the output current value is low, it takes time for driving. This is because of the fact that when the active matrix drive by way of current drive is employed, driving completes at the time when the same current as the output current of the digital-to-current conversion portion as a driving circuit flows to the TFT in the pixel, but a wiring load, particularly a parasitic capacity is always present in the signal line 110 within the display portion 400, the luminous element also has a capacity value, and therefore it is necessary that the capacity loads are charged or discharged by output current which is constant current. That is, since the same current as output current of a digital-to-current conversion circuit which is a driving circuit flows to the TFT within the pixel first by charging or discharging the capacities to a certain voltage, it takes long time till then.

SUMMARY OF THE INVENTION

It is an object of the present invention to provide a semiconductor device for driving a light emission display device and a light emission display device provided therewith capable of supplying output current of high accuracy to digital image data input and preferably capable of driving the light emission display device at high speed even where an output current value is low.

It is another object of the present invention to provide a further general semiconductor device for driving a current load device and a current load device provided therewith.

A semiconductor device for driving a current load device provided with a plurality of cells including a current load element, according to a first aspect of the present invention comprises:

current supply terminals for supplying current to said cells; and n-bit digital-to-current conversion circuit, at least one of which is provided to every one or plurality of said current supply terminals, and which stores n (n is natural number) kinds of current values decided by one or plural kinds of reference current to be input, and outputs one current in accordance with n-bit digital data to be input out of $2^n$ level current obtained from said stored current values.

A semiconductor device for driving a current load device provided with a plurality of cells including a current load element, according to a second aspect of the present invention comprises:

a plurality of n-bit digital-to-current conversion circuits for storing one or a plurality of reference current values and outputting current in accordance with n-bit digital data;

a current storing shift register for outputting a scanning signal in synchronism with storing operation of said reference current in said n-bit digital-to-current conversion circuit carried out in order;

an n-bit data latch for transmitting n-bit digital data to an n-bit data selector; and an n-bit data selector for determining whether or not n-bit digital data from said n-bit data latch according to the fact that said n-bit digital-to-current conversion circuit carries out operation for storing said reference current or carries out operation for outputting current.

One example of the current load device is a light emission display device which comprises a luminous element whose brightness is determined by current supplied and which is provided on each pixel. Now, the present invention will be described taking the semiconductor device for a light emission display device as an example The semiconductor device for driving a light emission display device according to the present invention comprises an n-bit digital-to-current conversion circuit provided with n 1-bit digital-to-current conversion circuits for storing reference current for 1-bit, each of which inputs n kinds of reference current corresponding to the current-brightness characteristics of the luminous element stored in the one 1-bit digital-to-current conversion circuit, and outputs the reference current to one or not less than two 1-bit digital-to-current conversion circuits selected on the basis of n-bit digital image data to thereby output $2^n$ kinds of current, the n-bit digital-to-current conversion circuit being provided every output terminal for outputting current to the light emission display device, and a current value of said n kinds of reference current is set to a value that the lowest current value is sequentially doubled.

The 1-bit digital-to-current conversion circuit may comprise a signal line to which the reference current flows, a data line to which 1-bit of the digital image data is transmitted, a control line, a first and a second voltage supply lines, a transistor whose source is connected to the first voltage supply line, a capacity element connected between a gate of the transistor and the second voltage supply line, a first switch connected between a drain of the transistor and the output terminal and controlled by a signal for transmitting the data line, a second switch connected between a gate of the first transistor and the signal line or a drain of the first transistor and controlled by a signal for transmitting the control line, and a third switch connected between a drain of the transistor and the signal line and controlled by a signal for transmitting the control line; and may comprise a signal line to which the reference current flows, a data line to which 1-bit of the digital image data is transmitted, a first and a second control lines, a first and a second voltage supply lines, a first transistor whose source is connected to the first voltage supply line, a capacity element connected between a gate of the first transistor and the second voltage supply line, a first switch connected between a drain of the first transistor and the output terminal and controlled by a signal for transmitting the data line, a second switch connected between a gate of the first transistor and the signal line or a drain of the first transistor and controlled by a signal for transmitting the second control line, and a third switch connected between a drain of the first transistor and the signal line and controlled by a signal for transmitting the first control line.

Alternatively, there may comprise a second transistor whose gate is biased, between the first transistor and the first voltage supply line.

Further, when the first switch is in an OFF state and the second and the third switches are in an ON state, the transistor is operated in a saturated area in which a portion between the gate and the drain thereof is short-circuited, a voltage between the gate and the source of the transistor in the stage in which the operation is stabilized is a voltage necessary for flowing the reference current to a voltage between the drain and source, the value of the voltage is decided in accordance with current/voltage characteristics of the transistor, after which when the second and the third switches assume an OFF state, a voltage between the gate and the source of the transistor is held in the capacity element, and whether or not reference current based on the voltage between the gate and the source held is output is decided by the operation of the first switch. Then, since the n 1-bit digital-to-current conversion circuits are present in each output, current of $2^n$ level according to the current-brightness characteristics of the luminous element can be output in accordance with the n-bit digital image data. Accordingly, the 1-bit digital-to-current conversion circuit is able to output current of high accuracy irrespective of unevenness of current/voltage characteristics of the transistor for storing and outputting the current.

Further, if the third switch assumes an OFF state after the second switch has assumed an OFF state, the influence of noises caused by the OFF operation of the transistor as the third switch is reduced, because of which the 1-bit digital-to-current conversion circuit is able to store and output current with higher accuracy.

The first to third switches may be constituted by a transistor.

Further, the 1-bit digital-to-current conversion circuit is provided with a dummy transistor in which an inverted signal of a signal for transmitting the second control line is input in a gate, the product of length and width of the gate is ½ of the product of length and width of a gate of a transistor constituting said second switch, a drain is connected to the gate of the transistor, and a source is short-circuited to the drain. Whereby, since movement of a charge when the transistor as the second switch is turned OFF can be compensated for, the 1-bit digital-to-current conversion circuit is able to store and output current with higher accuracy.

In the present invention, in the current storing period, the transistor for storing n current in the n-bit digital-to-current conversion circuit is operated in the saturated area in which a portion between the gate and the drain is short-circuited, and a voltage between the gate and the source is a voltage in which reference current flows in a stabilized manner. At the end of the current storing period, the switch which short-circuits between the gate and the drain is turned OFF, and a voltage between the gate and the source is stored in the capacity. At that time, since the n transistors store a voltage between the gate and the source to cause the reference current to flow in accordance with the respective current/voltage characteristics, the voltage between the gate and the source to cause the reference current to flow is held irrespective of unevenness of the current/voltage characteristics of the n transistors to thereby store current. In the driving period, the first transistor having n current stored turns ON/OFF n switches between the drain of the n transistors having current stored and the output of the digital-to-current conversion circuit to determine if the stored current is output. Since the thus output current is output from the n transistors themselves having current stored, current of high accuracy without being affected by unevenness of current/voltage characteristics results. By the operation as described above, the digital-to-current conversion circuit in each output of the present invention becomes possible to output current of high accuracy at which the current ratio is 0, 1, 2, . . . , $2^{n-1}$. In this case, n reference current sources are necessary in order to constitute the digital-to-current conversion circuit.

Further, in case of having the second transistor in which gate is biased, the first transistor and the second transistor are cascode connected, and where the both are operated in the close area, drain voltage dependability of drain current can be suppressed, because of which even if the characteristic of the luminous element becomes uneven, it is possible to suppress the unevenness of current supplied.

Further, there is provided a second semiconductor device for driving a light emission display device for driving a light emission display device according to the present invention in which a luminous element whose brightness is determined by current supplied is provided on each pixel characterized by having an n-bit digital-to-current conversion circuit for storing 1 kind of reference current and for producing and outputting $2^n$ kind of current corresponding to the current-brightness characteristics of the luminous element from the stored reference current on the basis of n-bit digital image data, every output terminal for outputting current to the light emission display device.

The n-bit digital-to-current conversion circuit comprises a signal line in which the reference current flows, n data lines to which 1-bit of the digital image data is transmitted, a control line, a first and a second voltage supply lines, a current storing transistor whose source is connected to the first voltage supply line, n current outputting transistors in which gates are short-circuited each other and sources are connected in common to the first voltage supply line, a capacity element connected between the gate of the current outputting transistor and the second voltage supply line, n output controlling switches connected between a drain of the n current outputting transistors and the output terminal and controlled by any of signals for transmitting the data line, a first storage controlling switch connected between a drain of the current storing transistor and the signal line and controlled by a signal for transmitting the control line, and a second storage controlling switch connected between a gate of the current storing transistor and a gate of the current outputting transistor and controlled by a signal for transmitting the control line, and current ability of the n current outputting transistors is set to a level that the lowest current ability may be sequentially doubled. The n-bit digital-to-current conversion circuit comprises a signal line in which the reference current flows, n data lines to which 1-bit of the digital image data is transmitted, a first and a second control lines, a first and a second voltage supply lines, a current storing transistor whose source is connected to the first voltage supply line, n current outputting transistors in which gates are short-circuited each other and sources are connected in common to the first voltage supply line, a capacity element connected between the gate of the current outputting transistor and the second voltage supply line, n output controlling switches connected between a drain of the n current outputting transistors and the output terminal and controlled by any of signals for transmitting the data line, a first storage controlling switch connected between a drain of the current storing transistor and the signal line and controlled by a signal for transmitting the second control line, and a second storage controlling switch connected between a gate of the current storing transistor and a gate of the current outputting transistor and controlled by a signal for transmitting said control line, and current ability of the n current outputting transistors is set to a level that the lowest current ability may be sequentially doubled.

Alternatively, a bias transistor whose gate is biased may be provided between the current storing transistor or the current outputting transistor and the first voltage supply line.

When the output controlling switch is in an OFF state and the first and the second storage controlling switches are in an ON state, the current storing transistor is operated in a saturated area in which a portion between the gate and the drain thereof is short-circuited, a voltage between the gate and the source of the current storing transistor in the stage in which the operation is stabilized is a voltage necessary for flowing the reference current to a voltage between the drain and source, the value of the voltage is decided in accordance with current/voltage characteristics of the current storing transistor, after which the first and the second storage controlling switches assume an OFF state, a voltage between the gate and the source of the current storing transistor is held in the capacity element to assume a state that the n current outputting transistors are able to flow current of n kinds in total based on the current/voltage characteristics from reference current on the basis of the voltage between the gate and the source held, and whether or not current capable of being flown by the current outputting transistor is output may be decided by the n-bit of digital image data.

Preferably, the second storage controlling switch assumes an OFF state after said first storage controlling switch has assumed an OFF state.

The output controlling switch and the first and the second storage controlling switches may be constituted from a transistor.

Preferably, the n-bit digital-to-current conversion circuit has a dummy transistor in which an inverted signal of a signal for transmitting the second control line is input in a gate, the product of length and width of the gate is ½ of the product of length and width of a gate of a transistor constituting the first storage controlling switch, a drain is connected to the gate of the current storing transistor, and a source is short-circuited to the drain.

The present invention can be used where the unevenness of current/voltage characteristics of the transistor in a close area is small. The transistor for storing current in the n-bit digital-to-current conversion circuit of each output stores current by the means similar to that mentioned above. Here, the transistor for storing the current, the aforementioned transistors and a current mirror are provided. When the transistor for storing current is made equal to or larger so that out of n outputting transistors whose current ability ratio is 1:2:4: . . . :$2^{n-1}$, the current ability ratio relative to the transistor of largest current ability is 1:1 or 2:1, the reference current value is large and a period for charging and discharging a wiring load through which reference current flows is shortened, and therefore the current storing period can be shortened. At this time, since the transistor for storing the current stores a gate-source voltage in the state that reference current flows, current can be stored with high accuracy irrespective of unevenness of current/voltage characteristics. Thereby, where the unevenness of current/voltage characteristics of the transistor in the close area is small, n switches to be turned ON/OFF in accordance with the digital input image data are provided as means between the drain of the outputting transistor and the output of the digital-to-current conversion circuit to enable outputting current of high accuracy in which the current ratio is 0, 1, 2, . . . , $2^{n-1}$. Further, in this case, a single reference current source is able to constitute the digital-to-current conversion circuit, making it possible to reduce the input from outside.

Further, in case of having the bias transistor in which the gate is biased, the current storing transistor or current outputting transistor and the bias transistor are cascode connected, and where the both are operated in the saturated area, drain voltage dependability of drain current can be suppressed, because of which even if the characteristic of the luminous element becomes uneven, it is possible to suppress the unevenness of current supplied.

There is provided a third semiconductor device for driving a light emission display device for driving a light emission display device in which a luminous element whose brightness is determined by current supplied is provided on each pixel according to the present invention characterized by having an n-bit output digital-to-current conversion circuit for storing k kind of reference current corresponding to the current-brightness characteristics of the luminous element, producing (n-k) kind of current from said k kind of reference current stored and outputting $2^n$ kind of current on the basis of n-bit of digital image data from a combination of these current, every output terminal for outputting current to the light emission display device.

The n-bit output digital-to-current conversion circuit comprises k signal lines in which the reference current flows, n data lines to which 1-bit of the digital image data is transmitted, a control line, a first and a second voltage supply lines, k current storing and outputting transistors whose source is connected to the first voltage supply line, (n-k) current outputting transistors in which a gate is short-circuited to one gate out of the k current storing and outputting transistors, one or a plurality of capacity elements connected between the gate of the current storing and outputting transistors and the second voltage supply line, n output controlling switches connected between drains of the current storing and outputting transistors and the current outputting transistors and an output terminal and controlled by any of signals for transmitting the data line, k first storage controlling switches connected between drains of the current storing and outputting transistors and the signal line and controlled by a signal for transmitting the control line, and k second storage controlling switches connected between gates and drains of the current storing and outputting transistors and controlled by a signal for transmitting the control line, and current ability of the current outputting transistors is lower than that of all of the current storing and outputting transistors, and current ability of the current outputting transistors and the current storing and outputting transistors is set to a level that the lowest current ability may be sequentially doubled. The n-bit digital-to-current conversion circuit comprises k signal lines in which the reference current flows, n data lines to which 1-bit of said digital image data is transmitted, a first and a second voltage supply lines, k number of current storing and outputting transistors whose source is connected to the first voltage supply line, (n-k) current outputting transistors in which gates are short-circuited to a gate of any one of said k current storing and outputting transistors, one or a plurality of capacity elements connected between the gate of the current storing and outputting transistors and the second voltage supply line, n output controlling switches connected between drains of the current storing and outputting transistors and the current outputting transistors and an output terminal and controlled by any of signals for transmitting the data line, k first storage controlling switches connected between a drain of the current storing and outputting transistors and the signal line and controlled by a signal for transmitting the second control line, and k second storage controlling switches connected between a gate and a drain of the current storing and outputting transistor and controlled by a signal for transmitting the first control line, and current ability of the current outputting transistors is lower than that of all of the current storing and outputting transistors, and current ability of the current outputting transistors and the current storing and outputting transistors set to a level that the lowest current ability may be sequentially doubled.

Alternatively, a bias transistor whose gate is biased may be provided between the current storing transistor or the current outputting transistor and the first voltage supply line.

When the output controlling switch is in an OFF state and the first and the second storage controlling switches are in an ON state, the current storing and outputting transistor is operated in a saturated area in which a portion between the gate and the drain thereof is short-circuited, a voltage between the gate and the source of the current storing and outputting transistor in the stage in which the operation is stabilized is a voltage necessary for flowing the reference current to a voltage between the drain and source, the value of the voltage is decided in accordance with current/voltage characteristics of the current storing and outputting transistor, after which when the first and the second storage controlling switches assume an OFF state, a voltage between the gate and the source of the current storing and outputting transistor is held in the capacity element to assume a state that the current outputting transistors and the current storing and outputting transistors are able to flow current of n kinds in total based on the current/voltage characteristics from reference current on the basis of the voltage between the gate and the source held, and whether or not current capable of being flown by the current outputting transistor and the current storing and outputting transistor is output may be decided by the n-bit of digital image data.

Preferably, the second storage controlling switch assumes an OFF state after the first storage controlling switch has assumed an OFF state.

The output controlling switch and the first and the second storage controlling switches may be constituted from a transistor.

Further, the n-bit digital-to-current conversion circuit has a dummy transistor in which an inverted signal of a signal for transmitting the second control line is input in a gate, the product of length and width of the gate is ½ of the product of length and width of a gate of a transistor constituting the first storage controlling switch, a drain is connected to the gate of the current storing transistor, and a source is short-circuited to the drain.

The present invention can be used where the current ability of the transistor in the close area is somewhat small. In the current storing period, one or several transistors in the n-bit digital-to-current conversion circuit means of each output stores the same number of reference current as that of the transistor by means similar to that mentioned above. Accordingly, the one or several transistors for storing current is able to output current of high accuracy. On the other hand, one or several outputting transistors comprising any of the transistors for storing current and the current mirror output current lower than the reference current whereby even if the current/voltage characteristics is uneven, the influence in the entirety can be minimized. By the constitution as described above, current in which current ratio is $1:2:4 \ldots :2^{n-1}$ can be supplied with high accuracy. n switches to be turned ON/OFF in accordance with digital input image data is provided, as means, between the drain of the transistor for storing and outputting the current and the output of the digital-to-current conversion circuit whereby current of high accuracy in which current ratio is $0, 1, 2, \ldots, 2^{n-1}$ can be output. Further, in this case, the digital-to-current conversion circuit can be constituted by one or several reference current sources, and the input from outside can be reduced.

Here, in case of having the bias transistor in which gate is biased, the current storing transistor or the current outputting transistor and the bias transistor are cascode connected, and where the both are operated in the close area, drain voltage dependability of drain current can be suppressed, because of which even if the characteristic of the luminous element becomes uneven, it is possible to suppress the unevenness of current supplied.

In the present invention, any of the aforementioned digital-to-current conversion circuit means can be combined to constitute an n-bit digital-to-current conversion circuit means. For example, the 1-bit digital-to-current conversion circuit of the first invention is used for the bit of highest current value, and the (n-1) bit digital-to-current conversion circuit of the second embodiment is used for the bit lower than the former to thereby enable constituting an n-bit digital-to-current conversion circuit which is high in accuracy of the bit of the highest current value greatly affected by the unevenness while there are two kinds of reference current.

Further, in the present invention, the first and second voltage supply lines may be a common power supply line.

Furthermore, where the number of the output terminals is a, and emitting color of the pixel of the light emission display device is b color, n×b kinds of reference current values are necessary, but in this case, current storing operation may be carried out by being divided into a/b times. The digital-to-current conversion circuit corresponding to 1-output has the above-described two n-bit digital-to-current conversion circuits whereby one is made to serve as a current outputting circuit and the other as a current storing circuit, and storing of current is carried out by being divided into a/b times using same reference current within each frame, and preferably, current output and current storage are changed in role every frame. By changing the role every frame, a period for storing current other than a period for driving the light emission display device is not necessary. Therefore, the driving period can be considered as the whole frame period, 1 horizontal period for driving 1 line can be taken longer, and current of high accuracy can be driven in the pixel circuit. The aforementioned operation is similarly carried out, for example, even where the digital-to-current conversion circuit corresponding to 1-output is provided with not less than three n-bit digital-to-current conversion circuits. Further, changing of role between the current output and the current storage may be carried out every plural frames.

In the present invention, there is provided a precharge circuit in which current output from a current outputting circuit such as the above-described n-bit digital-to-current conversion circuit is input to thereby output a suitable voltage. Preferably, the precharge circuit comprises a false load circuit in which if the light emission display device is of a simple matrix type, a load equal to the luminous element results and if the light emission display device is of an active matrix type, a load equal to a pixel circuit results, a voltage follower whose input is a voltage where output current flows from the current outputting circuit to the false load circuit, a first precharging switch connected between an output of the current outputting circuit and the false load circuit, a first precharging control line for transmitting a signal for controlling the first precharging switch, a second precharging switch for connecting an output of the current outputting circuit and the light emission display device, a second precharging control line for transmitting the first precharging switch to control an inverted signal of a signal for controlling the first precharging switch, and a third switch connected between an output of the voltage follower and the light emission display device and controlled by a signal for transmitting the first precharging control line.

Further, as precharge operation at the first stage of 1 horizontal period, output current of the current outputting circuit is supplied to the false load circuit, the voltage being applied to a luminous element within the pixel within the light emission display device or the pixel, and thereafter, as current drive operation, output current of the current outputting circuit is directly supplied to a luminous element within the pixel within the light emission display device or the pixel circuit, whereby even if output current of the current outputting circuit is small, the time for charging and discharging the wiring load or the like within the light emission display device can be shortened, because of which the luminous element within the pixel within the light emission display device or the pixel circuit can be driven with more stably and at higher speed, and with high accuracy.

Furthermore, the precharge circuit has the constitution which cancels an offset voltage of the voltage follower, and the operation for canceling the offset voltage of the voltage follower is carried out at the time of the current driving operation, whereby extra time is not necessary, and a difference between the case where output current of the circuit for storing and outputting current is supplied to the false load circuit and the case where the current is supplied to the pixel (circuit) within the actual light emission display device becomes small, because of which the luminous element within the pixel within the light emission display device or the pixel circuit can be driven more stably and at high speed, and with high accuracy.

By the provision of the precharge circuit, since the false pixel (circuit) is present close to the digital-to-current conversion circuit, even where the wiring load therebetween is small, and current to be output is small, the false pixel (circuit) causes current output to flow stably in a short period of time. A gate voltage in the state that current is flowing stably to the false pixel (circuit) is input in the voltage follower, and an output of the voltage follower is connected to a data line of the light emission display device, whereby a voltage close to a voltage in the state that output current of the current outputting circuit is flowing stably to the pixel (circuit) within the display portion is applied to the signal line or the pixel (circuit) within the display portion. The precharge operation as described above can be carried out at high speed as compared with one in which a load of the data line is charged and discharged with constant current. After the data line and the voltage of the pixel (circuit) within the display portion have been stabilized by the precharge operation, the current outputting circuit is separated from the false pixel (circuit), and current is directly output to the data line from the current outputting circuit. In this case, since the load of the data line caused by constant current which is output of the current outputting circuit and the charging and discharging of the pixel (circuit) within the display portion may be carried out slightly because the precharge has been already carried out, and there is not affected by the load of the signal line before the precharge and the voltage of the pixel (circuit) within the display portion. Further, the driving time can be shortened. Accordingly, by carrying out two stages of driving operation as described above, the pixel (circuit) can be current-driven stably, at high speed and with high accuracy without being affected by the wiring load within the light emission display portion before driving and the voltage of the load of the pixel (circuit).

The semiconductor device for driving a light emission display device according to the present invention comprises one or a plurality of the n-bit digital-to-current conversion circuits for storing reference current every output and outputting $2^n$ kinds of current in accordance with n-bit digital data, a data selector in which the n-bit digital-to-current conversion circuit performs outputting of current or storing operation to thereby to perform operation whether or not transmitting an n-bit data latch and data from the n-bit data latch to the n-bit digital-to-current conversion circuit, and a current storing shift register for outputting a scanning signal in synchronism with operation for storing the reference current. Furthermore, the semiconductor device for driving a light emission display device has the precharge circuit every output. Further, the semiconductor device for driving a light emission display device is provided, every output, with an n-bit data register for holding n-bit digital data input from outside in synchronism with a scanning signal of a data holding shift register. Further, there comprises an output selector circuit capable of sequentially connecting outputs of the n-bit digital-to-current circuit or the precharge circuit in the 1 horizontal period to a plurality of data lines of the light emission display device in accordance with a selector signal whereby the semiconductor device for driving a light emission display device is able to drive the light emission display device in a lesser circuit scale.

It is noted that there can be integrated on one chip along with a circuit for producing the reference current. Further, the transistor may be comprised of a thin film transistor.

The light emission display device according to the present invention is characterized by the provision of any of the aforementioned semiconductor devices for driving a light emission display device formed on the same substrate as the luminous element and integrated on one chip together with the circuit for producing reference current.

Particularly, where the luminous element and the aforementioned semiconductor devices for driving a light emission display device formed on the same substrate as the luminous element, the false load (circuit) within the precharge circuit can be constituted in the same size and shape as the load (circuit) within the pixel of the display device, because of which the accuracy of the precharge voltage obtained can be made high. At this time, the driving method having the precharge operation and the current outputting operation combined can be driven more stably, at high speed and with high accuracy.

The aforementioned semiconductor devices for driving a light emission display device and the light emission display device according to the present invention can be also applied to a more general current load element, a semiconductor device for driving a current load element or a current load device, which are constituted by a current load element in place of a luminous element, as mentioned above.

DETAILED DESCRIPTION OF THE PREFERRED EMBODIMENTS

The semiconductor device for a current load device according to the embodiment of the present invention will be explained in detail with reference to the accompanying drawings taking the semiconductor device for a light emission display device as an example similarly to that mentioned above. In the following explanation, those for which order is set in the same constitutional elements are shown by an under bar and a numeral, and in case where attention is paid individually, they are shown without attaching an under bar and a numeral thereto.

Figure 8:
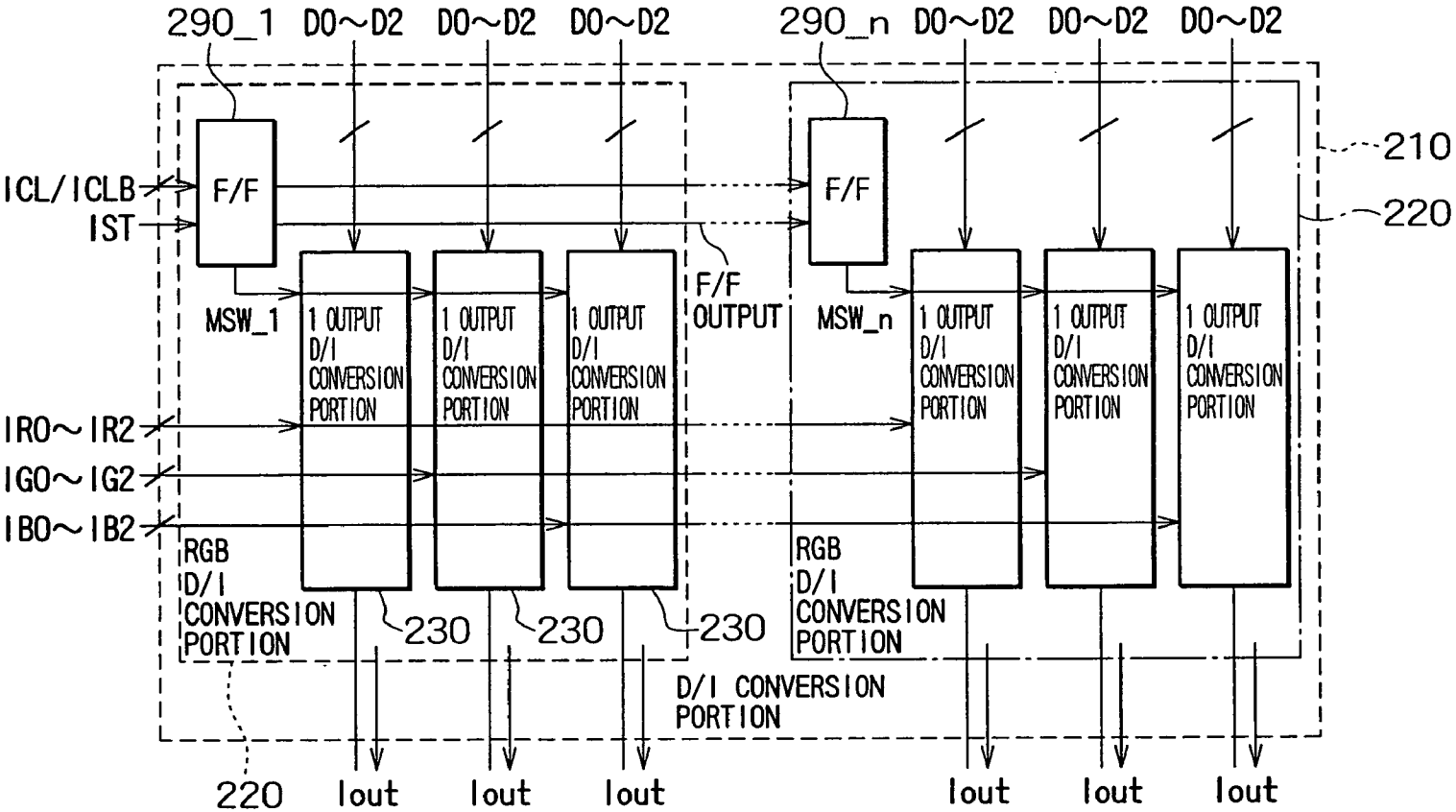
FIG. 8 is a block diagram showing the constitution of a semiconductor device for driving a current load device according to a first embodiment of the present invention.

FIG. 8 is a block diagram showing the constitution of a semiconductor device for a light emission display device according to a first embodiment of the present invention. In the first embodiment, a digital-to-current (D/I) conversion portion 210 is provided, and the digital-to-current (D/I) conversion portion 210 is provided with a shift register comprising a 1-output D/I conversion portion 230 for the output number (3×n) to the light emission display device, and n flip-flops (F/F) 290_1 to 290_n provided every 3-output. Into the shift register are input a start signal IST for controlling timing for storing current, a clock signal ICL, and an inverted signal ICLB of the clock signal ICL. Further, into the 1-output D/I conversion portion 230 are input digital image data D0 to D2 of outputs, and any of reference current IR0 to IR2, IG0 to IG2, and IB0 to IB2 for reference are input according to light emitting color assigned thereto. Further, reference current has a current value adjusted to the current-brightness characteristics of luminous elements whose light emitting colors are red, blue and green, and a current value ir0 of reference current IR0 corresponds to a first gradation of a luminous element whose emitting color is red, a current value ir1 of reference current IR1 corresponds to a second gradation of a luminous element whose emitting color is red, and a current value ir2 of reference current IR2 corresponds to a fourth gradation of a luminous element whose emitting color is red. Similarly, current values of reference current IG0 to IG2 correspond to a first gradation, a second gradation, and a fourth gradation whose light emitting colors are green, respectively, and reference current IB0 to IB2 correspond to a first gradation, a second gradation, and a fourth gradation whose light emitting colors are blue, respectively. One F/F 290 and three 1-output D/I conversion portions 230 into which is input a signal MSW output from the F/F 290 constitute one RGB D/I conversion portion 220.

Figure 9:
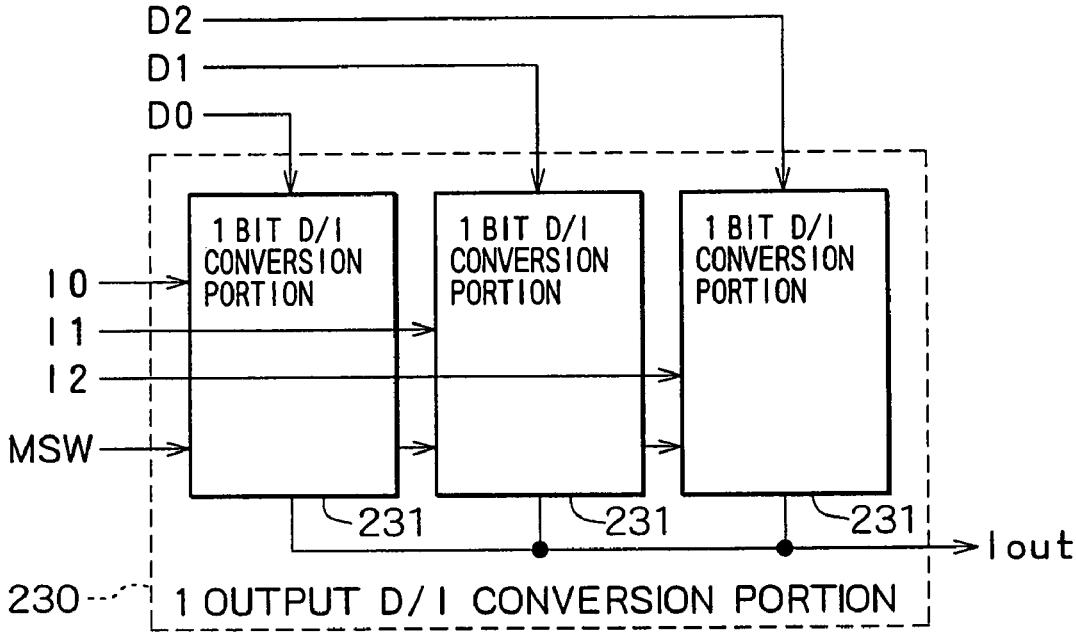
FIG. 9 is a block diagram showing the constitution of a 1-output D/I conversion portion 230.

FIG. 9 is a block diagram showing the constitution of a 1-output D/I conversion portion 230. The 1-output D/I conversion portion 230 comprises three 1-bit D/I conversion portions 231. Any of a combination of image data D0 and reference current I0, a combination of image data D1 and reference current I1, and a combination of image data D2 and reference current I2 are input into these 1-bit D/I conversion portions 231. and a signal MSW which is an output signal of F/F is input. Reference current I0 to I2 correspond to any of a combination of reference current IR0 to IR2, a combination of reference current IG0 to IG2, and a combination of reference current IB0 to IB2. That is, in the 1-output D/I conversion portion 230 for displaying red (R), reference current supplied to the 1-bit D/I conversion portion 231 into which is input digital gradation data D0 is reference current IR0 corresponding to brightness of the first gradation of a luminous element for displaying red. Further, reference current supplied to the 1-bit D/I conversion portion 231 into which is input digital gradation data D1 is reference current IR1 corresponding to brightness of the second gradation of a luminous element for displaying red, and reference current supplied to the 1-bit D/I conversion portion 231 into which is input digital gradation data D2 is reference current IR2 corresponding to brightness of the fourth gradation of a luminous element for displaying red. However, since the current-brightness characteristics of a luminous element has a proportional relation, a relation of ir1=2×ir0 and ir2=4×ir0 is established. Likewise, In the 1-bit D/I conversion portion 231 provided in the 1-output D/I conversion portion 230 for displaying green (G) or a blue (B) into which are input gradation data D0, D1 and D2, reference current IG0 or IB0, reference current IG1 or IB1, and reference current IG2 or IB2 are input.

Figure 10:
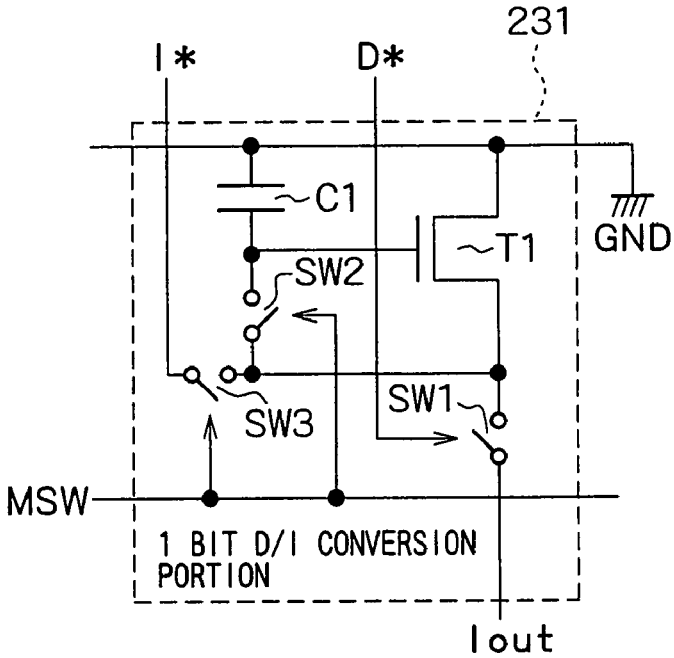
FIG. 10 is a block diagram showing the constitution of a 1-bit D/I conversion portion 231.

FIG. 10 is a block diagram showing the constitution of a 1-bit D/I conversion portion 231. In the 1-bit D/I conversion portion 231 are provided a current storing and outputting transistor N channel thin film transistor (TFT) T1, switches SW1 to SW3, and a capacity element C1. The switch SW1 is connected to a drain of TFT T1, and controlled by gradation data D*. Output current Iout is output from the other end of the switch SW1. The switch SW2 is connected between a contact between the switch SW1 and TFT T1, one end of the capacity element C1 and a gate of TFT T1, and controlled by a signal MSW. One end of the switch SW3 is connected to a signal line to which is supplied reference current 1*, and the other end thereof is connected between a contact between the switch SW1 and TFT T1 and one end of the capacity element C1, and controlled by a signal MSW. Further, a source of TFT T1 and the other end of the capacity element C1 are, for example, grounded, but where there is no problem in terms of operation, a voltage higher than a ground voltage GND may be supplied. Gradation data D* and reference current I* correspond to any of gradation data D0 and reference current 10, gradation data D1 and reference current I1, and gradation data D1 and reference current I2.

Figure 1:
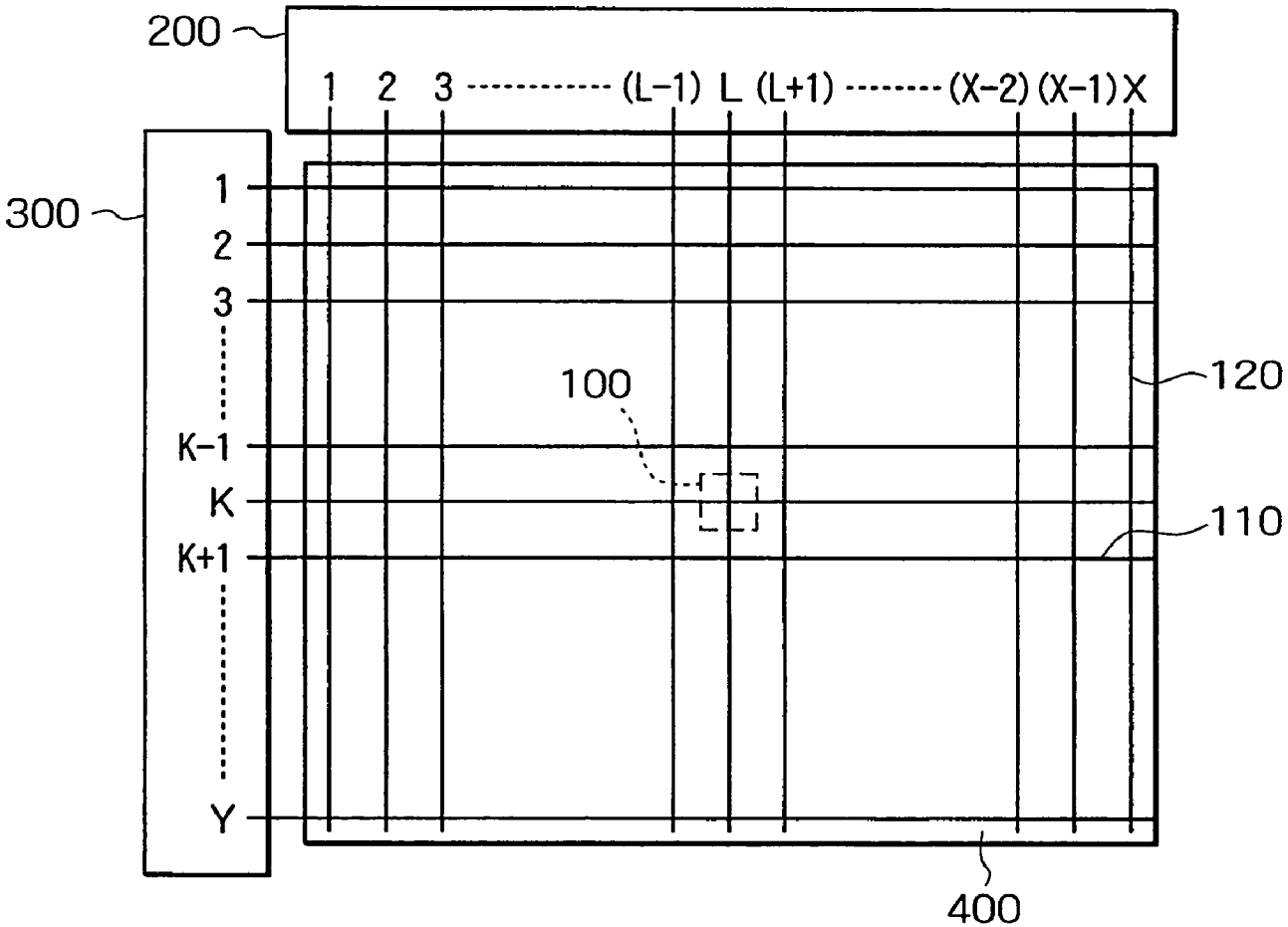
FIG. 1 (PRIOR ART)
FIG. 1 is a view showing the constitution of a light emission display device in which a luminous element whose brightness is decided by current supplied is present in each pixel.
Figure 2:
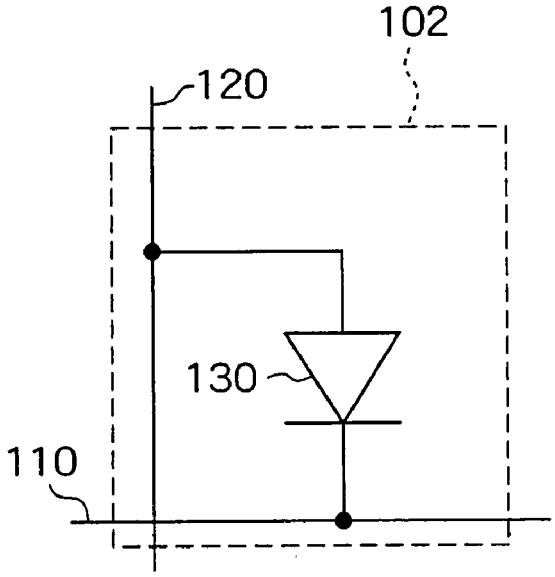
FIG. 2 (PRIOR ART)
FIG. 2 is a circuit view showing the constitution of a 1-pixel display portion in case of a simple matrix drive.
Figure 3:
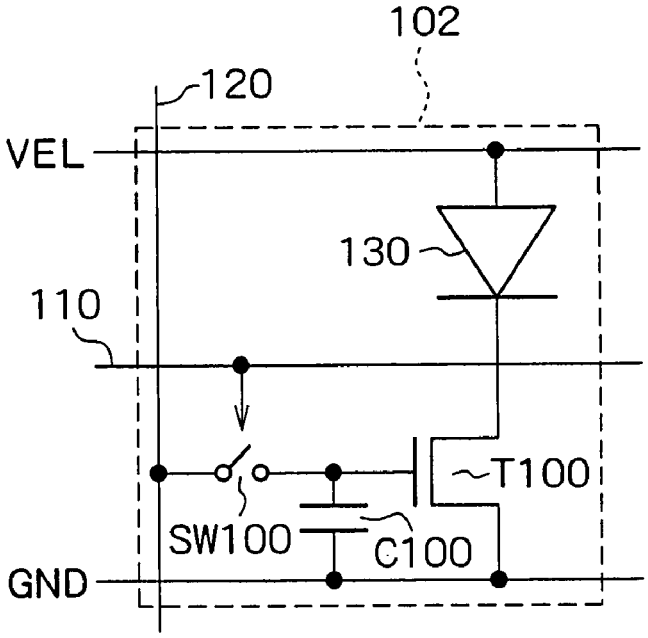
FIG. 3 (PRIOR ART)
FIG. 3 is a circuit view showing the constitution of a 1-pixel display portion in case of an active matrix drive.
Figure 11:
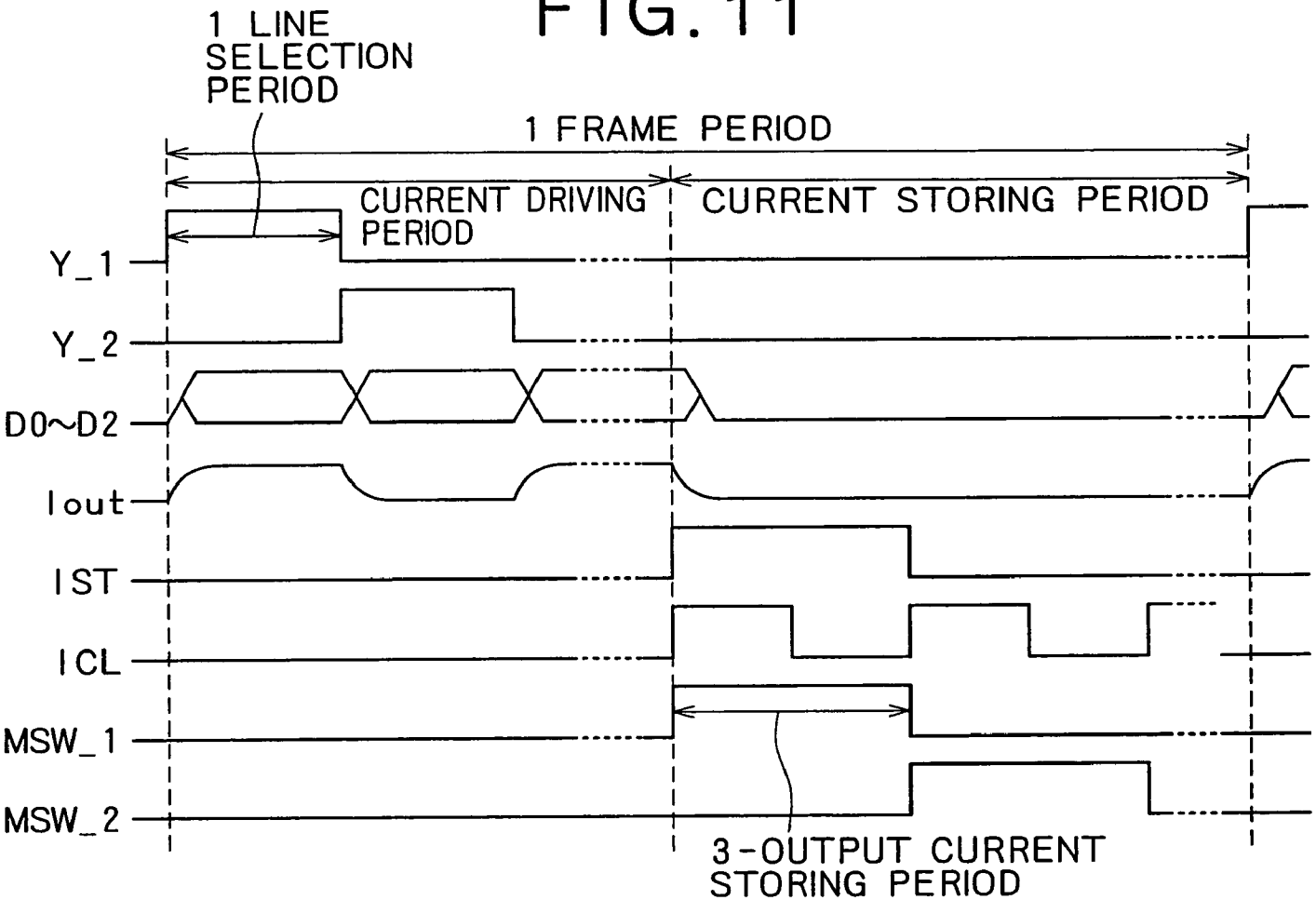
FIG. 11 is a timing chart showing the operation of a semiconductor device for driving a current load device according to a first embodiment of the present invention.

In the following, the operation of the semiconductor device for a light emission display device according to a first embodiment constituted as mentioned above will be explained. FIG. 11 is a timing chart showing the operation of a semiconductor device for a light emission display device according to a first embodiment of the present invention. In FIG. 11, Y_1 and Y_2 show respectively a first line and a second line output signals of a vertical scanning circuit 300 (see FIG. 1), D0, D1 and D2 show respectively 3-bit digital image data (gradation data), Iout shows an output signal of the 1-output D/I conversion portion 230, IST shows a start signal of a shift register constituted by n flip-flops 290, ICL shows a clock signal of the shift register, and MSW_1 and MSW_2 show respectively a first stage and a second stage output signals of the shift register.

A period from the beginning of vertical scanning of a display portion 400 (see FIG. 1) to the next beginning of vertical scanning is called 1 frame. The 1 frame comprises a current driving period (a first operation period) and a current storing period (a second operation period).

First, the current storing period (the second operation period) will be explained. In the current storing period, each 1-bit D/I conversion portion 231 stores reference current supplied from a reference current source. In the present period, all digital gradation data are a low level, and the switch SW1 of the 1-bit D/I conversion portion 231 is OFF.

With the start of the current storing period, a pulse signal is input as a start signal IST into F/F 290_1 of the first stage, and simultaneously with the input of the pulse signal, a clock signal ICL and a clock inverted signal ICLB are input into the F/F 290_1, whereby a shift register constituted by n F/F 290*s* begins to operate. When an output signal MSW_1 of the F/F 290_1 of the first stage assumes a high level, the switches SW2 and SW3 of each 1-bit D/I conversion portion 231 provided in the 1-output D/I conversion portion 230 into which is input the output signal MSW_1 are turned ON. When the switches SW2 and SW3 are turned ON, the current storing and outputting TFT T1 within the 1-bit D/I conversion portion 231 operates in a saturated area because a portion between the gate and the drain is short-circuited. And, in the state that the present operation is stabilized, the gate voltage is set adjusting to the current/voltage characteristics of TFT T1 so that reference current from the reference current source flows between the drain and the source of TFT T1.

After assuming the stabilized state, when the signal MSW_1 assumes a low level and the output signal MSW_2 of F/F of the second stage assumes a high level, the switches SW2 and SW3 of each 1-bit D/I conversion portion 231 within the RGB D/1 conversion portion 220 on which F/F 290_1 is provided are turned OFF, At this time, a gate voltage of TFT T1 within the RGB D/1 conversion portion 220 on which F/F 290_1 is provided is held at a voltage so that reference current is flown by the capacity element C1. As a result, reference current is stored in TFT T1 irrespective of the respective current/voltage characteristics. A period that the signal MSW is held at a high level as described above is termed as a 3-output current storing period in the RGB D/1 conversion portion 220. On the other hand, the switches SW2 and SW3 within the RGB D/1 conversion portion 220 on which F/F of the second stage is provided are turned ON, and in the stabilized state, operation is made in a saturated area so that reference current flows between the drain and the source of TFT T1, and the gate voltage is set adjusting to the current/voltage characteristics of TFT T1 so that the reference current flows.

In the current storing period, the 3-output current storing period as mentioned above is repeated with respect to all the RGB D/1 conversion portions 220, and reference current is stored in all the 1-output D/I conversion portions 230.

Next, the current driving period (the first operation period) will be explained. In the current driving period, the vertical scanning circuit 300 selects the control lines (scanning lines) line by line. FIG. 11 shows scanning pulses Y_1 and Y_2 which are outputs of the first line and the second line, respectively.

When the scanning pulse Y_1 assumes a high level, the control line of the first line is selected, and in synchronous therewith, 3-bit digital gradation data D0 to D2 of the first line for the number of output are input every output into the 1-output D/I conversion portion 230. When the digital gradation data D0 to D2 are input, turning ON/OFF of the switch SW1 within the 1-bit D/I conversion portion 231 is controlled according to levels (high level (H)/low level (L)) thereof, and current having been stored in TFT T1 in the current driving period of the frame directly before is output. The following Table shows a relationship between input digital gradation data D0 to D2 and gradation (output current value).

TABLE 1

| | Gradation Data | | | Output Current Value |
|---|---|---|---|---|
| Gradation | D0 | D1 | D2 | (Current Value of Iout) |
| 0 | L | L | L | 0 |
| 1 | H | L | L | i0 |
| 2 | L | H | L | i1 = 2 × i0 |
| 3 | H | H | L | i1 + i0 = 3 × i0 |
| 4 | L | L | H | i2 = 4 × i0 |
| 5 | H | L | H | i2 + i0 = 5 × i0 |
| 6 | L | H | H | i2 + i1 = 6 × i0 |
| 7 | H | H | H | i2 + i1 + i0 = 7 × i0 |

As shown in Table 1, the output current value can be adjusted by digital gradation data input from 0 to 7×i0. Further, the gate voltage is set so that current equal to the reference current source flows, adjusting to the current/voltage characteristics of TFT T1 in the current storing period (the second operation period), and the same TFT T1 is used to output current, because of which unevenness of output current is small and high accuracy is obtained irrespective of unevenness of the current/voltage characteristics.

On the other hand, in the current driving period (the first operation period), the shift register is not operated, and all the switches SW2 and SW3 always remain to be OFF.

And, such an operation as described above is repeated with respect to each frame whereby the display portion 400 carries out displaying according to the gradation data D0 to D2, and at that time, current of high accuracy is supplied to the pixel circuit.

Figure 4A:
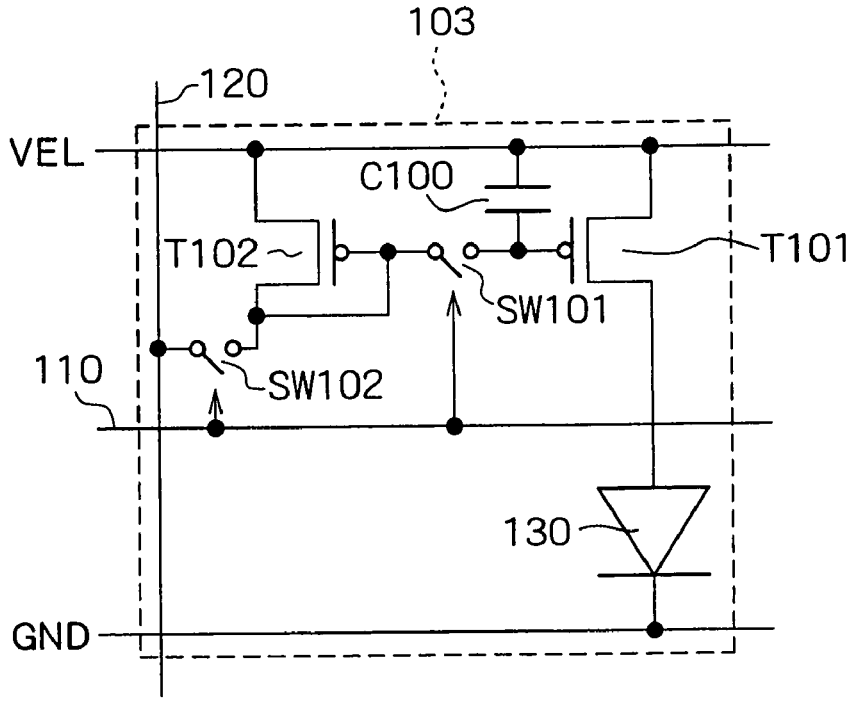
FIG. 4A (PRIOR ART)
FIGS. 4A and 4B are respectively circuit views showing another constitution of a 1-pixel display portion in case of an active matrix drive.

According to the first embodiment as described above, it is possible to supply current at high speed and with high accuracy to a light emission display device having a P channel TFT as shown in FIG. 4A.

Figure 12:
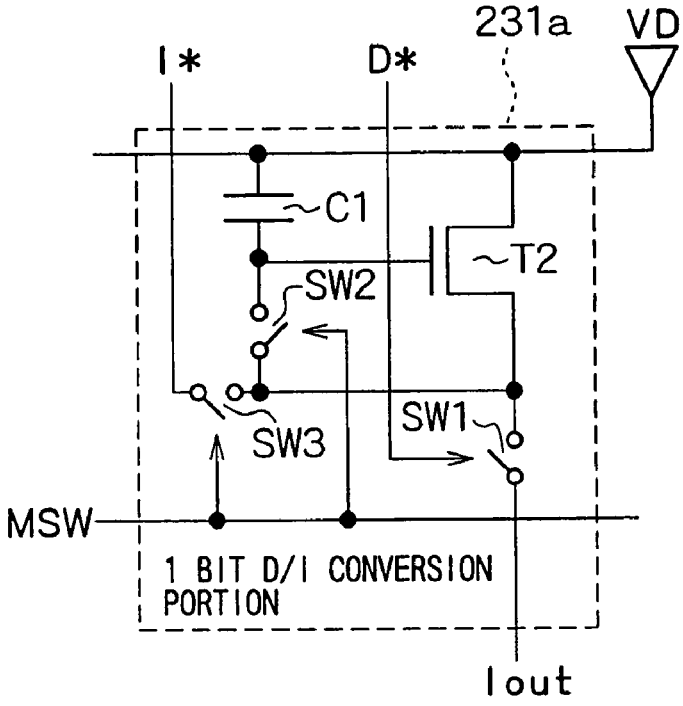
FIG. 12 is a block diagram showing the constitution of a 1-bit D/I conversion portion according to a second embodiment of the present invention.

Next, the second embodiment of the present invention will be explained. In the second embodiment, the constitution of the 1-bit D/I conversion portion in the first embodiment is changed, and for example, the second embodiment is applied to the pixel circuit shown in FIG. 4B. FIG. 12 is a block diagram showing the constitution of a 1-bit D/I conversion portion according to a second embodiment of the present invention.

A 1-bit D/I conversion portion 231*a* according to the second embodiment is provided with a P channel TFT T2 in place of the N channel TFT T1 in the first embodiment, to which source and one end of the capacity element C1 are supplied a power supply potential VD. The voltage VD is a voltage equal to or lower than the voltage VEL, which is a level not posing a problem in terms of operation.

Figure 4B:
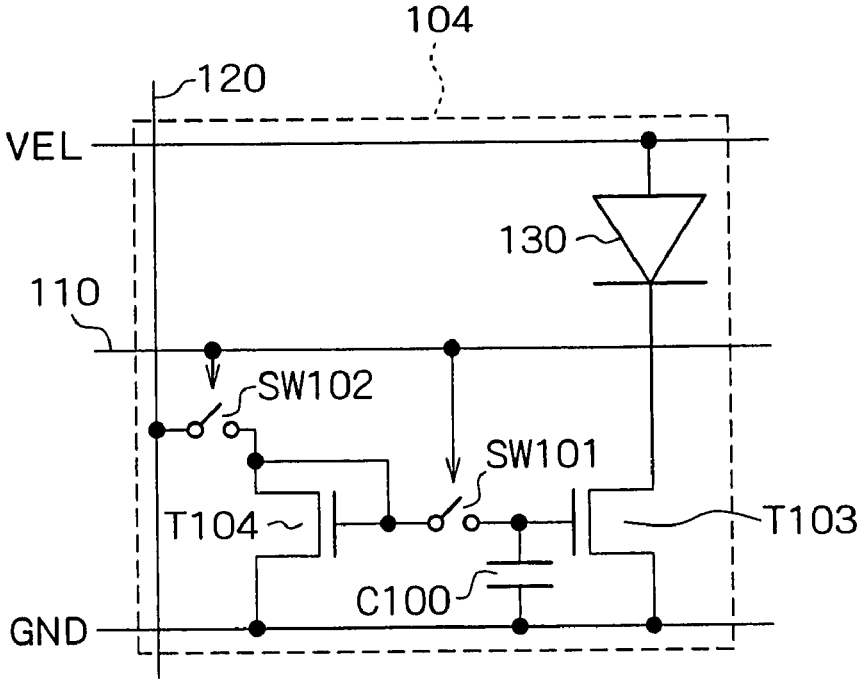
FIG. 4B (PRIOR ART)
Figure 5:
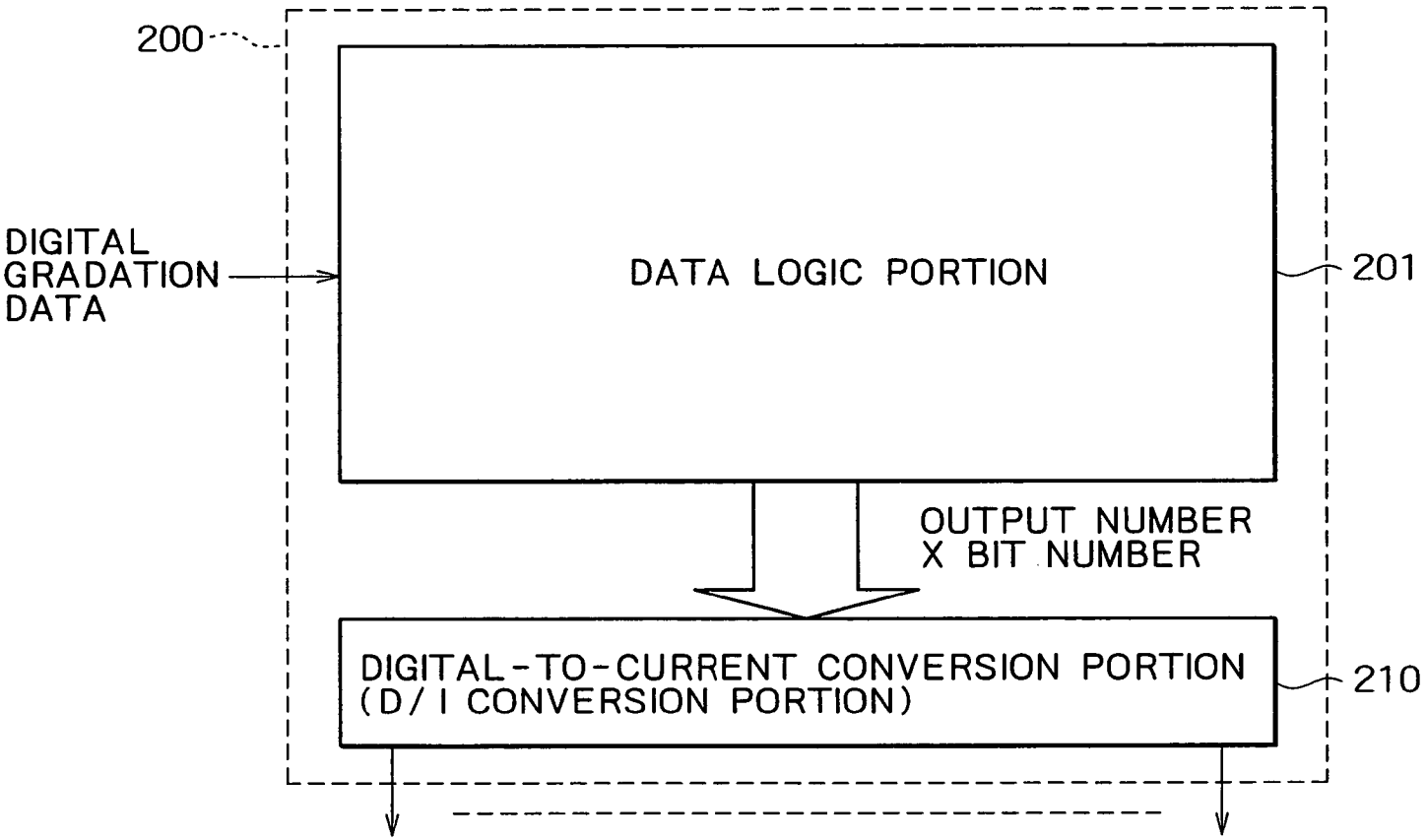
FIG. 5 (PRIOR ART)
FIG. 5 is a block diagram showing one example of a horizontal scanning circuit 200 for outputting current to a display portion 400.
Figure 6:
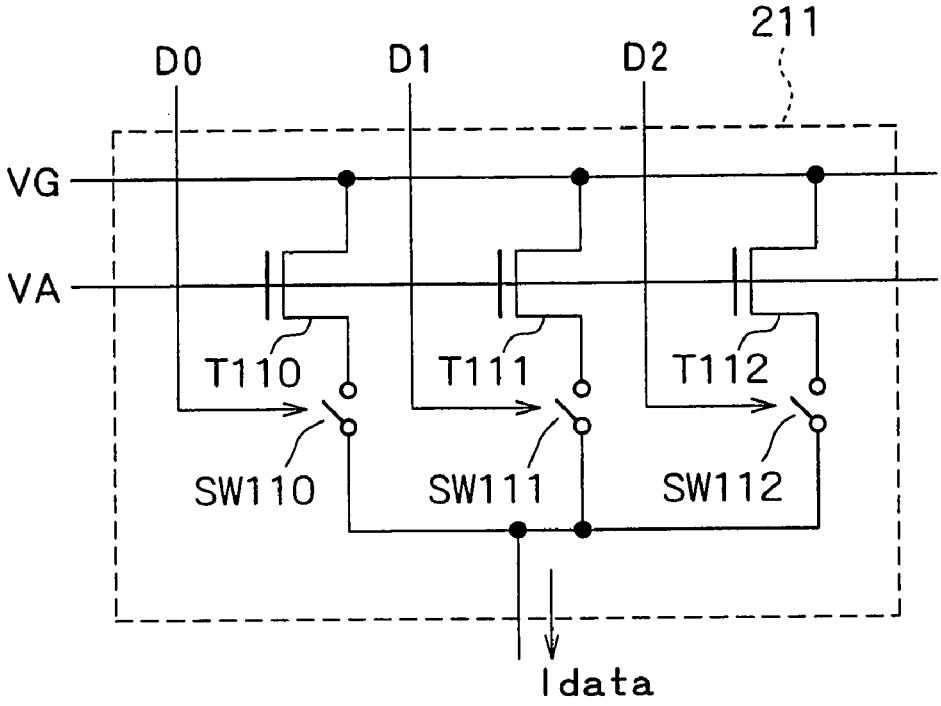
FIG. 6 (PRIOR ART)
FIG. 6 is a circuit view showing a first conventional example of a digital-to-current conversion portion for 1-output.
Figure 7:
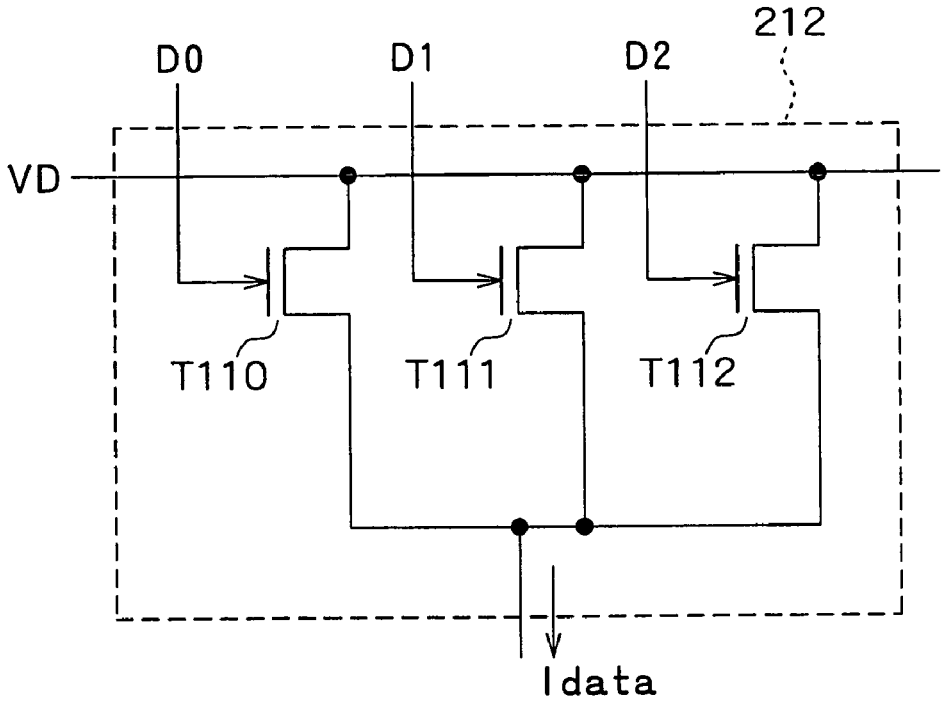
FIG. 7 (PRIOR ART)
FIG. 7 is a circuit view showing a second conventional example of a digital-to-current conversion portion for 1-output.

The first embodiment can be applied to the case where the transistor for causing current of the pixel circuit as shown in FIG. 4A to flow is the P channel TFT, but the second embodiment can be applied to the N channel TFT as shown in FIG. 4B. That is, where TFT within the pixel circuit is the P channel TFT, the source voltage is the voltage VEL, but in case of the N channel TFT, it is necessary that the source voltage be a ground level GND, and the present embodiment can be corresponded thereto.

The operation of the second embodiment is similar to the first embodiment, except that the polarity of output current is changed, and the similar effect is obtained.

Figure 13:
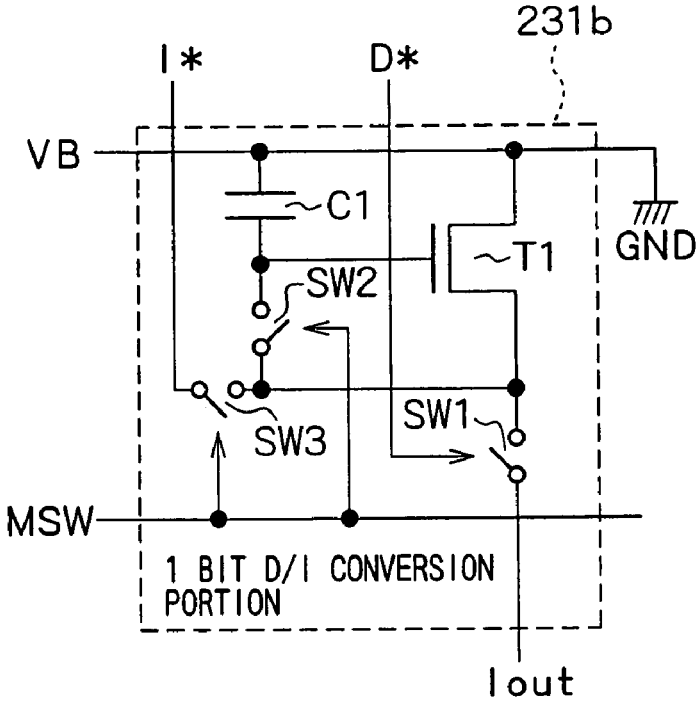
FIG. 13 is a block diagram showing the constitution of a 1-bit D/I conversion portion according to a third embodiment of the present invention.

Next, the third embodiment of the present invention will be explained. In the third embodiment, the constitution of the 1-bit D/I conversion portion in the first embodiment is changed, and for example, the third embodiment is applied to the pixel circuit shown in FIG. 4A. FIG. 13 is a block diagram showing the constitution of a 1-bit D/I conversion portion according to the third embodiment of the present invention.

In a 1-bit D/I conversion portion 231*b* according to the third embodiment, a suitable stabilized voltage VB instead of the ground potential GND is supplied to one end of the capacity element C1.

Figure 14:
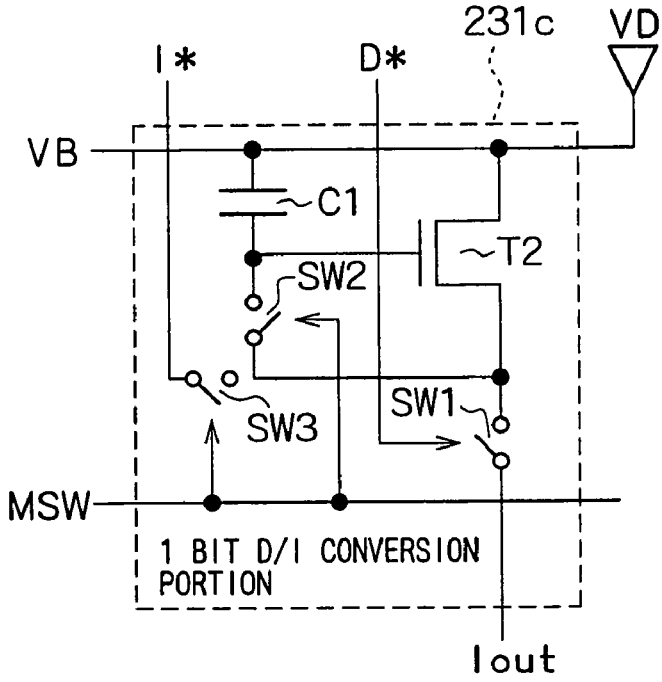
FIG. 14 is a block diagram showing the constitution of a 1-bit D/I conversion portion according to a fourth embodiment of the present invention.

The operation of the third embodiment is similar to the first embodiment, and the similar effect is obtained. This indicates that the voltage supplied to the capacity element C1 may be any voltage as long as it is stabilized. Next, the fourth embodiment of the present invention will be explained. In the fourth embodiment, the constitution of the 1-bit D/I conversion portion in the first embodiment is changed, and for example, the fourth embodiment is applied to the pixel circuit shown in FIG. 4B. FIG. 14 is a block diagram showing the constitution of a 1-bit D/I conversion portion according to the fourth embodiment of the present invention.

In a 1-bit D/I conversion portion 231*c* according to the fourth embodiment, a suitable stabilized voltage VB instead of the ground potential GND is supplied to one end of the capacity element C1, similarly to the third embodiment. Further, a P channel TFT T2 in place of the N channel TFT T1 in the first embodiment is provided similarly to the second embodiment, and a power supply potential VD is supplied to the source and one end of the capacity element C1.

Figure 15:
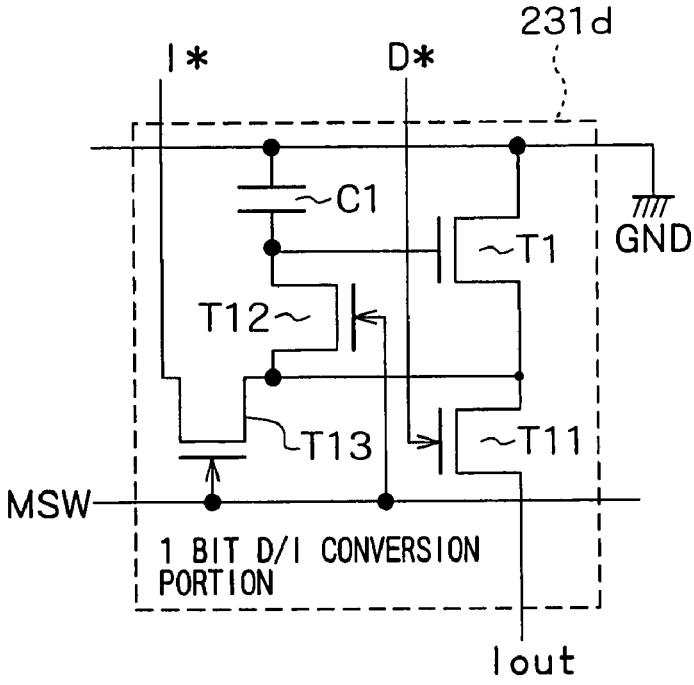
FIG. 15 is a block diagram showing the constitution of a 1-bit D/I conversion portion according to a fifth embodiment of the present invention.

As described above, the fourth embodiment is in the form that the third embodiment is applied to the second embodiment, indicating that the voltage supplied to the capacity element C1 may be any voltage as long as it is stabilized, similarly to the third embodiment. Next, the fifth embodiment of the present invention will be explained. In the fifth embodiment, the constitution of the 1-bit D/I conversion portion in the first embodiment is changed, and for example, the fifth embodiment is applied to the pixel circuit shown in FIG. 4A. FIG. 15 is a block diagram showing the constitution of a 1-bit D/I conversion portion according to the fifth embodiment of the present invention.

In a 1-bit D/I conversion portion 231*d* according to the fifth embodiment, N channel transistors T11 to T13 in place of the switches SW1 to SW3 in the first embodiment are provided.

Also in the fifth embodiment as described, the operation similar to the first embodiment is carried out on the basis of the timing chart shown in FIG. 11, and the similar effect is obtained. It is noted that P channel transistors may be used in place of the N channel transistors T11 to T13. In this case, in the timing chart, the output signal of F/F is made to be a signal that one shown in FIG. 11 is inverted.

Figure 16:
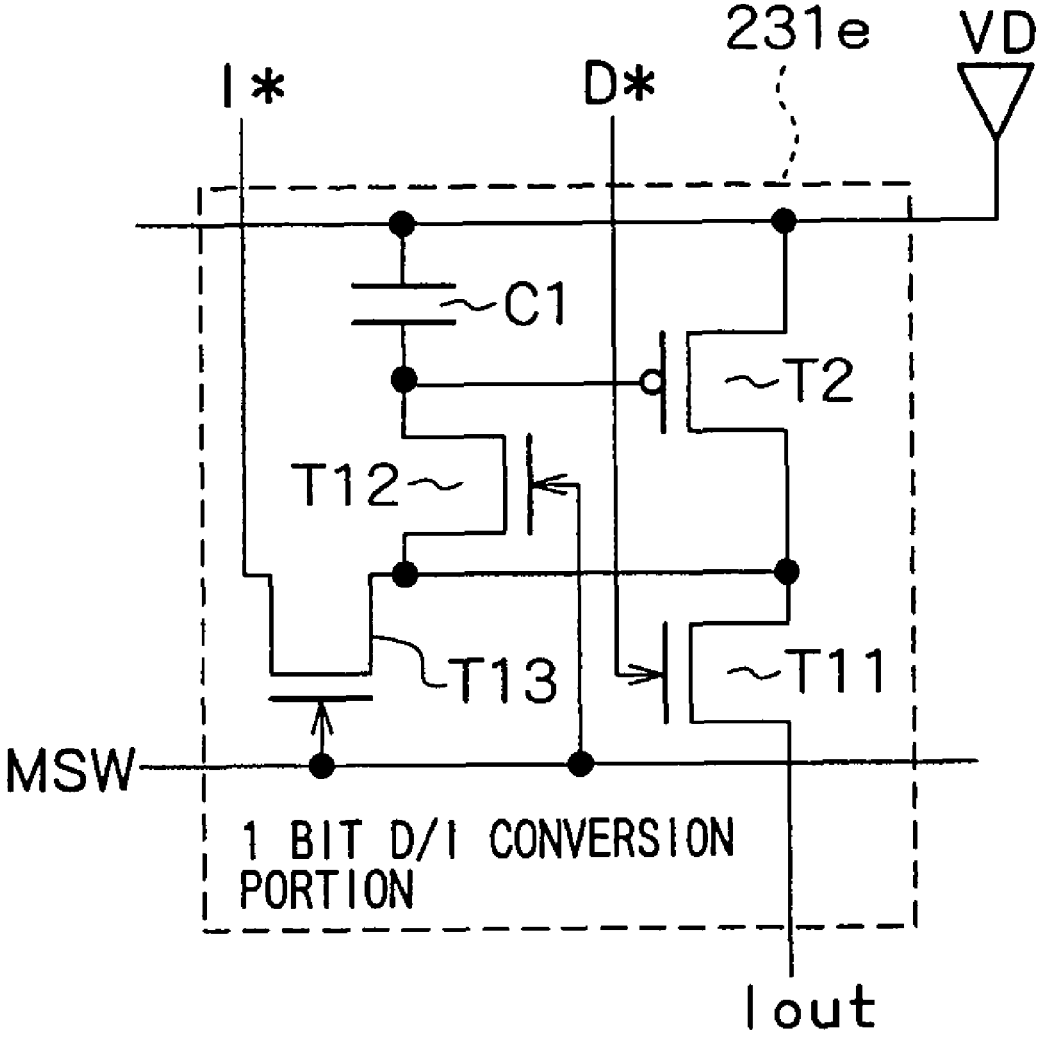
FIG. 16 is a block diagram showing the constitution of a 1-bit D/I conversion portion according to a sixth embodiment of the present invention.

Next, the sixth embodiment of the present invention will be explained. In the sixth embodiment, the constitution of the 1-bit D/I conversion portion in the first embodiment is changed, and for example, the sixth embodiment is applied to the pixel circuit shown in FIG. 4B. FIG. 16 is a block diagram showing the constitution of a 1-bit D/I conversion portion according to the sixth embodiment of the present invention.

In a 1-bit D/I conversion portion 231*e* according to the sixth embodiment, N channel transistors T11 to T13 in place of the switches SW1 to SW3 in the second embodiment are provided.

Also in the sixth embodiment as described, the operation similar to the second embodiment is carried out on the basis of the timing chart shown in FIG. 11, and the similar effect is obtained. It is noted that P channel transistors may be used in place of the N channel transistors T11 to T13. In this case, in the timing chart, the output signal of F/F is made to be a signal that one shown in FIG. 11 is inverted.

Figure 17:
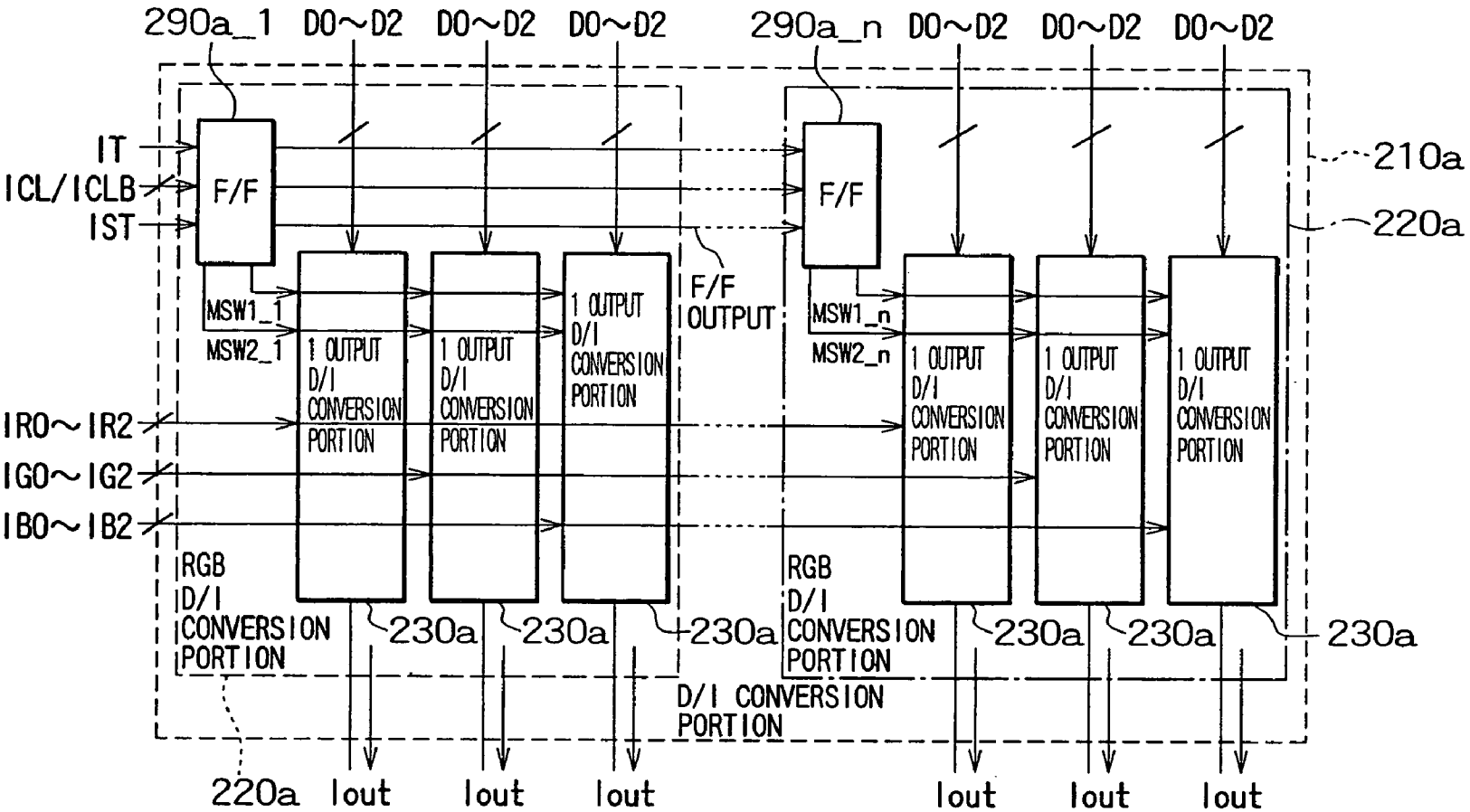
FIG. 17 is a block diagram showing the constitution of a semiconductor device for a light emission display device according to a seventh embodiment of the present invention.

Next, the seventh embodiment of the present invention will be explained. The seventh embodiment is, for example, applied to the pixel circuit shown in FIG. 4A. FIG. 17 is a block diagram showing the constitution of a semiconductor device for a light emission display device according to a seventh embodiment of the present invention.

In the seventh embodiment, a D/I conversion portion 210*a* is provided, and the D/I conversion portion 210*a* is provided with a shift register comprising a 1-output D/I conversion portion 230*a* for the outputs of (3×n) to the light emission display device, and n flip-flops (F/F) 290*a*_1 to 290*a*__*n* provided every 3-output. Into the shift register are input a start signal IST for controlling timing for storing current, a clock signal ICL, an inverted signal ICLB of the clock signal ICL, and a current storing timing signal IT. Further, digital image data D0 to D2 of each output are input into the 1-output D/I conversion portion 230*a*, and any of reference current IR0 to IR2, IG0 to IG2, and IB0 to IB2 for reference are input according to light emitting colors assigned thereto. One F/F 290*a*, and three 1-output D/I conversion portions 230*a* into which are input signals MSW1 and MSW2 output from the F/F 290*a* constitute one RGB D/I conversion portion 220*a*.

Figure 18:
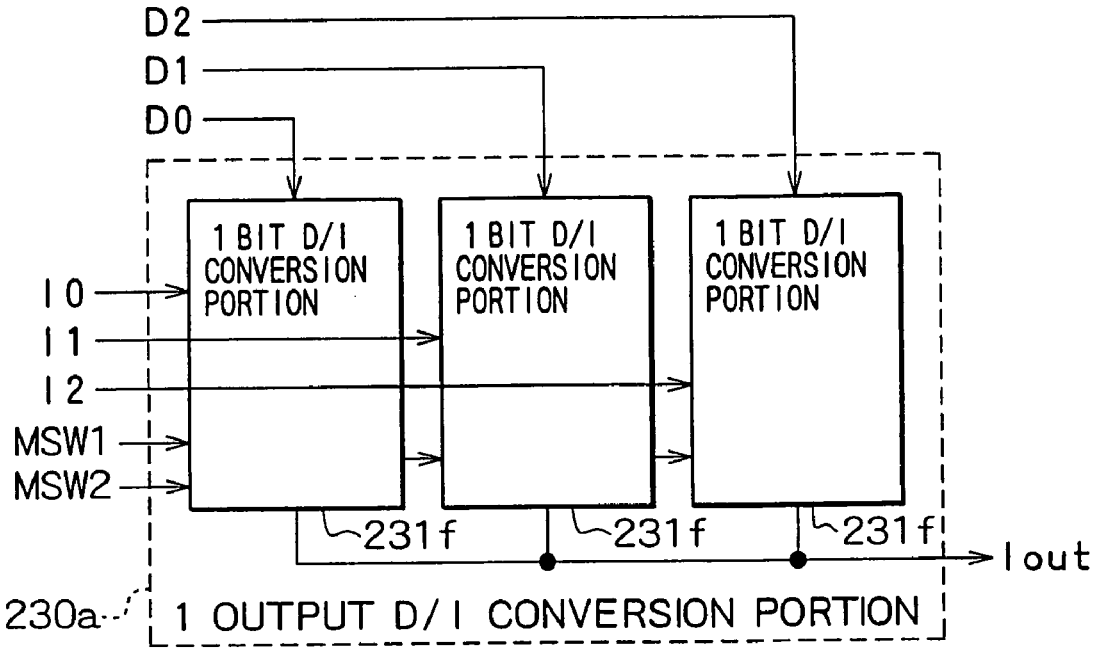
FIG. 18 is a block diagram showing the constitution of a 1-output D/I conversion portion 230*a*.

FIG. 18 is a block diagram showing the constitution of a 1-output D/I conversion portion 230*a*. The 1-output D/I conversion portion 230*a* comprises three 1-bit D/I conversion portions 231*f*. Any of a combination of image data D0 and reference current I0, a combination of image data D1 and reference current I1, and a combination of image data D2 and reference current I2 is input into these 1-bit D/I conversion portions 231*f*, and signals MSW1 and MSW2 which are output signals of F/F are input.

Figure 19:
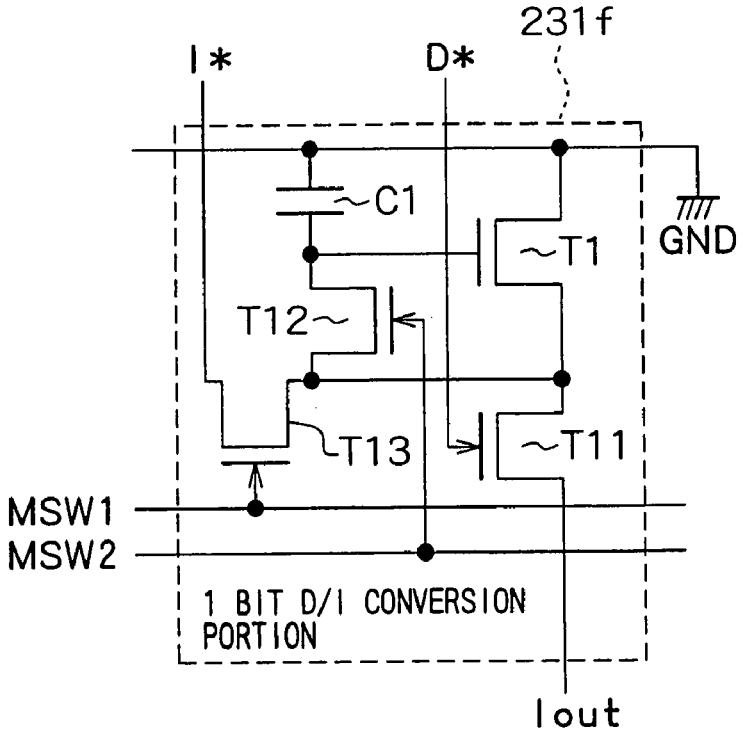
FIG. 19 is a block diagram showing the constitution of a 1-bit D/I conversion portion 231*f*.

FIG. 19 is a block diagram showing the constitution of the 1-bit D/I conversion portions 231*f*. The 1-bit D/I conversion portions 231*f* is provided, similar to the fifth embodiment, with the current storing and outputting transistor N channel TFT T1, N channel transistors T11 to T13, and the capacity element C1. The gradation data D0, the signal MSW2 and the signal MSW1 are input into the gates of the transistors T11, T12, and T13, respectively, and the transistors are controlled by these signals.

Figure 20:
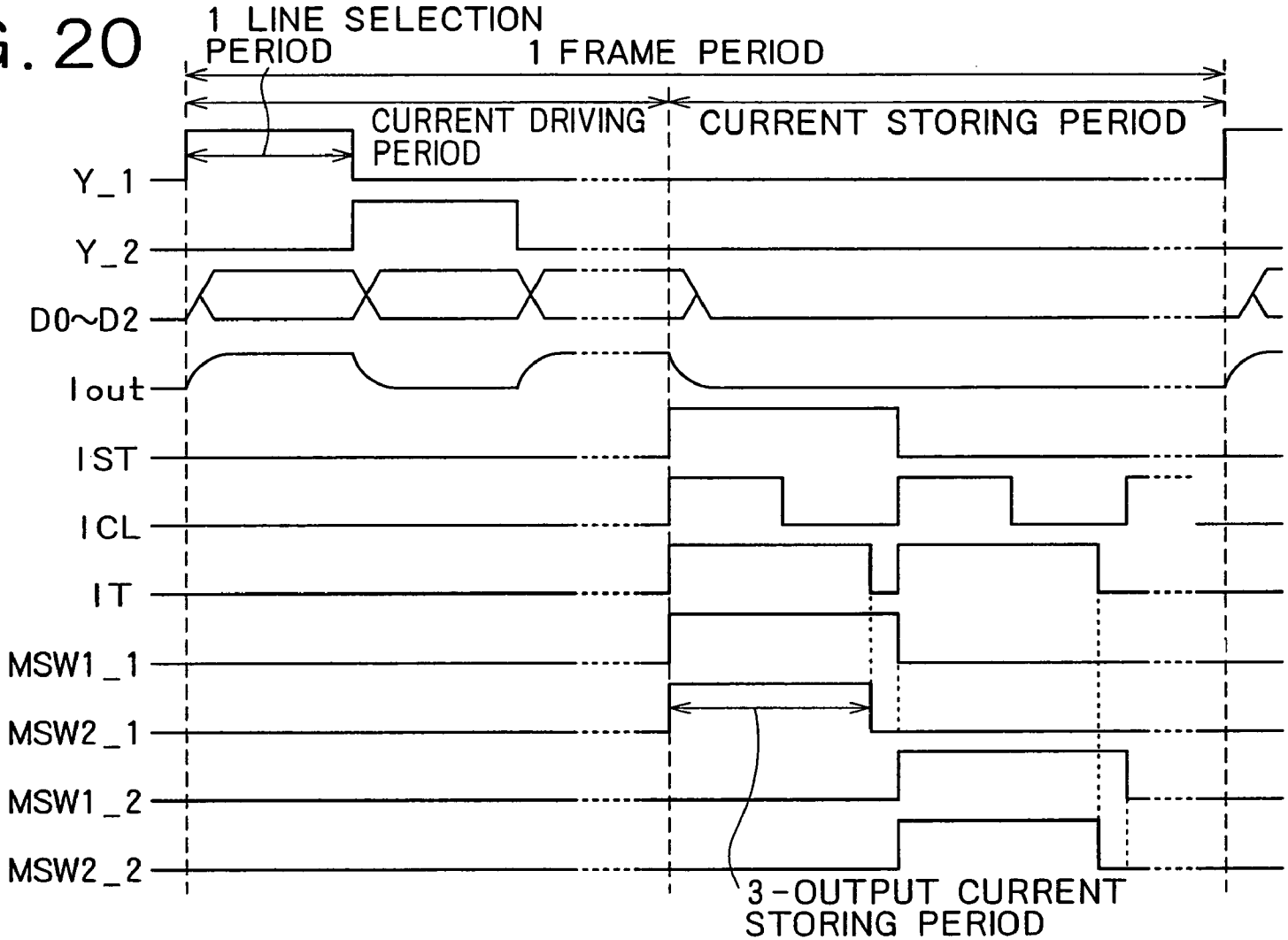
FIG. 20 is a timing chart showing the operation of a semiconductor device for driving a current load device according to a seventh embodiment of the present invention.

Next, the operation of the semiconductor device for a light emission display device according to the seventh embodiment constituted as described above will be explained. FIG. 20 is a timing chart showing the operation of the semiconductor device for a light emission display device according to the seventh embodiment of the present invention.

According to the present embodiment, in the current storing period, the signal MSW1 changes similarly to the signal MSW1 in the first embodiment, as shown in FIG. 20. Further, the current storing timing signal IT rises in synchronism with rising of the signals MSW1, and falls at a timing earlier than the signal MSW. And the signal MSW2 rises at the same timing as the signal MSW1, and falls in synchronism with the falling of the current storing timing signal IT. The period during which the signal MSW2 rises is termed as a 3-output current storing period in the RGB D/I conversion portion 220*a*.

In the seventh embodiment as described above, in the 1-bit D/I conversion portions 231*f*, only the transistor T12 is turned OFF at the termination of the 3-output current storing period, and afterwards, the transistor T13 is turned OFF. Accordingly, the gate voltage of TFT T1 in the state that reference current flows stably between the drain and the source is held more positively without being affected by noises when the transistor T13 is turned OFF. Because of this, in the present embodiment, current of higher accuracy than the fifth embodiment can be supplied.

Figure 21:
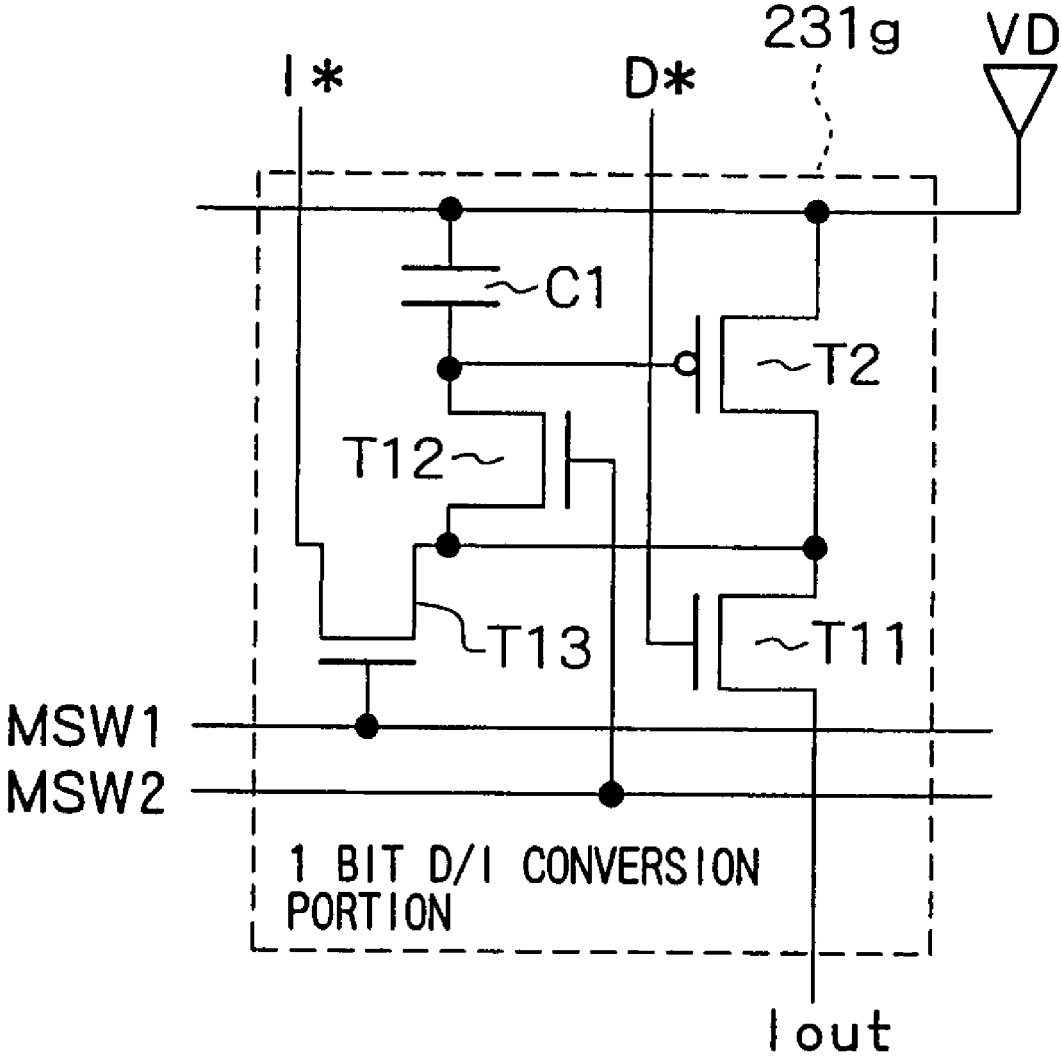
FIG. 21 is a block diagram showing the constitution of a 1-bit D/I conversion portion according to an eighth embodiment of the present invention.

Next, the eighth embodiment of the present invention will be explained. In the eighth embodiment, the constitution of the 1-bit D/I conversion portion in the seventh embodiment is changed, and for example, the eighth embodiment is applied to the pixel circuit shown in FIG. 4B. FIG. 21 is a block diagram showing the constitution of the 1-bit D/I conversion portion in the eighth embodiment of the present invention.

A 1-bit D/I conversion portion 231*g* in the eighth embodiment is provided with a P channel TFT T2 in place of the N channel TFT T1 in the seventh embodiment, and a power supply potential VD is supplied to the source thereof and one end of the capacity element C1.

It is noted that the operation of the eighth embodiment is similar to that of the seventh embodiment except that the polarity of output current is changed, and the similar effect is obtained. For example, current of higher accuracy than the sixth embodiment can be supplied.

Figure 22:
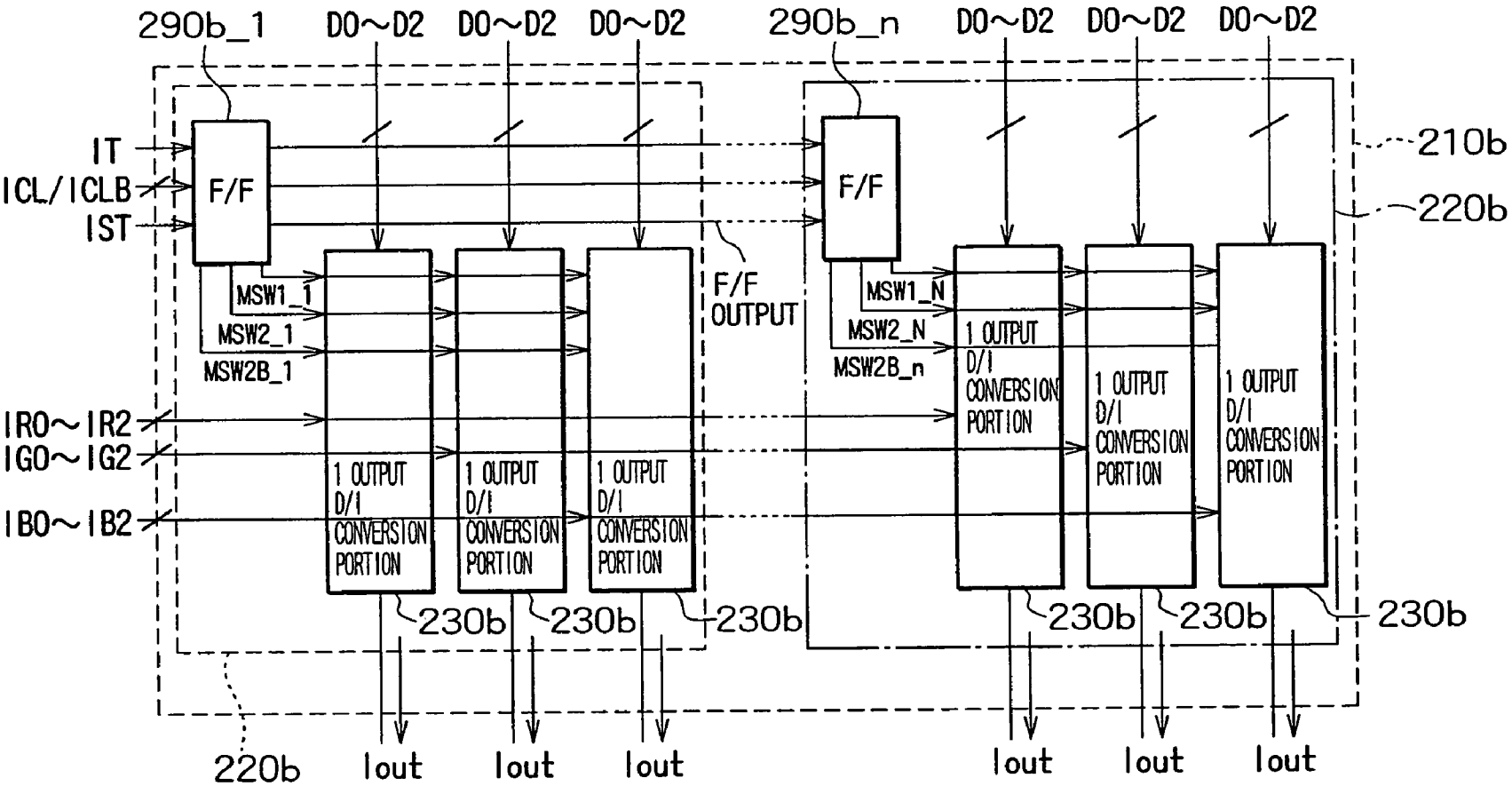
FIG. 22 is a block diagram showing the constitution of a semiconductor device for driving a current load device according to a ninth embodiment of the present invention.

Next, the ninth embodiment of the present invention will be explained. The ninth embodiment is, for example, applied to the pixel circuit shown in FIG. 4A. FIG. 22 is a block diagram showing the constitution of the semiconductor device for a light emission display device according to the ninth embodiment of the present invention.

In the ninth embodiment, a D/I conversion portion 210*b* is provided. The D/I conversion portion 210*b* is provided with a shift register comprising a 1-output D/I conversion portion 230*b* for outputs of (3×n) to the light emission display device, and n flip-flops (F/F) 290*b*_1 to 290*b*_*n* provided every 3-output. Into the shift register are input a start signal IST for controlling timing for storing current, a clock signal ICL, an inverted signal ICLB of the clock signal ICL, and a current storing timing signal IT. Further, digital image data D0 to D2 of each output are input into the 1-output D/I conversion portion 230*b*, and any of reference current IR0 to IR2, IG0 to IG2, and IB0 to IB2 for reference are input according to light emitting colors assigned thereto. One F/F 290*b*, and three 1-output D/I conversion portions 230*b* into which are input signals MSW1, MSW2 and MSW2B output from the F/F290*b* constitute one RGB D/I conversion portion 220*b*. Note that the signal MSW2B is an inverted signal of the signal MSW2.

Figure 23:
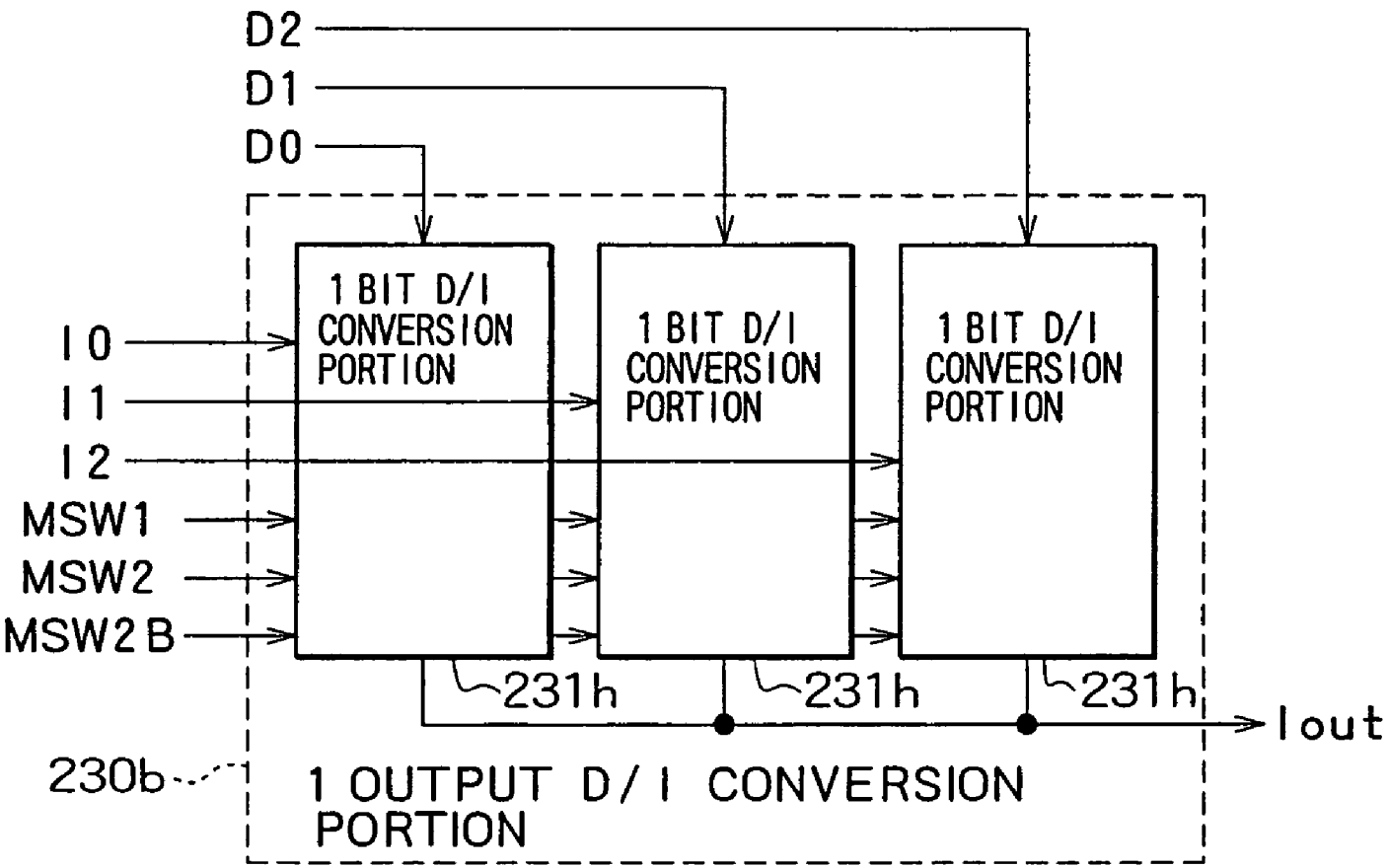
FIG. 23 is a block diagram showing the constitution of a 1-output D/I conversion portion 230*b*.

FIG. 23 is a block diagram showing the constitution of the 1-output D/I conversion portion 230*b*. The 1-output D/I conversion portion 230*b* comprises three 1-bit D/I conversion portions 121*h*. Into these 1-bit D/I conversion portions 121*h* are input any of a combination of image data D0 and reference current I0, a combination of image data D1 and reference current I1, and a combination of image data D2 and reference current I2, and signals MSW1, MSW2 and MSW2B which are output signals of F/F are input.

Figure 24:
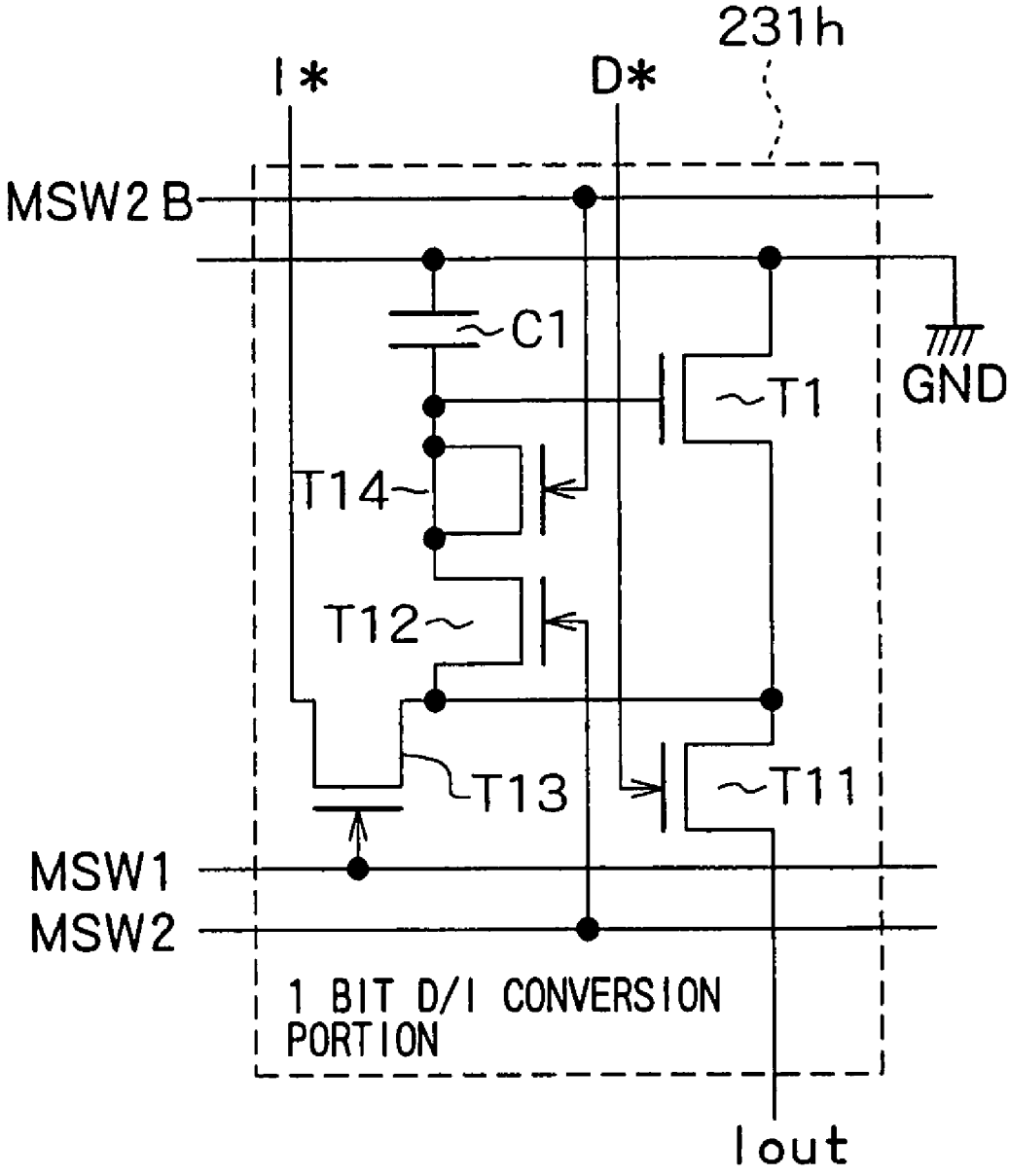
FIG. 24 is a block diagram showing the constitution of a 1-bit D/I conversion portion 231*h*.

FIG. 24 is a block diagram showing the constitution of the 1-bit output D/I conversion portion 231*h*. The 1-bit output D/I conversion portion 231*h* is provided, similarly to the seventh embodiment, with the current storing and outputting transistor N channel TFT T1, N channel transistors T11 to T13 and the capacity element C1. Gradation data D0, a signal MSW2, and a signal MSW1 are input into the gates of the transistors T11, T12 and T13, and the transistors are controlled by these signals. In the present embodiment, an N channel transistor T14 is connected between the N channel transistor T12 and one end of the capacity element C1. The source and the drain of the N channel transistor 14 are short-circuited each other, and the signal MSW2B is input into the gate thereof. And the gate of the TFT T1 is connected to a contact between the drain of the N channel transistor 14 and one end of the capacity element C. The product of the transistor length L and the transistor width W of the transistor T14 is one half the product of the transistor length L and the transistor width W of the transistor T12.

The semiconductor device for a light emission display device according to the ninth embodiment constituted as described above is operated, similarly to the seventh embodiment, on the basis of the timing chart shown in FIG. 20. However, a waveform of the signal MSW2B is one in which a waveform of the signal MSW2 is inverted.

Accordingly, in the 1-bit D/I conversion portion 231*h*, at the termination of the 3-output current storing period, the transistor T12 is turned OFF, and simultaneously therewith, the transistor T14 is turned ON, after which the transistor T13 is turned OFF. Because of this, the gate voltage of TFT T1 in the state that reference current is caused to flow stably between the drain and the source is not affected by the noise when the transistor T13 is turned OFF, and movement of a load caused when the transistor T12 is turned ON is also absorbed by turning-ON of the transistor T14 and is held more accurately. As described above, current of higher accuracy than the seventh embodiment can be supplied.

Figure 25:
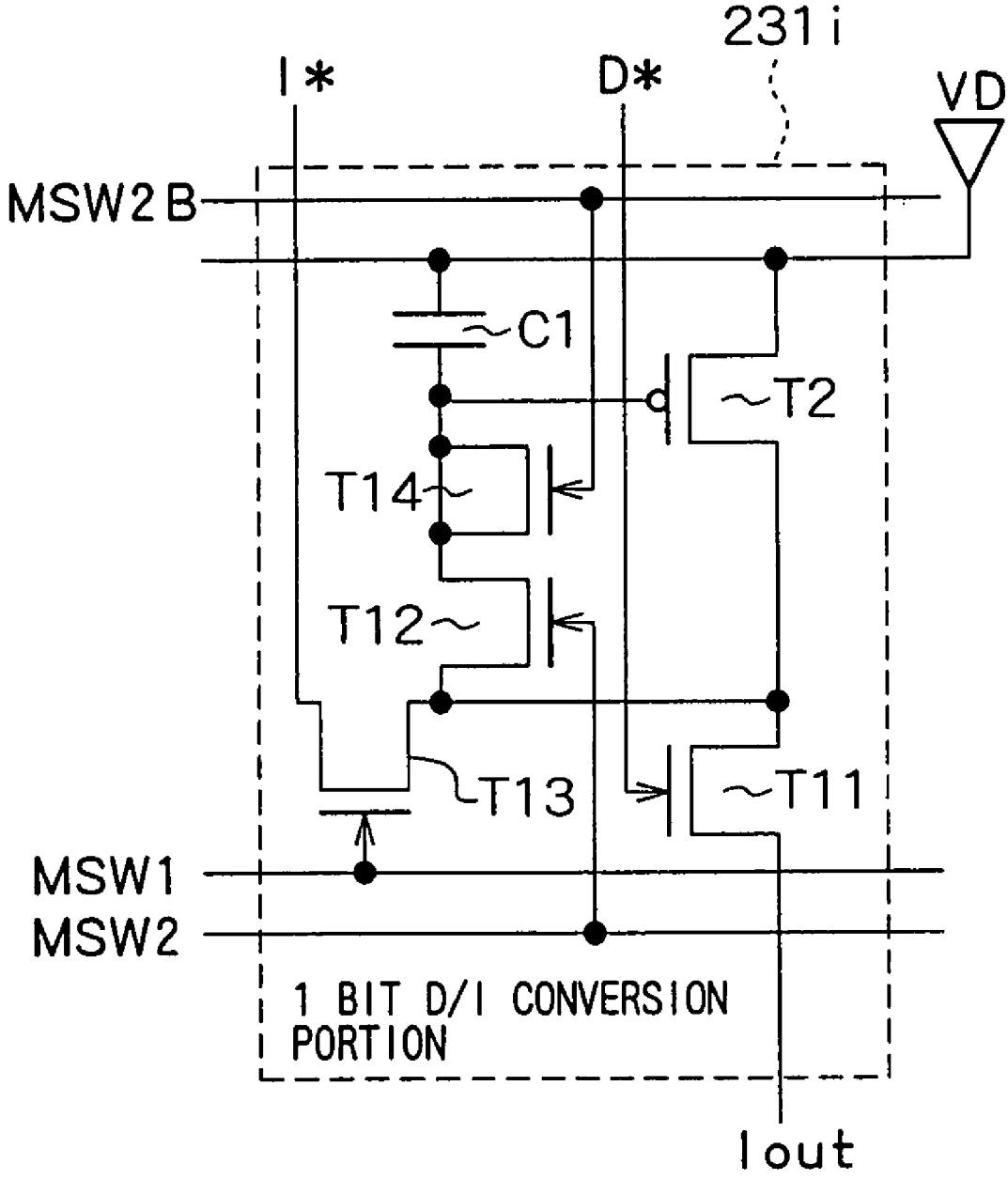
FIG. 25 is a block diagram showing the constitution of a 1-bit D/I conversion portion according to a tenth embodiment of the present invention.

Next, the tenth embodiment of the present invention will be explained. In the tenth embodiment, the constitution of the 1-bit D/I conversion portion in the ninth embodiment is changed, and for example, the tenth embodiment is applied to the pixel circuit shown in FIG. 4B. FIG. 25 is a block diagram showing the constitution of a 1-bit D/I conversion portion according to the tenth embodiment of the present invention.

In a 1-bit D/I conversion portion 231*i* according to the tenth embodiment, a P channel TFT T2 is provided in place of the N channel TFT T1 in the ninth embodiment, and a power supply potential VD is supplied to the source and one end of the capacity element C1.

It is noted that the operation of the tenth embodiment is similar to the ninth embodiment except that the polarity of output current is changed, and the similar effect is obtained. For example, current of higher accuracy than the eighth embodiment.

Figure 37:
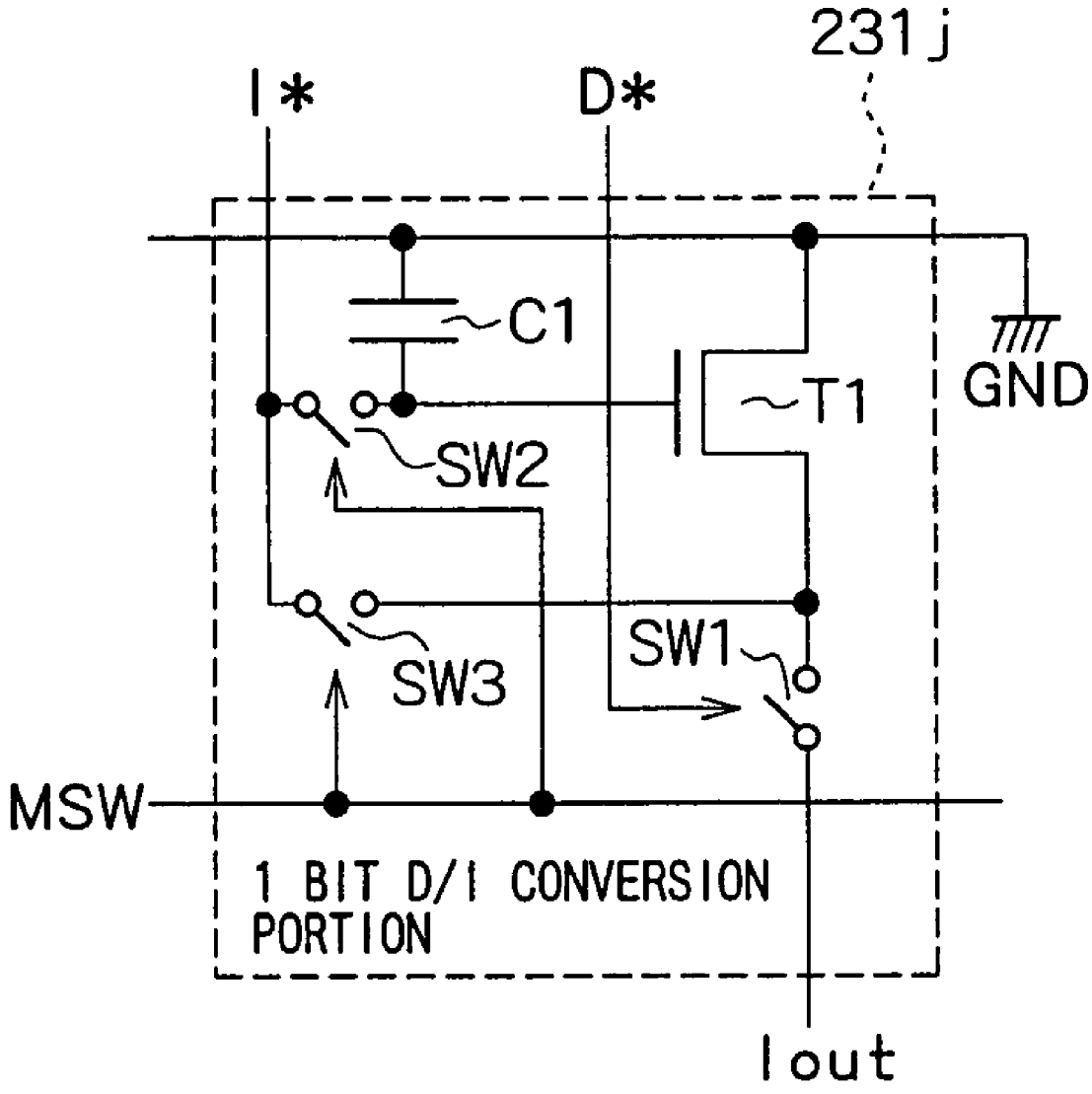
FIG. 37 is a block diagram showing the constitution of a 1-bit D/I conversion portion according to an eleventh embodiment of the present invention.

Next, the eleventh embodiment of the present invention will be explained. In the eleventh embodiment, the constitution of the 1-bit D/I conversion portion in the first embodiment is changed, and the eleventh embodiment is, for example, applied to the pixel circuit shown in FIG. 4A. FIG. 37 is a block diagram showing the constitution of the 1-bit D/I conversion portion in the eleventh embodiment of the present invention.

In a 1-bit D/I conversion portion 231*j* in the eleventh embodiment, both ends of SW2 are not connected to a contact between the switch SW1 and TFTI and the gate of TFT T1, respectively, but connected to a signal line to which reference current I * is supplied and the gate of TFT T1.

The operation of the eleventh embodiment is similar to that of the first embodiment, and the similar effect is obtained. Further, the change as in the second and the tenth embodiments with respect to the first embodiment can be carried out.

Figure 38:
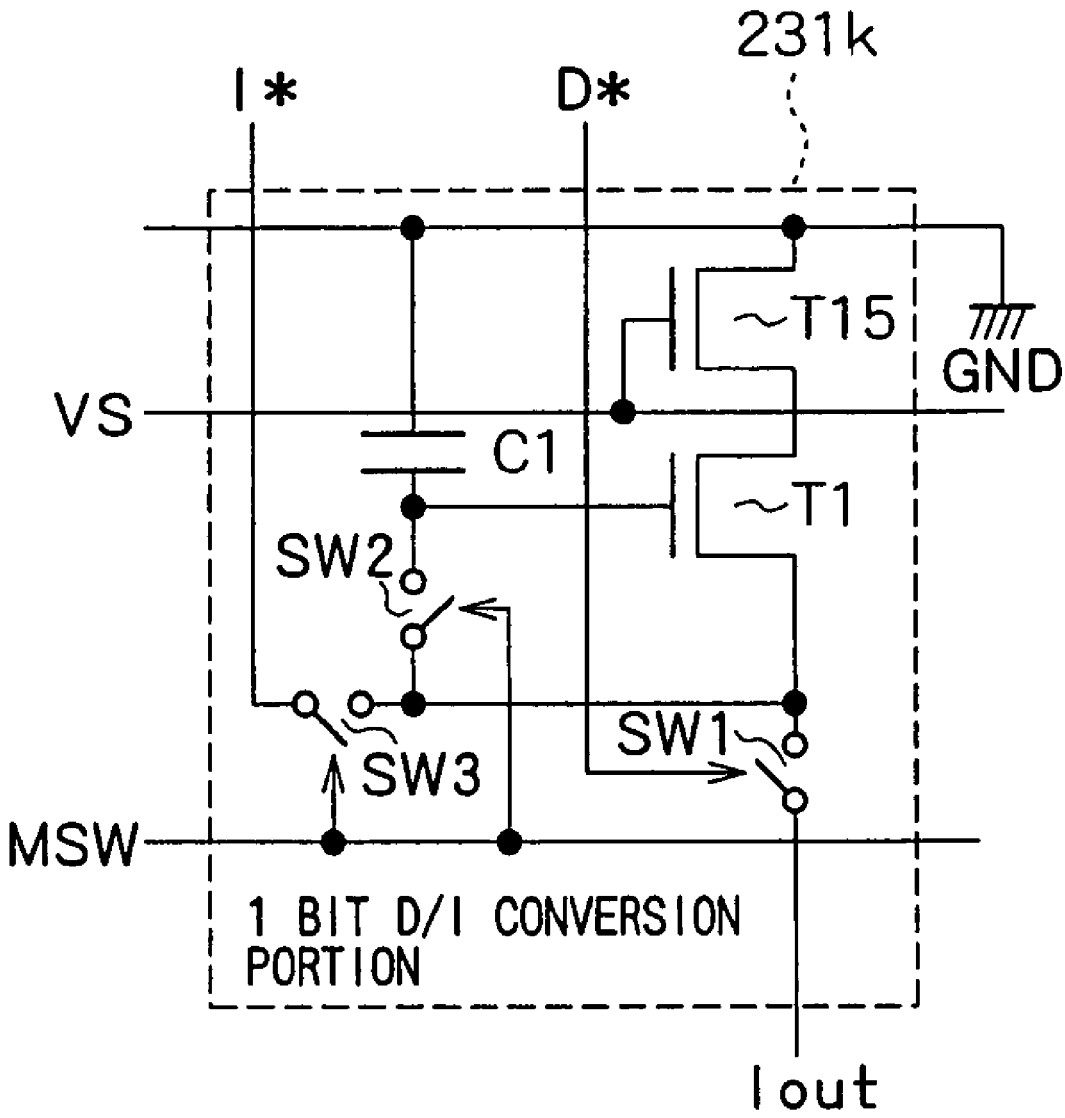
FIG. 38 is a block diagram showing the constitution of a 1-bit D/I conversion portion according to a twelfth embodiment of the present invention.

Next, the twelfth embodiment of the present invention will be explained. In the twelfth embodiment, the constitution of the 1-bit D/I conversion portion in the eleventh embodiment is changed. For example, the twelfth embodiment is applied to the pixel circuit shown in FIG. 4. FIG. 38 is a block diagram showing the constitution of a 1-bit D/I conversion portion according to the twelfth embodiment.

In the 1-bit D/I conversion portion 231*k* according to the twelfth embodiment, TFT T15 is added between TFT T1 and the GND line, and a suitable voltage VS1 is applied to the gate of TFT T15.

The operation of the twelfth embodiment is similar to that of the first embodiment, and the similar effect is obtained. Further, since in the embodiment, the added TFT T15 and TFT T1 are cascode connected, the drain voltage dependability of drain current in the saturated area of TFT1 is flattened to enable improving accuracy of output current Iout. In addition, the present embodiment is able to carryout the change as in the second to the tenth embodiments with respect to the first embodiment.

Figure 26:
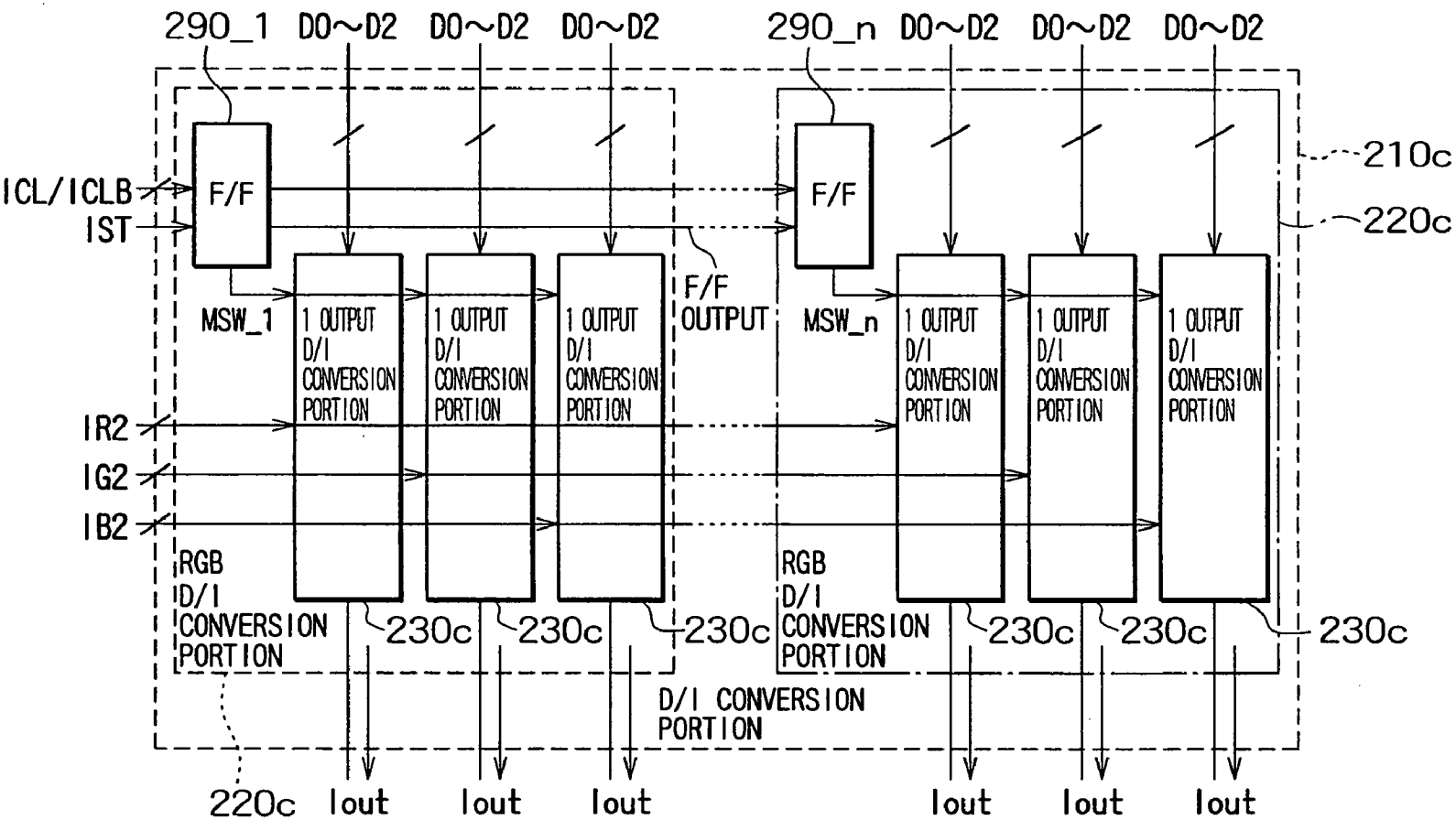
FIG. 26 is a block diagram showing the constitution of a semiconductor device for driving a current load device according to a thirteenth embodiment of the present invention.

Next, the thirteenth embodiment of the present invention will be explained. The thirteenth embodiment is, for example, applied to the pixel circuit shown in FIG. 4A, and can be used where current/voltage characteristics unevenness in the close area is small. FIG. 26 is a block diagram showing the constitution of the semiconductor device for a light emission display device according to the eleventh embodiment of the present invention.

In the thirteenth embodiment, a D/I conversion portion 210*c* is provided. The D/I conversion portion 210*c* is provided with a shift register comprising a 1-output D/I conversion portion 230*c* for outputs of (3×n) to the light emission display device, and n flip-flops (F/F) 290_1 to 290_n. Into the shift register are input a start signal IST for controlling timing for storing current, a clock signal ICL, and an inverted signal ICLB of the clock signal ICL is input. Further, digital image data D0 to D2 of each output are input into the 1-output D/I conversion portion 230*c*, and any of reference current IR2, IG2, and IB2 for reference current are input according to light emitting color assigned thereto. One F/F290 and three 1-output D/I conversion portions 230*c* into which is input a signal MSW output from the F/F290 constitute one RGB D/I conversion portion 220*c*.

The current values of reference current are adjusted to the current brightness characteristics in which light emitting colors are red, blue, and green. A current value ir2 of reference current IR2 corresponds to the fourth gradation in which light emitting color is red, a current value ig2 of reference current IG2 corresponds to the fourth gradation in which light emitting color is green, and a current value ib2 of reference current IB2 corresponds to the fourth gradation in which light emitting color is blue. That is, reference current supplied to the 1-output D/I conversion portion 230*c* for displaying red (R) is reference current IR2 corresponding to brightness of the fourth gradation of the luminous element for displaying red. However, since the current-brightness characteristics of the luminous element has a proportional relation, assuming that the current value corresponding to the first gradation is ir0, ir2=4×ir0 results. Likewise, reference current IG2 or IB2 is input into the 1-output D/I conversion portion 230*c* for displaying green (G) or blue (B). Accordingly, in the present embodiment, the minimum value of reference current input is four times of that of the first embodiment. The reason for causing reference current to correspond to the fourth gradation is that design was made so that as will be described later, current ability of N channel TFT T23 for storing current provided in the 1-output D/I conversion portion becomes equal to current ability of N channel TFT T23 for outputting current corresponding to the fourth gradation.

Figure 27:
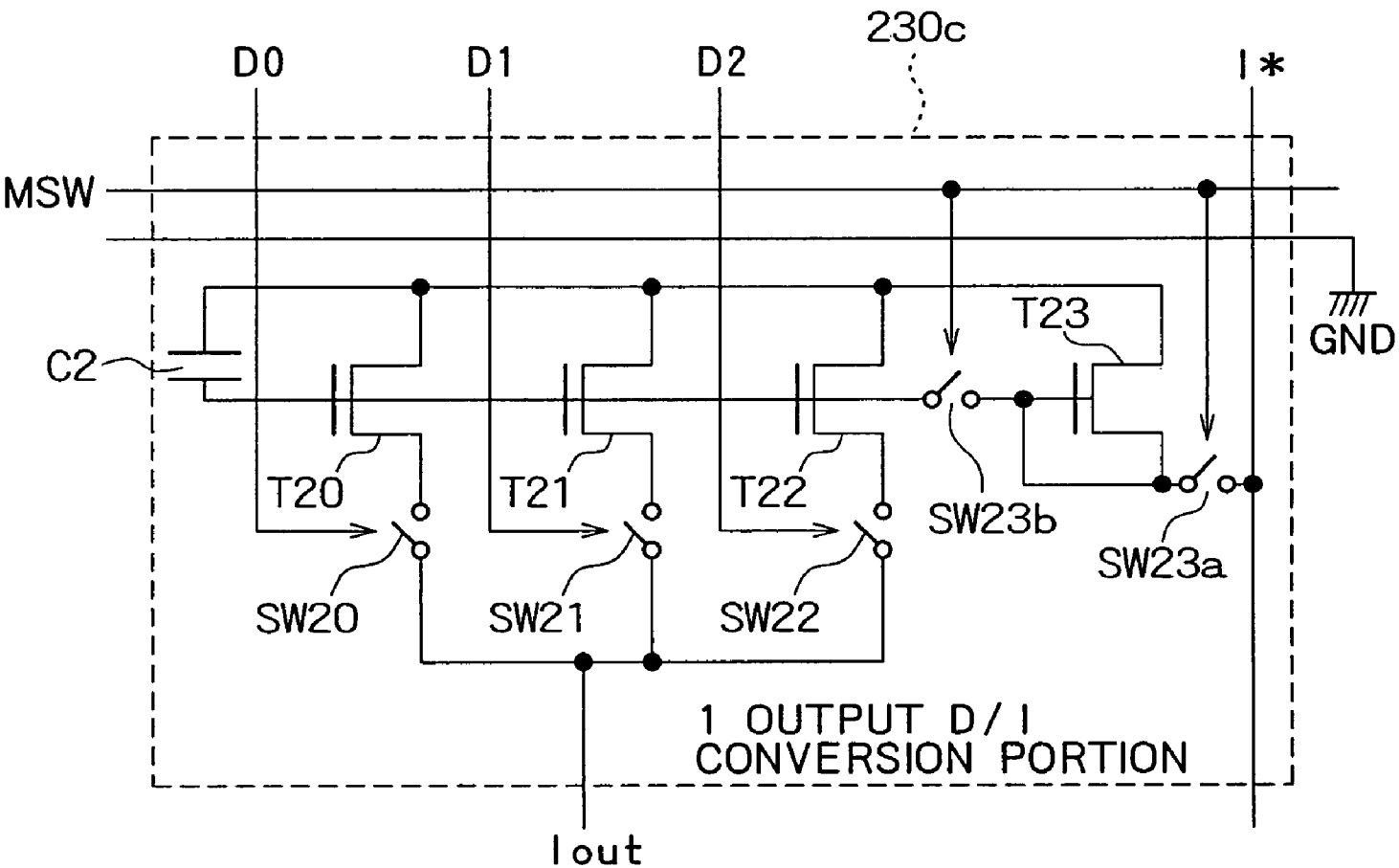
FIG. 27 is a block diagram showing the constitution of a 1-output D/I conversion portion 230*c*.

FIG. 27 is a block diagram showing the constitution of the 1-output D/I conversion portion 230*c*. The 1-output D/I conversion portion 230*c* is provided with a switch SW23*a* controlled by a signal MSW and to one end of which is supplied reference current I*. A drain and a gate of an N channel TFT T23 are connected in common to the other end of the switch 23*a*. A source of TFT T23 is grounded. One end of a switch SW23*b* controlled by signal MSW is connected to the drain and the gate of the N channel TFT T23, and gates of N channels TFT T20 to T22 and one end of the capacity element C2 are connected in common to the other end thereof. The sources of TFT T20 to T22 and the other end of the capacity element C2 are grounded. Switches SW20, SW21 and SW22 controlled by gradation data D0, D1 and D2, respectively, are connected to the drains of TFT T20, T21 and T22, and the other ends of these switches SW20 to SW22 are connected in common. Output current Iout is output from the common connected point. The current ability ratio of TFT T20, T21 and T22 is 1:2:4. Further, the current ability of TFT T22 and the current ability of TFT T23 are designed to be the same each other. Where there is no problem in terms of operation, a voltage higher than a ground potential GND instead of the ground potential GND may be supplied to the sources of TFT T20 to T23 and one end of the capacity element C2. For example, only the capacity element C2 may be connected to a different signal line.

The semiconductor device for a light emission display device according to the thirteenth embodiment constituted as described above operates, similarly to the first embodiment, on the basis of the timing chart shown in FIG. 11.

In the current storing period (the second operation period) in the thirteenth embodiment, each 1-output D/I conversion portion 230*c* stores reference current (either IR2, IG2 or IB2) supplied from the reference current source. Here, in the present period, all digital gradation data are a low level, and the switches SW20 to SW22 of the 1-output D/I conversion portion 230*c* are OFF.

As the current storing period starts, a pulse signal as the start signal IST is input into F/F 290_1 of the first stage, and simultaneously with the input of the pulse signal, a clock signal ICL and a clock inverted signal ICLB are input into F/F 290_1 whereby a shift register comprising n F/F 290 begins to operate. When an output signal MSW_1 of F/F 290_1 of the first stage assumes a high level, switches SW23*a* and SW23*b* provided in the 1-output D/I conversion portion 230*c* within the RGB D/I conversion portion 220*c* provided with the F/F 290_1 are turned ON. When the switches SW23*a* and SW23*b* are turned ON, the current storing TFT T23 of the 1-output D/I conversion portion 230*c* operates in a saturated area since a portion between the gate and the drain thereof is short-circuited. Thereafter, the gate voltage (of TFT T23) is set adjusting to the current/voltage characteristics of TFT T23 so that reference current from the reference current source flows between the drain and the source of TFT T23 in the stabilized condition.

When after assuming the stabilized condition, the signal MSW_1 assumes a low level, and the output signal MSW_2 of F/F of the second stage assumes a high level, the switches SW23*a* and SW23*b* of the 1-output D/I conversion portion 220*c* provided with F/F 290_1 are turned OFF. At this time, a voltage so that TFT T23 causes reference current to flow is held by the capacity element C2 of the 1-output RGB D/I conversion portion 230 within the RGB D/I conversion portion 220*c* provided with F/F 290_1. Since one end of the capacity element C2 is connected to gates of outputting TFT T20 to T22, the outputting TFT T20 to T22 are able to flow, corresponding to the current ability ratio with respect to TFT T23, current corresponding to the first gradation, current corresponding to the second gradation, and current corresponding to the fourth gradation. The period in which the signal MSW is at a high level as described is termed as a 3-output current storing period in the RGB D/I conversion portion 220*c*. On the other hand, the switches SW23*a* and SW23*b* within the RGB D/I conversion portion 220*c* provided with F/F of the second stage are turned ON, and in the stabilized condition, operation is made in a saturated area so that reference current flows between the drain and the source of TFT T23, and the gate voltage is set adjusting to the current/voltage characteristics of TFT T23 so that reference current flows.

In the current storing period, the 3-output current storing period as mentioned above is repeated with respect to all RGB D/I conversion portions 220*c*, and reference current is stored in all 1-output D/I conversion portions 230*c*.

In the current driving period (the first operation period), the vertical scanning circuit 300 selects control lines line by line.

When a scanning pulse Y_1 assumes a high level, a control line of the first line is selected, and in synchronism therewith, 3-bit digital gradation data D0 to D2 of the first line corresponding to outputs are input into the 1-output D/I conversion portion 230*c* every output. When the digital gradation data D0 to D2 are input, turning ON/OFF if switches SW20 to SW22 is controlled according to these levels (high level (H)/low level (L)), and current having been stored in the current driving period of the frame immediately before is output according to current ability of TFT T20 to T22. As a result, gradation expression as shown in Table 1 becomes enabled. Accordingly, the output current value can be adjusted, from 0 to 7×i0, by digital gradation data input. Further, reference current is stored adjusting to unevenness of current/voltage characteristics in the current storing period (the second operation period), and in a close area, the unevenness of current/voltage characteristics is small. Therefore, unevenness of current is small irrespective of unevenness of current/voltage characteristics in a large area, and high accuracy is obtained.

On the other hand, in the current driving period (the first operation period), the shift register is not operated, and all switches SW23*a* and SW23*b* always remain turned OFF.

The operation as described above is repeated with respect to each frame whereby in a display portion 400, displaying according to gradation data D0 to D2 is carried out, at which time, current of high accuracy is supplied to the pixel circuit.

According to the thirteenth embodiment as described above, since reference current is four times of the minimum value of reference current in the first embodiment, charging and discharging of a load of wiring for flowing reference current can be carried out at high speed, and it is possible to attain a stabilized condition quickly. Accordingly, since the current storing period can be shortened to extend the current driving period, current of higher accuracy can be supplied to the pixel within the display portion.

It is noted in the thirteenth embodiment that as in the second to the tenth embodiments, where the pixel circuit has the constitution as shown in FIG. 4B, the polarity of the transistor may be changed; a transistor may be used as a switch; and timings for turning OFF the switches SW23*a* and SW23*b* may deviated each other or transistors are added to raise accuracy of output current. Further, for example, current ability of TFT T23 is made larger than current ability of TFT T22 whereby the minimum value of reference current can be made larger. In this case, since the current storing period can be shorted, and the current driving period can be extended, the charting and discharging time for a load of a wiring to the pixel within the display portion can be secured longer, and current of higher accuracy can be supplied to the pixel.

Figure 28:
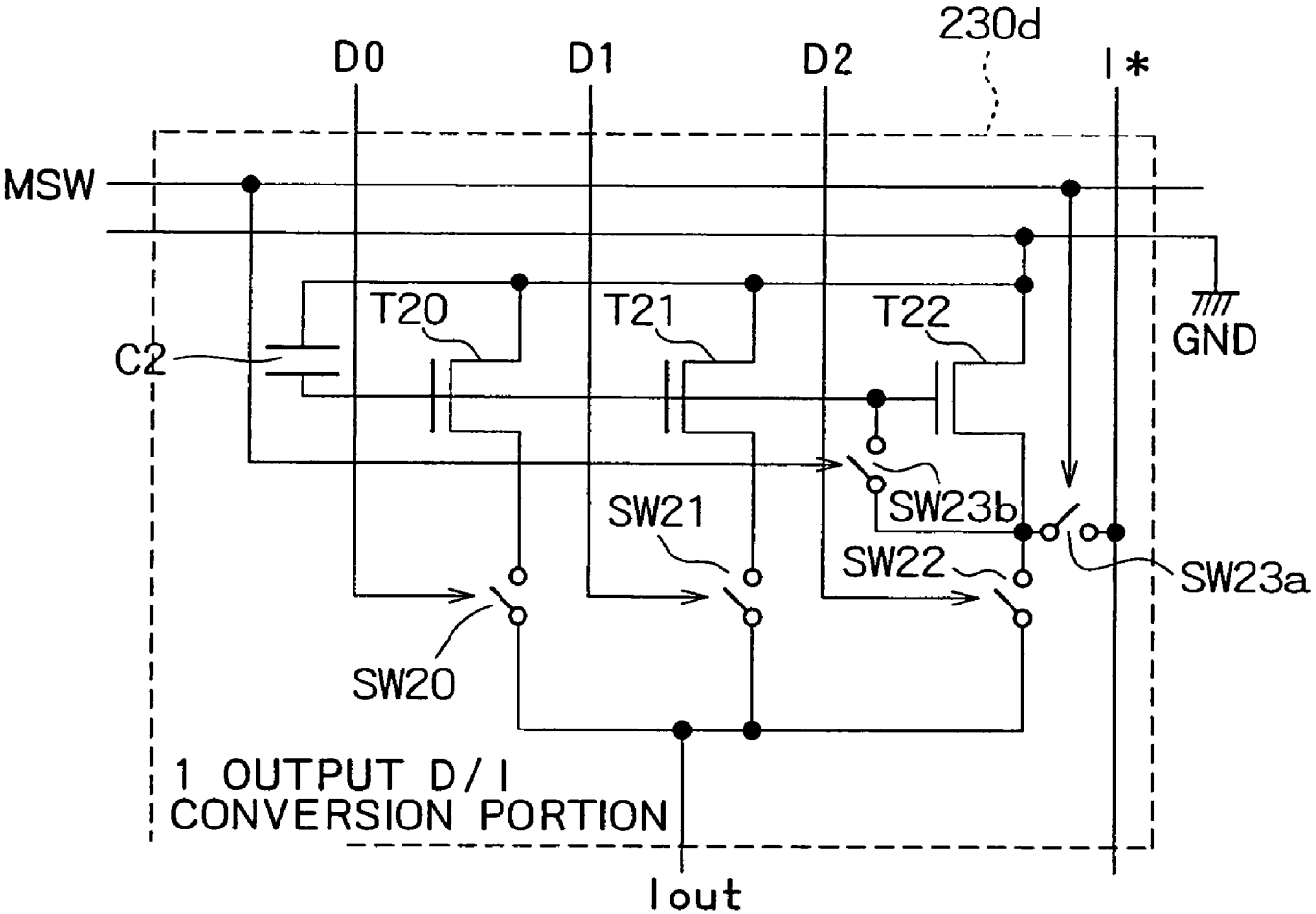
FIG. 28 is a block diagram showing the constitution of a 1-bit D/I conversion portion according to a fourteenth embodiment of the present invention.

Next, the fourteenth embodiment of the present invention will be explained. In the fourteenth embodiment, the constitution of the 1-output D/I conversion portion in the thirteenth embodiment is changed. For example, the fourteenth embodiment is applied to the pixel circuit shown in FIG. 4A, and can be used where unevenness of current/voltage characteristics in a close area is somewhat small. FIG. 28 is a block diagram showing the constitution of a 1-bit D/I conversion portion according to the fourteenth embodiment.

In the 1-bit D/I conversion portion 230*d* according to the fourteenth embodiment, TFT T23 is not provided, and one end of the switch SW 23*a* is connected to a drain of TFT T22. Further, the switch SW 23*b* is connected between the drain and the source of TFT T22.

It is noted that similarly to the thirteenth embodiment, the current value of reference current is adjusted to the current brightness characteristics in which light emitting colors are red, blue and green; and the current value ir2 of reference current IR2 corresponds to the fourth gradation in which light emitting color is red, the current value ig2 of reference current IG2 corresponds to the fourth gradation in which light emitting color is green, and the current value ib2 of reference current IB2 corresponds to the fourth gradation in which light emitting color is blue. That is, the reference current supplied to the 1-output D/I conversion portion 230*d* for displaying red (R) is reference current IR2 corresponding to brightness of the fourth gradation of a luminous element for displaying red. However, since the current-brightness characteristics of the luminous element have a proportional relation, assuming that the current value corresponding to the first gradation is ir0, ir2=4×ir0 results. Similarly, reference current IG2 or IB2 is input into the 1-output D/I conversion portion 230*c* for displaying green (G) or displaying blue (B). Accordingly, in the present embodiment, the minimum value of reference current input will be 4 times of that of the first embodiment. The reason for causing the reference current to correspond to the fourth gradation is that as will be mentioned later, design was made so that current ability of outputting TFT T20, T21 of the 1-output D/I conversion portion 230*d* and current ability of TFT T22 for storing and outputting current are 1:2:4.

The semiconductor device for a light emission display device according to the fourteenth embodiment constituted as described above is also operated on the basis of the timing chart shown in FIG. 11, similarly to the first embodiment.

In the current storing period (the second operation period) in the fourteenth embodiment, each 1-output D/I conversion portion 230*d* stores reference current (either IR2. IG2 or IB2) supplied from the reference current source. Here, in the present period, all digital gradation data are made to be a low level, and the switches SW20 to SW22 of the 1-output D/I conversion portion 230*d* are turned OFF.

With the start of the current storing period, a pulse signal as a start signal IST is input into F/F 290_1 of the first stage, and simultaneously with the input of the pulse signal, a clock signal ICL and a clock inverted signal ICLB are input into F/F 290_1 whereby a shift register comprising n F/F290 begins to operate. When an output signal MSW_1 of F/F 290_1 of the first stage assumes a high level, switches SW23*a* and SW23*b* provided in the 1-output D/I conversion portion within the RGB D/I conversion portion 220*c* provided with the F/F 290_1 are turned ON. When the switches SW23*a* and SW23*b* are turned ON, the current storing and outputting TFT T22 of the 1-output D/I conversion portion 230*d* operates in a saturated area because a portion between the gate and the drain is short-circuited. Thereafter, in the stabilized condition, the gate voltage is set adjusting to the current/voltage characteristics of TFT T22 so that reference current from the reference current source flows between the drain and source of TFT T22.

After assuming the stabilized condition, when the signal MSW_1 assumes a low level and the output signal MSW_2 of F/F of the second stage assumes a high level, the switches SW23*a* and SW23*b* of the 1-output D/I conversion portion 230*d* within the RGB D/I conversion portion 220*c* provided with F/F 290_1 are turned OFF. At this time, a voltage such that TFT T22 causes reference current to flow is held by the capacity element C2 of the 1-output D/I conversion portion 230*d* within the RGB D/I conversion portion 220*c* provided with F/F 290_1. Since one end of the capacity element C2 is connected to the gates of the outputting TFT T20 and T21, the outputting TFT T20 to T22 are able to flow, corresponding to the current ability ratio, current corresponding to the first gradation, current corresponding to the second gradation, and current corresponding to the fourth gradation. The period in which the signal MSW is at a high level as described above is termed as a 3-output current storing period in the RGB D/I conversion portion 220*c*. On the other hand, the switches SW23*a* and SW23*b* within the RGB D/I conversion portion 220*c* provided with F/F of the second stage are turned ON, and in the stabilized condition, operation is made in a saturated area so that reference current flow between the drain and the source of TFT T22, and the gate voltage is set adjusting to the current/voltage characteristics of TFT T22 so that the reference current flows.

In the current storing period, the 3-output current storing period as described above is repeated with respect to all RGB D/I conversion portions 220*c*, and reference current is stored in all 1-output D/I conversion portions 230*d*.

In the current driving period (the first operation period), the vertical scanning circuit 300 selects the control lines line by line.

When the scanning pulse Y_1 assumes a high level, the control line of the first line is selected, and in synchronism therewith, 3-bit digital gradation data D0 to D2 of the first line corresponding to outputs are input into the 1-output D/I conversion portion 230*d* every output. When the digital gradation data D0 to D2 are input, turning ON/OFF of the switches SW20 to SW22 is controlled according to these levels (high level (H)/low level (L)), and current having been stored in the current driving period of the frame immediately before is output according to the current ability of TFT T20 to T22. As a result, gradation expression as shown in Table 1 results. Accordingly, the output current value can be adjusted, from 0 to 7×i0, by digital gradation data input. Further, reference current corresponding to the fourth gradation is stored adjusting to unevenness of current/voltage characteristics in the current storing period (the second operation period), and current corresponding to the fourth gradation in TFT T22 is output, because of which current of high accuracy can be output as current corresponding to the fourth gradation. Further, current output in TFT T20 and T21 correspond to the first gradation and the second gradation, respectively, but current values thereof are not more than one half of current of the fourth gradation, and even if the current value is varied due to the unevenness of current/voltage characteristics, its influence is small as compared with the case where the fourth gradation is uneven.

Accordingly, even where unevenness of current is somewhat present in the close area, current of high accuracy can be supplied.

On the other hand, in the current driving period (the first operation period), the shift register is not operated, and all switches SW23*a* and SW23*b* always remain turned OFF.

The operation as described above is repeated with respect to each frame whereby in a display portion 400, displaying according to gradation data D0 to D2 is carried out, at which time, current of high accuracy is supplied to the pixel circuit.

According to the fourteenth embodiment as described above, since reference current is four times of the minimum value of reference current in the first embodiment, charging and discharging of a load of wiring for flowing reference current can be carried out at high speed, and it is possible to attain a stabilized condition quickly. Accordingly, since the current storing period can be shortened to extend the current driving period, the charging and discharging time for a load in a wiring to the pixel within the display portion can be secured long. Because of this, current of higher accuracy can be supplied to the pixel.

It is noted in the fourteenth embodiment that as in the second to the tenth embodiments, where the pixel circuit has the constitution as shown in FIG. 4B, the polarity of the transistor may be changed; a transistor may be used as a switch; and timings for turning OFF the switches SW23*a* and SW23*b* may deviated each other or transistors are added to raise the accuracy of output current. Further, arrangement is made so that only the TFT T22 is a transistor for storing and outputting current but TFT T21 also stores and outputs current to increase reference current whereby even where the close area is uneven, current of higher accuracy can be supplied.

Figure 29:
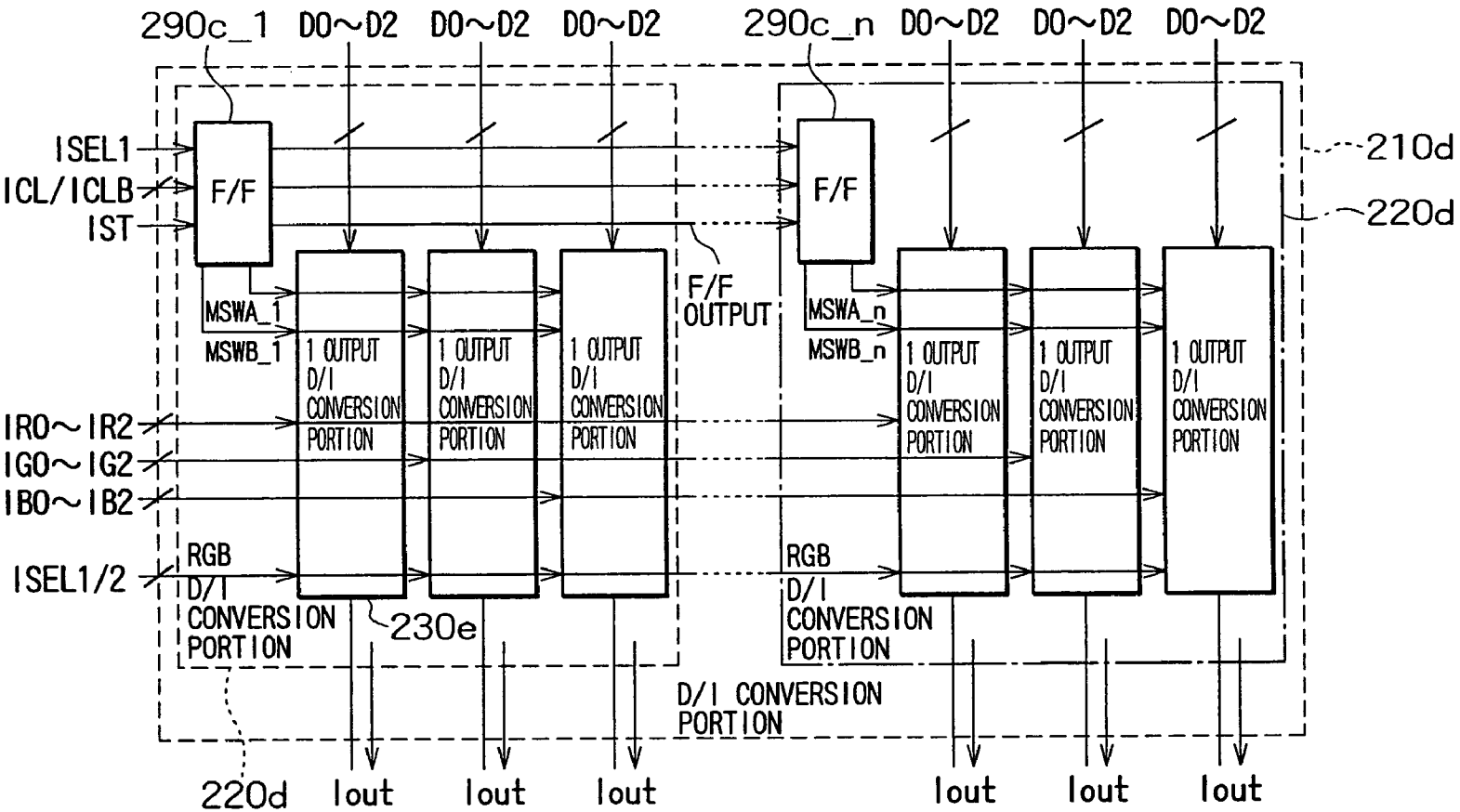
FIG. 29 is a block diagram showing the constitution of a semiconductor device for driving a current load device according to a fifteenth embodiment of the present invention.

Further, for example, in the semiconductor device for a light emission display device in the thirteenth or the fourteenth embodiment, one or a plurality of the 1-bit D/I conversion circuits are added to the 1-output D/I conversion circuits in the thirteenth or fourteenth embodiment to thereby raise the accuracy for one or a plurality of bits. Next, the fifteenth embodiment of the present invention will be explained. For example, the fifteenth embodiment is applied to the pixel circuit shown in FIG. 4A. FIG. 29 is a block diagram showing the constitution of a semiconductor device for a light emission display device according to the fifteenth embodiment of the present invention.

In the fifteenth embodiment, there is provided a D/I conversion portion 210*d*. The D/I conversion portion 210*d* is provided with a shift register comprising a 1-output D/I conversion portion 230*e* for outputs of (3×n) to the light emission display device and n flip-flops (F/F) 290*c*_1 to 290*c*_n provided every 3-output. Into the shift register are input a start signal IST for controlling timing for storing current, a clock signal ICL, an inverted signal ICLB of the clock signal ICL, and a current selector signal ISEL1. Further, digital image data D0 to D2 are input into the 1-output D/I conversion portion 230*e*, and any of reference current IR0 to IR2, IG0 to IG2, and IB0 to IB2 is input according to light emitting colors assigned thereto. Reference current has a current value adjusted to the current-brightness characteristics of luminous elements in which light emitting colors are reds blue, and green, and a current value ir0 of reference current IR0 corresponds to the first gradation of a luminous element whose light emitting color is red, a current value ir1 of reference current IR1 corresponds to the second gradation of a luminous element whose light emitting color is red, and a current value ir2 of reference current IR2 corresponds to the fourth gradation of a luminous element whose light emitting color is red. Likewise, current values of reference current IG0 to IG2 correspond to the first gradation, the second gradation and the fourth gradation whose light emitting color is green, respectively, and current values of reference current IB0 to IB2 correspond to the first gradation, the second gradation and the fourth gradation whose light emitting color is blue, respectively. Further, current selector signals ISEL1 and ISEL2 are input into the 1-output D/I conversion portion 230*e*. One F/F 290*c*, and three 1-output D/I conversion portions 230*e* into which signals MSWA and MSWB output from the F/F290*c* constitute one RGB D/I conversion portion 220*d*.

Figure 30:
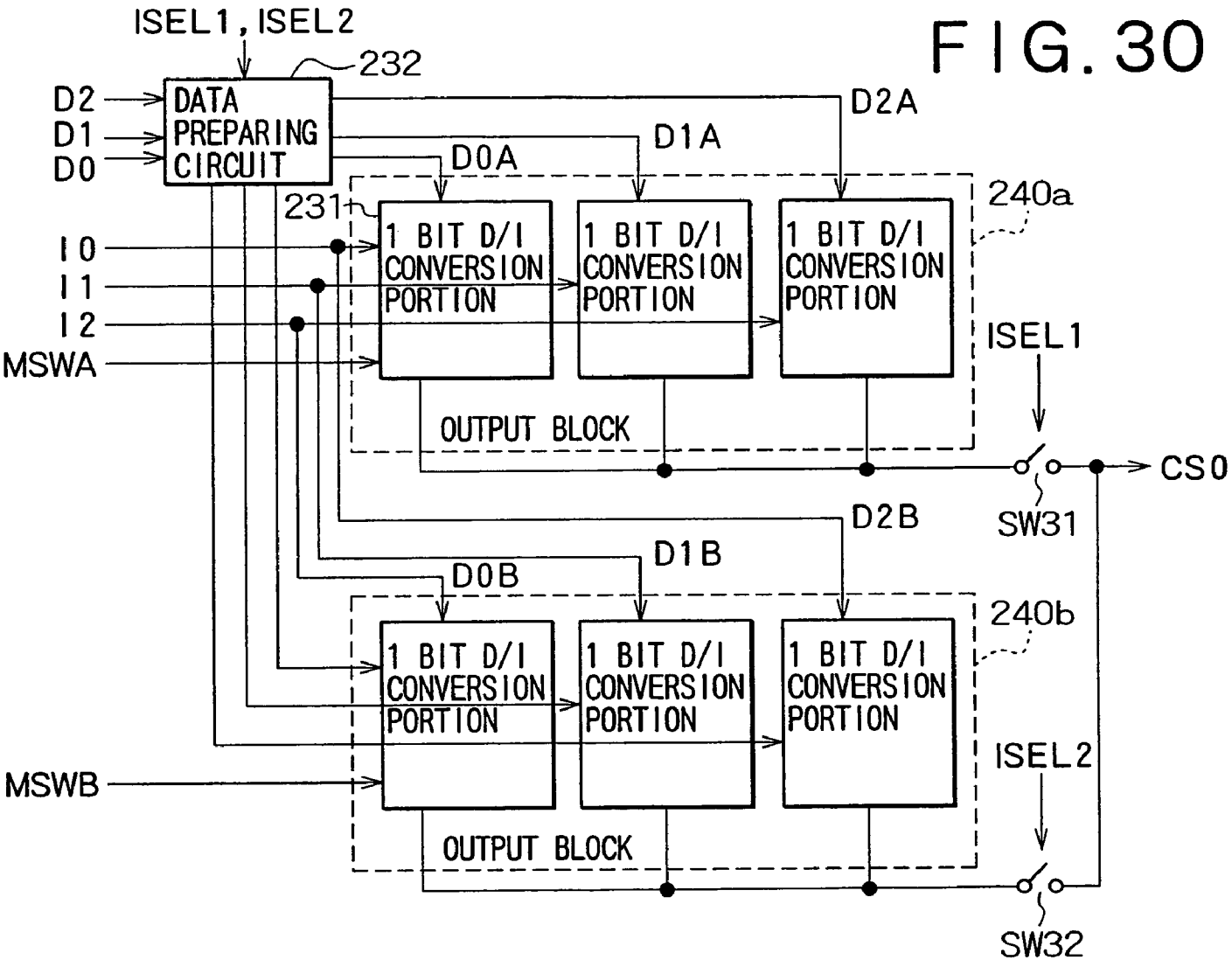
FIG. 30 is a block diagram showing the constitution of a 1-output D/I conversion portion 230*e*.

FIG. 30 is a block diagram showing the constitution of a 1-output D/I conversion portion 230*e*. The 1-output D/I conversion portion 230*e* is provided with output blocks 240*a* and 240*b* respectively comprising three 1-bit D/I conversion portions 231 and a data preparation circuit 232. Further, there are provided switches SW31 and SW32 controlled by current selector signals ISEL1 and ISEL2, respectively, and for selecting if current is output from which block out of the output blocks 240*a* and 240*b*. The data preparation circuit 232 produce data signals D0A to D2A and D0B to D2B on the basis of digital gradation data E0 and D2 for 1-output and the current selector signals ISEL1 and ISEL2. The data signals D0A to D2A are input into the output block 240*a*, and the data signals D0B to D2B are input into an output block 240_2. An output signal MSWA of F/F 290*c* is input into the output block 240*a*, and an output signal MSWB of F/F 290*c* is input into the output block 240*b*. Reference current I0 to I2 for reference are input into the output blocks 240*a* and 240*b*. The 1-bit D/I conversion portion 231 has the constitution similar to that of the first embodiment, and since the current-brightness characteristics of a luminous element has a proportional relation, a relation of ir1=2×ir0 and ir2=4×ir0 is established. Likewise, into the 1-bit D/I conversion portion 231 provided in the 1-output D/I conversion portion 230 for displaying green (G) or for displaying blue (B), into which gradation data D0, D1 and D2 are input reference current IG0 or IB0, reference current IG1 or IB1, and reference current IG2 or IB2, respectively.

Figure 31:
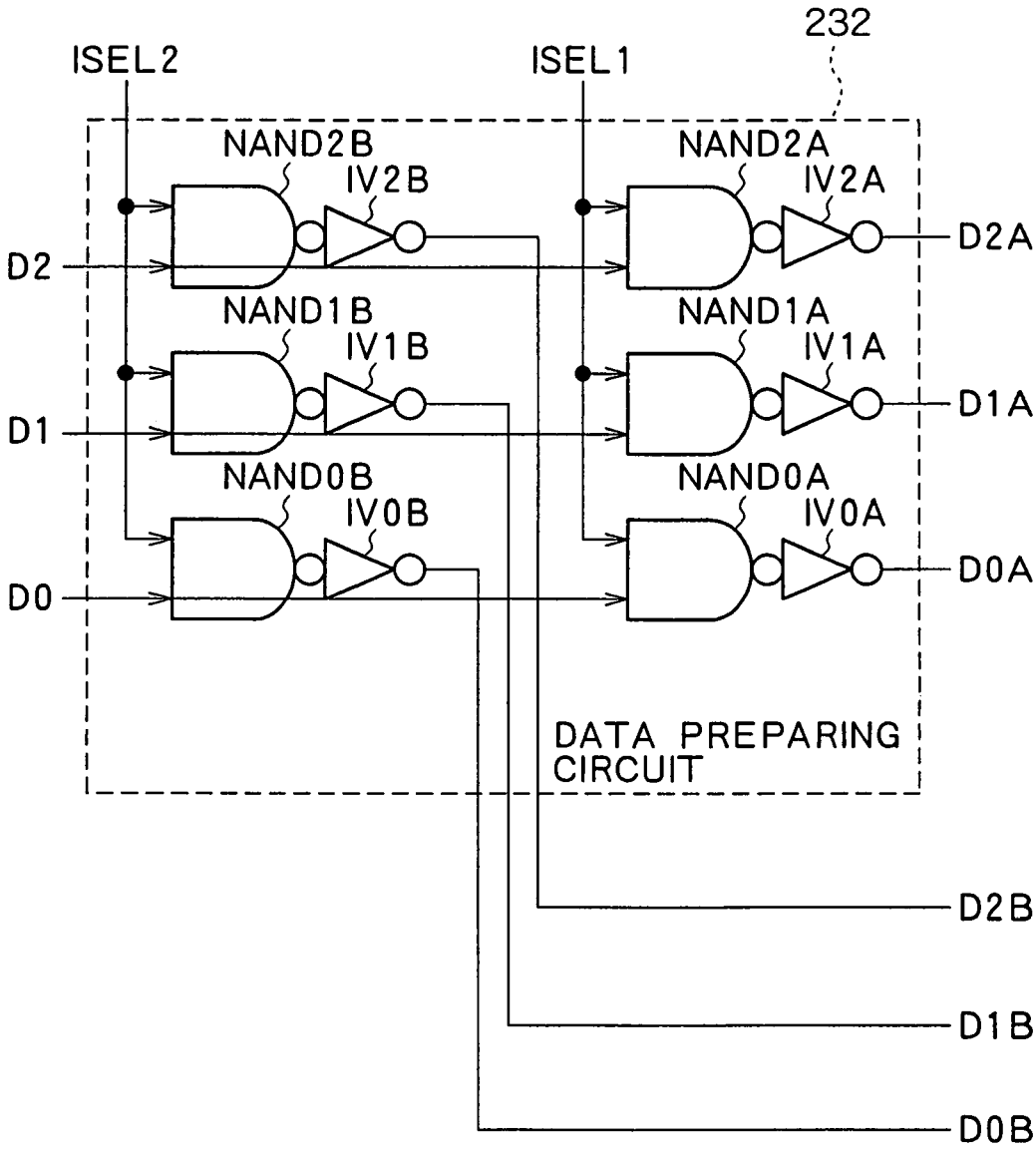
FIG. 31 is a circuit view showing the constitution of one example of a data preparation circuit 232.

FIG. 31 is a circuit view showing the constitution of one example of the data preparation circuit 232. The data preparation circuit 232 is provided with NAND gates NAND0A to NAND2A with the current selector signal ISEL1 as 1 input, for example, inverters IV0A to IV2A for inverting these outputs, NAND gates NAND0B to NAND2B with the current selector signal ISEL2 as 1 input, and inverters IV0B to IV2B for inverting these outputs. Gradation data D0 is further input into the NAND gates NAND0A and NANDOB, gradation data D1 is further input into the NAND gates NAND1A and NAND1B, and gradation data D2 is further input into the NAND gates NAND2A and NAND2B. And, data signals D0A to D2A and D0B to D2B are output from the inverters IV0A to IV2A and IV0B to IV2B, respectively. However, this constitution is one example, and other constitutions may be employed if a similar signal can be output.

Figure 32:
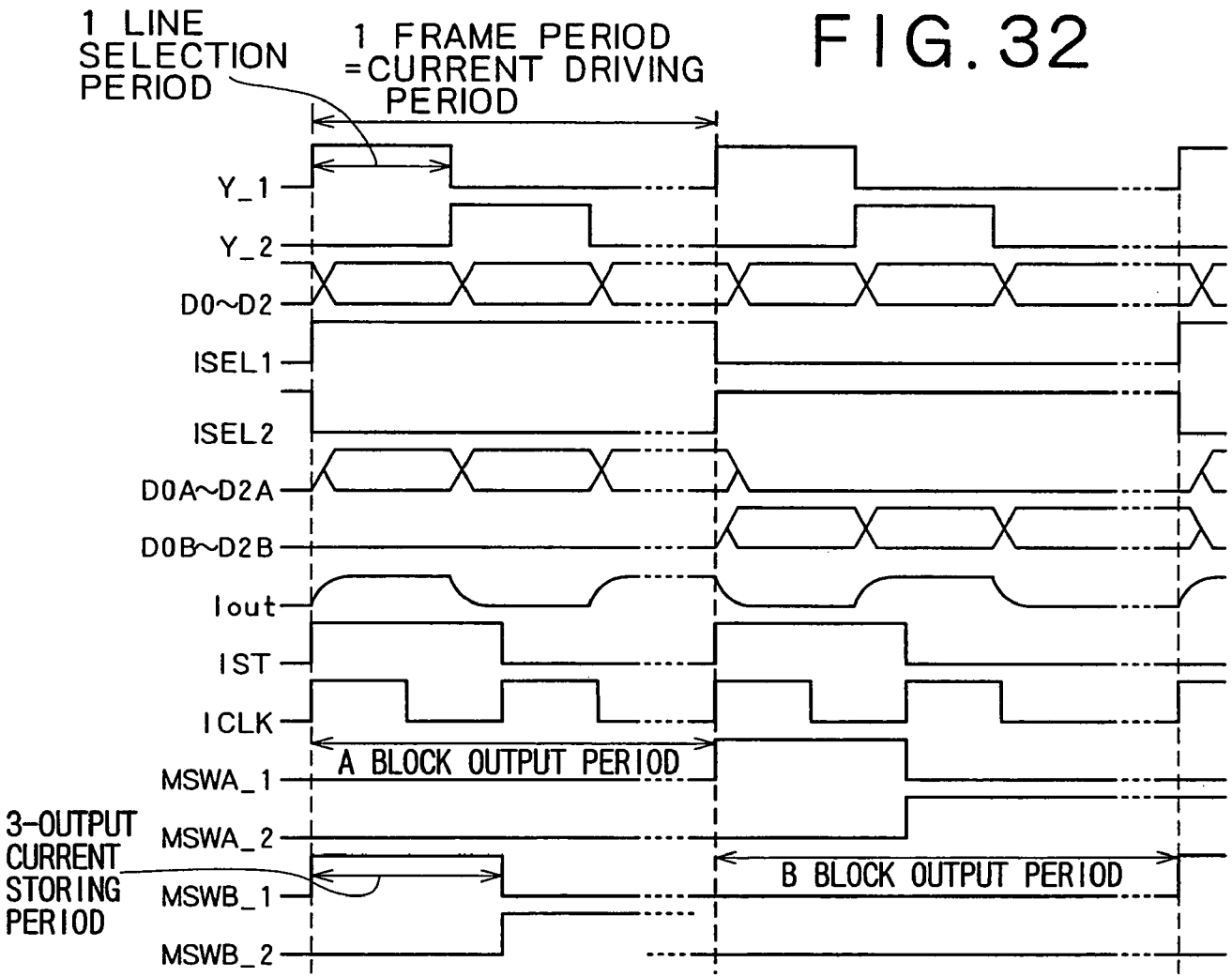
FIG. 32 is a timing chart showing the operation of a semiconductor device for driving a current load device according to a fifteenth embodiment of the present invention.

Next, the operation of the semiconductor device for a light emission display device according to the fifteenth embodiment constituted as described above. FIG. 32 is a timing chart showing the operation of the semiconductor device for a light emission display device according to the fifteenth embodiment of the present invention.

A period from the beginning of vertical scanning of the display portion 400 (see FIG. 1) to the beginning of the next vertical scanning is termed as 1 frame. In the case of the present embodiment, two kinds of frames in which one of the mutually exclusive current selector signals ISEL1 and ISEL2 assumes a high level appear alternately.

First, the first frame will be explained. In the first frame, the current selector signal ISEL1 assumes a high level, and the current selector signal ISEL2 assumes a low level. In this case, in the output blocks 240*a* and 240*b*, in the first output block 240*a* into which are input digital image data DA0 to DA2, the switch SW1 is turned ON to output current. On the other hand, in the second output block 240*b* into which are input digital image data DB0 to DB2, the switch SW2 is turned OFF to store current. In further detail, the 1-bit D/I conversion portion 231 within the output block 240*b* stores any one of reference current IR0 to IR2, IG0 to IG2, and IB0 to IB2. However, in the present frame, the digital gradation data DB0 to DB2 are at a low level, the switch SW1 of the 1-bit D/I conversion portion 231 within the output block 240*b* is OFF.

Next, the operation for storing current of the output block 240*b* will be explained.

With the start of the first frame, a pulse signal as a start signal IST is input into F/F 290*c*_1 of the first stage, and a clock signal ICL and a clock inverted signal ICLB are input into F/F 290*c*_1 simultaneously with the input of the pulse signal whereby a shift register comprising n F/F 290 starts to operate. When an output signal MSWB_1 of F/F 290*c*_1 of the first stage assumes a high level, switches SW2 and SW3 of each 1-bit D/I conversion portion 231 of the output block 240*b* provided in the 1-output D/I conversion portion 230*e* into which the output signal MSWB_1 is input are turned ON. When the switches SW2 and SW3 are turned ON, a current storing and outputting TFT T1 within the 1-bit D/I conversion portion 231 is operated in a saturated area since the gate and the drain thereof is short-circuited. And, in the stabilized condition of the present operation, the gate voltage is set adjusting to current/voltage characteristics of TFT T1 so that reference current flows between the drain and the source of TFT T1.

After assuming the stabilized condition, when the signal MSWB_1 assumes a low level, and the output signal MSWB_2 of F/F of the second stage assumes a high level, the switches SW2 and SW3 within the output block 240*b* provided in the 1-output D/I conversion portion 230*e* within the RGB D/I conversion portion 220*d* provided with F/F 290_1 are turned OFF. At this time, the gate voltage of TFT T1 of the output block 240*b* within the RGB D/I conversion portion 220*d* provided with F/F 290_1 is held to be a voltage so that reference current is flown by the capacity element C1. As a result, reference current is stored in TFT T1 irrespective of the current/voltage characteristics. The period in which the signal MSW is at a high level is termed as a 3-output current storing period in the RGB D/I conversion portion 220*d*. On the other hand, the switches SW2 and SW3 of the output block 240*b* within the RGB D/I conversion portion 220*d* provided with F/F of the second stage are turned ON, and in the stabilized condition, operation is carried out in a saturated area so that reference current flows between the drain and the source of TFT T1 of the 1-bit D/I conversion portion 231, and the gate voltage is set adjusting the current/voltage characteristics of TFT T1 so that reference current flows.

In the first frame period, the 3-output current storing period as mentioned above is repeated with respect to the second output block 240*b* within all the RGB D/I conversion portions 220*d*, and reference current is stored in the second output block 240*b* of all the 1-output D/I conversion portions 230*e*.

Next, the operation of the first output block 240*a* in the first frame will be explained. The vertical scanning circuit 300 selects control lines line by line. FIG. 32 shows scanning pulses Y_1 and Y_2 which are outputs of the first line and the second line, respectively.

When the scanning line Y_1 assumes a high level, the control line of the first line is selected, and in synchronism therewith, 3-bit digital gradation data D0 to D2 of the first line corresponding to outputs are input into the first output block 240*a* within the 1-output D/I conversion portion 230*e* every output. When the digital gradation data D0 to D2 are input, turning ON/OFF of the switch SW1 within the 1-bit D/I conversion portion 231 is controlled according to these level (high level (H)/low level (L)), and current having been stored in TFT T1 in the current driving period of the frame immediately before whereby gradation expression is carried out.

As shown in Table 1, the output current value can be adjusted, from 0 to 7×i0, by digital gradation data input. Further, in the frame immediately before, the gate voltage is set so that current equal to the reference current source flows adjusting to the current/voltage characteristics of TFT T1, and being output using the same TFT T1, because of which unevenness of output current is small, irrespective of the unevenness of current/voltage characteristics, and high accuracy is obtained.

On the other hand, in the first frame, the output MSWA of the shift register is always at a low level, and the switches SW2 and SW3 within all the output blocks 240*a* always remain turned OFF.

Next, in the second frame, the current selector signal ISEL1 is set to a low level, and the current selector signal ISEL2 is set to a high level, whereby the operation of the first output block 240*a* is replaced with the operation of the second output block 240*b*. As a result, the first output block 240*a* stores current, and the second output block 240*b* outputs current.

In the present embodiment, the above-described operation is repeated every 2 frames, whereby current of high accuracy can be supplied to the pixel circuit. Further, in the present embodiment, since two output blocks are provided in 1-output, in each frame, one output block can be used to output current, and the other output block can be used to store current, and the current storing period need not be provided separately. Thereby, one frame period serves as a current driving period, the charging and discharging time for a load of a wiring to the pixel within the display portion can be secured longer. Accordingly, current with higher accuracy can be supplied to the pixel.

It is noted that the second to fourteenth embodiments may be applied to the fifteenth embodiment, and the similar effect can be obtained.

Further, a period of current storage is not limited to every one frame, but may be every several frames. The period of current storage is set every several frames whereby a period of current storage is extended, and therefore, current can be stored with higher accuracy. However, it is necessary that no variation less than accuracy obtained due to a leakage of a transistor or the like occurs in the gate voltage corresponding to current at the time of storage.

Figure 33:
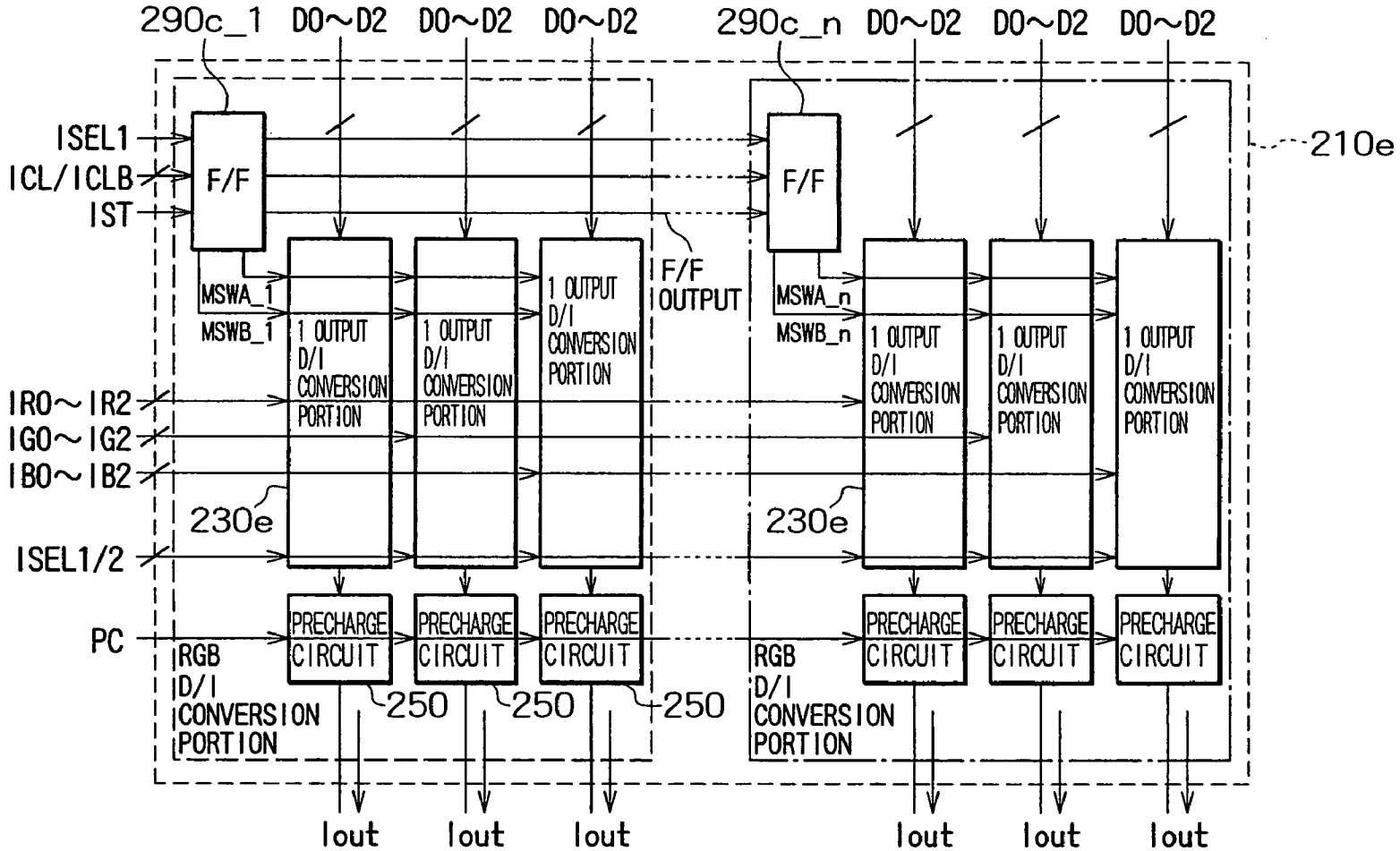
FIG. 33 is a block diagram showing the constitution of a semiconductor device for driving a current load device according to a sixteenth embodiment of the present invention.

Next, the sixteenth embodiment of the present invention will be explained. In the sixteenth embodiment, a precharge circuit is provided at the rear of the 1-output D/I conversion portion. FIG. 33 is a block diagram showing the constitution of the semiconductor device for a light emission display device according to the sixteenth embodiment of the present invention.

In the sixteenth embodiment, a D/I conversion portion 210*e* is provided. The D/I conversion portion 210*e* has the constitution similar to that of the D/I conversion portion 210*d* in the sixteenth embodiment except that a precharge circuit 250 is provided at the rear of each 1-output D/I conversion portion 230*e*. A precharge signal PC is input into the precharge circuit 250.

Figure 34:
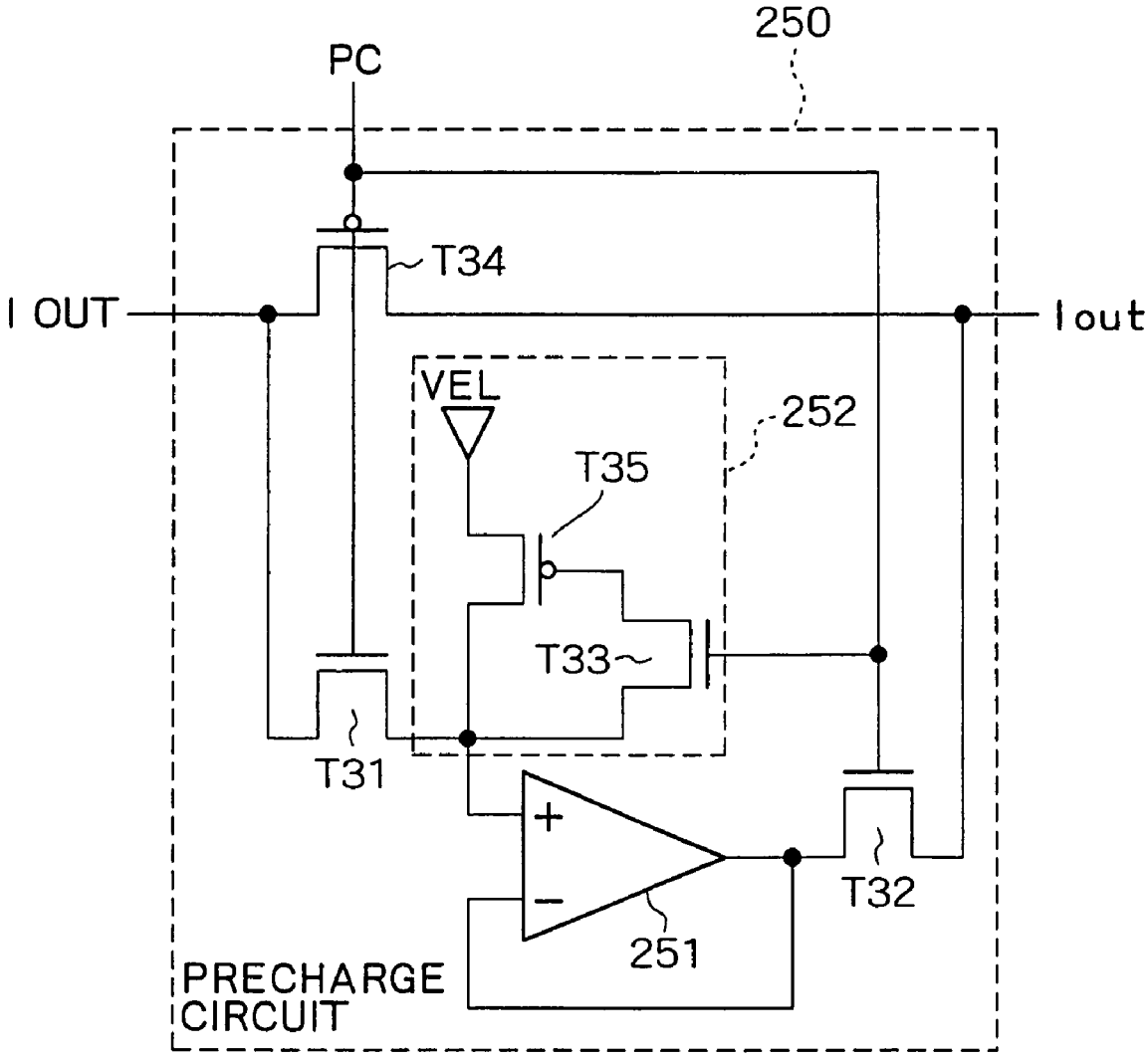
FIG. 34 is a circuit view showing the constitution of a precharge circuit 250.

In the precharge circuit 250, in the period set by a precharge signal, a voltage determined by output current of the 1-output D/I conversion portion in place of output current of the 1-output D/I conversion portion 230*e* is output in each output of the D/I conversion portion 210*d*. FIG. 34 is a current diagram showing the constitution of the precharge circuit 250. The precharge circuit 250 is provided with N channel transistors T31 to T33 controlled by the precharge signal PC and a P channel transistor T34. Output current IOUT is input into one end of the transistors T31 and T32 from the 1-output D/I conversion portion, and a false load circuit 252 and a non-inverted input terminal of an ope-amp 251 are connected to the other end of the transistor T31. In the false load circuit 252, one end of the transistor T33 is connected to the transistor T31, and a gate of the P channel transistor T35 is connected to the other end of the transistor T33. A voltage VEL is supplied to a source of the transistor T35, and the other end thereof is connected to the transistor T31. An output signal of the ope-amp 251 itself is input into an inverted input terminal of the ope-amp 251, one end of the transistor T32 is connected to an output terminal of the ope-amp 251, and the other end thereof is connected to the other end of the transistor T34. A driving current of a luminous element is output from a common connection between the transistors T32 and T34.

In such a precharge circuit 250 as described, whether output current IOUT of the 1-output D/I conversion portion 230*e* is output as output current Iout directly, or is output to the false load circuit 252 is decided by the transistor T34. Further, whether or not output of the ope-amp 251 is to be output of the D/I conversion portion 210*e* is decided by the transistor T32. Furthermore, since the ope-amp 251 negatively feeds back its output, a voltage input into the non-inverted input is voltage-follower output. Further, the transistor T35 is the same transistor as TFT T 102 of the pixel circuit (FIG. 4A) within the display portion 400 or a transistor having equable current ability. However, the false load circuit 252 may be a constitution in which the gate and the drain of the transistor T35 is short-circuited, and the transistor T33 is not provided. Further, since the transistors T31, T32 and T34 act as a switch, a transistor of reverse polarity may be used according to the polarity of the precharge signal PC, for example, and if a constitution is employed in which the precharge signal PC itself and its inverted signal are input, transistor of any polarity can be used.

Figure 35:
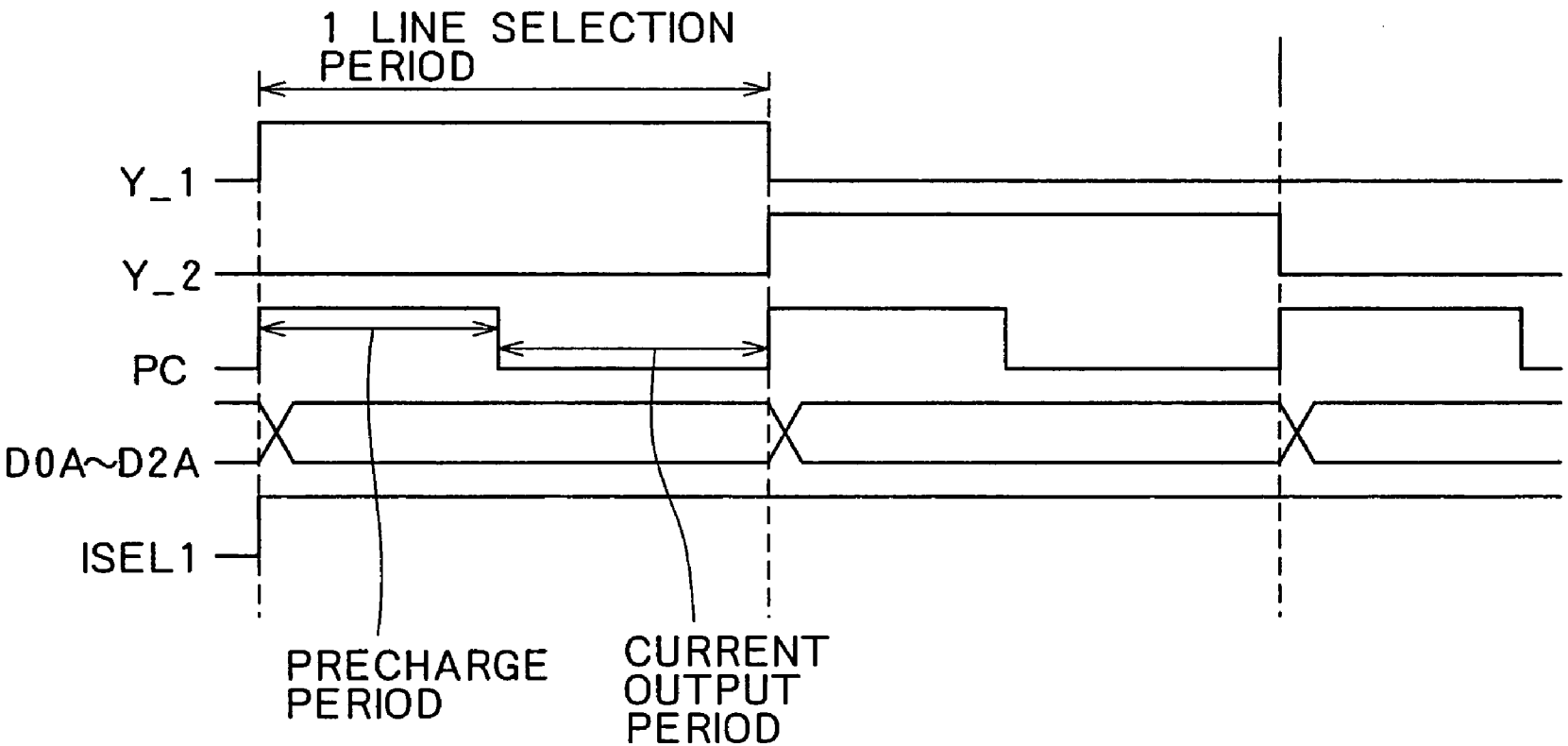
FIG. 35 is a timing chart showing the operation of a precharge circuit 250.

Next, the operation of the precharge circuit 250 will be explained. FIG. 35 is a timing chart showing the operation of the precharge circuit 250.

In the present embodiment, a 1 line selection period is divided into a first period and a second period according to a level of the precharge signal PC.

In the first period, the precharge signal PC is at a high level, which period is a precharge period. When a scanning pulse Y_1 assumes a high level, a control line of the first line is selected, in synchronism with which 3-bit digital gradation data D0 to D2 of the first line corresponding to outputs are input into the 1-output D/I conversion portion 230*e* every output. The 1-output D/I conversion portion 230*e* outputs current in accordance with the relationship shown in Table 1 from the digital gradation data DA0 to DA2 input. At this time, if the precharge signal PC is at a high level, the transistor T34 within the precharge circuit 250 is turned OFF, and the transistors T31 and T32 are turned ON. Therefore, in the precharge circuit 250, output current of the 1-output D/I conversion portion 230*e* flows into the false load circuit 252. Since the false load circuit 252 is provided with the transistor T35, where output current Iout flows in a stabilized manner, the gate voltage of the transistor T35 is substantially the same voltage as the gate voltage where the output current Iout flows into the pixel circuit within the display portion in a stabilized manner. And, this voltage will be an input of the voltage follower constituted by the ope-amp 252, and in the precharge period, the transistor T32 is turned ON, because of which output of the voltage follower will be output of the D/I conversion portion 210*e*. Thereby, in the present period, the gate voltage of the transistor T35 can be applied to the pixel circuit within the display portion.

The false load circuit 252 is located close to the 1-output D/I conversion portion 230*e* away from the pixel circuit, and a wiring load or the like which need be charged or discharged is extremely small. Therefore, the operation for flowing constant output current of the 1-output D/I conversion portion 230*e* into the transistor T35 in a stabilized manner can be carried out at very high speed, even where output current value is low, as compared with the case where the pixel circuit within the display portion is driven by constant output current of the 1-output D/I conversion portion 230*e*. Further, the operation for applying the gate voltage of the transistor T35 to the pixel circuit within the display portion can be also realized because the operation is carried out by output of low impedance which is a voltage follower.

In the second period, the precharge signal is at a low level, and the period is a current output period. Where the precharge signal PC is at a low level, the transistor T34 within the precharge circuit 250 is turned ON, and the transistors T31 and T32 are turned OFF. Therefore, in the precharge circuit 250, output current of the 1-output D/I conversion portion 230*e* is output without modification, and the pixel circuit within the display portion is driven. At this time, the precharge operation is carried out in the first period, and therefore, a voltage close to that where output current of the 1-output D/I conversion portion 230*e* flows in a stabilized manner is applied to the pixel circuit within the display portion. Accordingly, in the second period, the operation for correcting unevenness of current ability between the transistor T35 and the transistor TFT T102 (FIG. 4) in the pixel circuit within the display portion, and the operation for flowing output current Iout to the pixel circuit within the display portion in a stabilized manner to drive it are carried out. As a result, the amount for charging and discharging the wiring load or the like in the second period will suffice to be small. Accordingly, in the second period, the period can be shortened as compared with the case where the precharge operation is not carried out. Further, since the current driving is carried out after a stable voltage has been output by the precharge operation, the operation becomes enabled without being affected by the condition prior to the 1 line selection period.

Thereafter, the scanning pulse Y_1 assumes a low level, the scanning pulse Y_2 assumes a high level, the control line of the second line is selected, and the same operation is repeated. By the above-described operation, the pixel circuit within the display portion can be driven at high speed by current of higher accuracy.

It is noted that the first to fifteenth embodiment may be applied as the 1-output D/I conversion portion of the sixteenth embodiment, and if it apply the circuit/semiconductor device which supply current are not included in the present invention, similar effect can be obtained.

Figure 36:
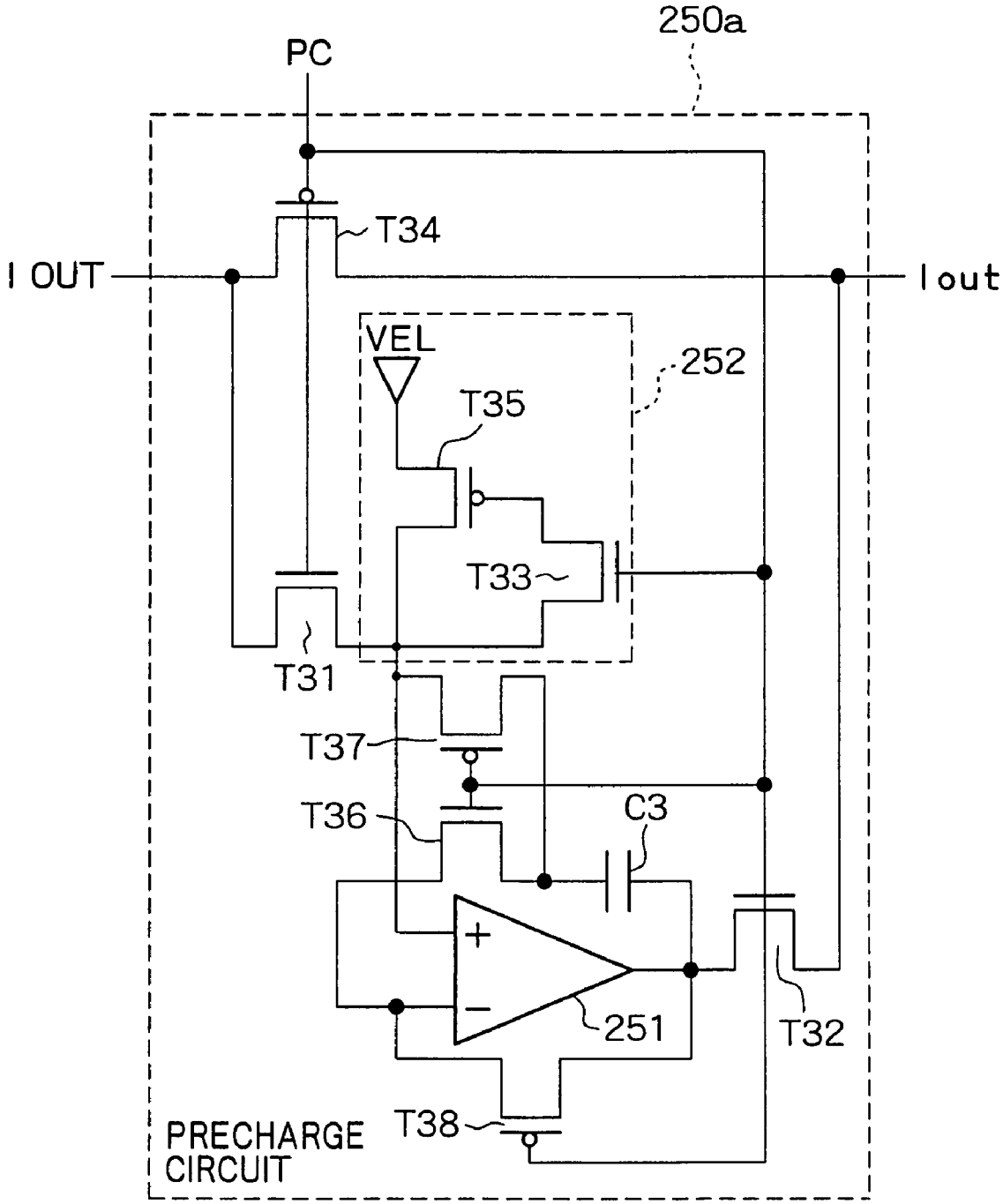
FIG. 36 is a block diagram showing the constitution of a 1-bit D/I conversion portion according to a seventeenth embodiment of the present invention.

Next, the seventeenth embodiment will be explained. In the seventeenth embodiment, the constitution of the precharge circuit in the sixteenth embodiment is changed. FIG. 36 is a block diagram showing the constitution of a precharge circuit according to the seventeenth embodiment.

An N channel transistor T36 into which the precharge signal PC is input and P channel transistors T37 and T38 are provided in the precharge circuit 250*a* in the seventeenth embodiment in addition to the constitutional elements of the precharge circuit 250. The transistor T38 is connected between an output terminal of the ope-amp 251 and an inverted input terminal. Further, a capacity element C3 is input into an output terminal of the ope-amp 251, the transistor T36 is connected between the other end thereof and the inverted input terminal, and the transistor T37 is connected between it and a non-inverted input terminal.

The thus constituted precharge circuit 250*a* is provided with a circuit for canceling an offset voltage of the ope-amp 251 well known, and the offset canceling operation is carried out in a current driving period whereby the precharge operation can be carried out without being affected by the offset voltage of the ope-amp 251. Other operations are similar to the operation of the precharge circuit 250 in the sixteenth embodiment.

Figure 39:
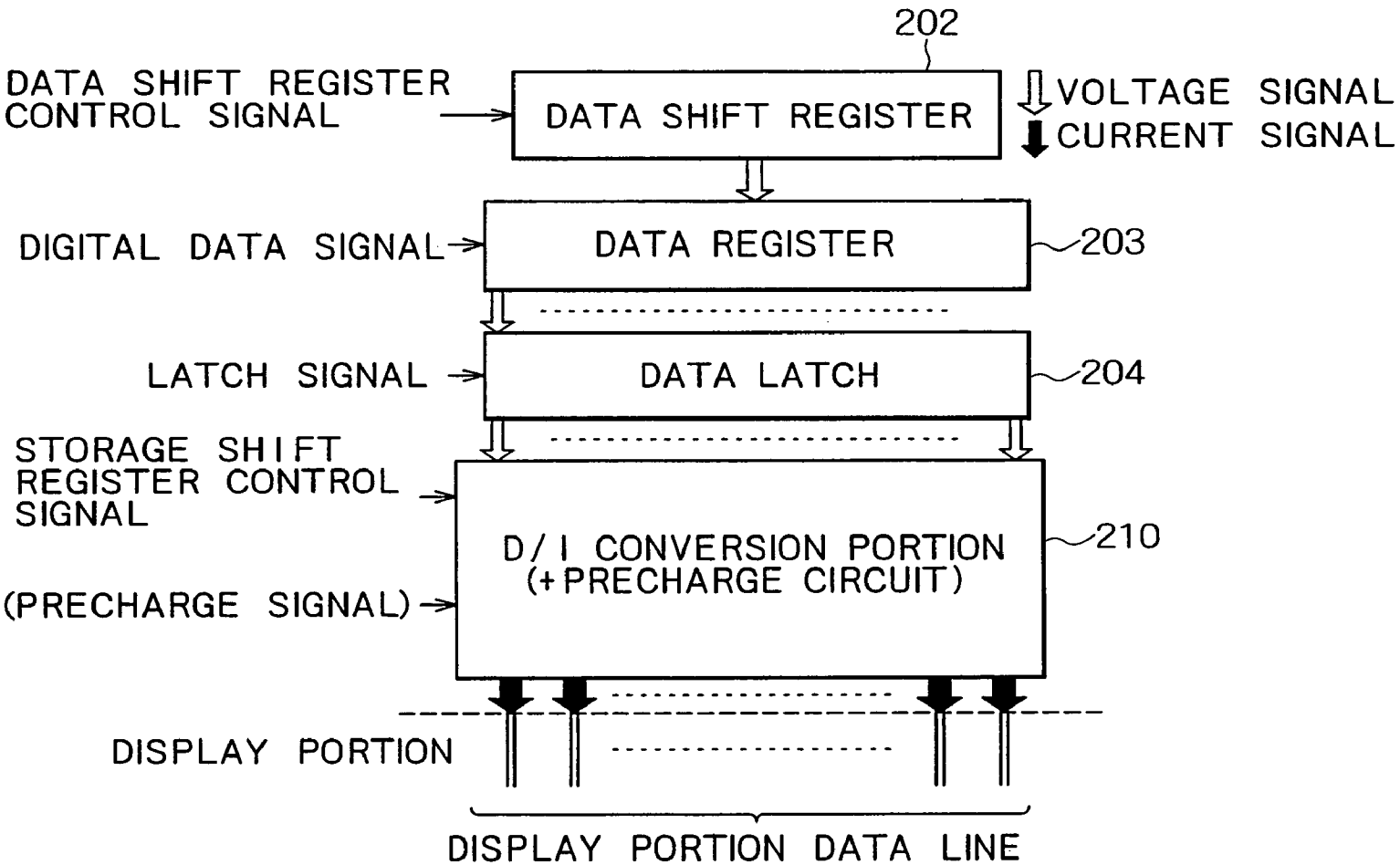
FIG. 39 is a block diagram showing the constitution of a semiconductor device for driving a current load device according to an eighteenth embodiment of the present invention.

Next, FIG. 39 shows the eighteenth embodiment of the present invention. The eighteenth embodiment provides a horizontal driving circuit 200 comprising a data register 203 for holding a digital signal to be input, a data shift register 202 for outputting a scanning signal in synchronism with the holding timing, a data latch 204 for holding signals of all data registers in synchronism with a latch signal to output them to a D/I conversion portion 210, and a D/I conversion portion 210 for outputting current in accordance with the digital data signals. The D/I conversion portion 210 may include a precharge circuit. Further, the D/I conversion portion 210 may be constituted by the D/I conversion portion in any of the first to seventeenth embodiments of the present invention.

Figure 40:
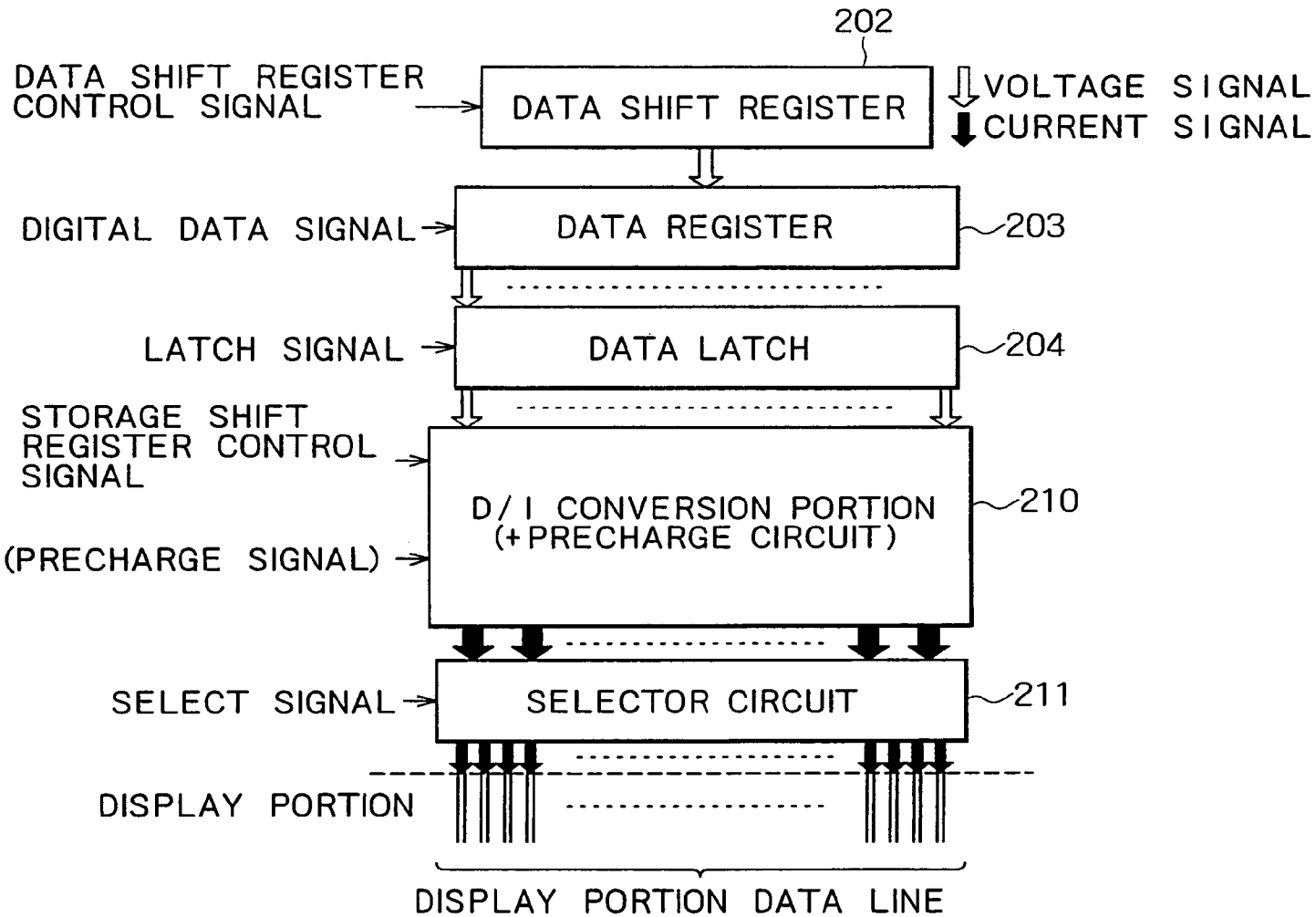
FIG. 40 is a block diagram showing the constitution of a semiconductor device for driving a current load device according to a nineteenth embodiment of the present invention.

Next, FIG. 40 shows the nineteenth embodiment of the present invention. In the nineteenth embodiment, outputs of the D/I conversion portion of the eighteenth embodiment can be connected sequentially to a plurality of display portions 400 by a selector circuit 211 to thereby increase data lines and pixel circuits that can be driven without increasing circuit scales.

Figure 41:
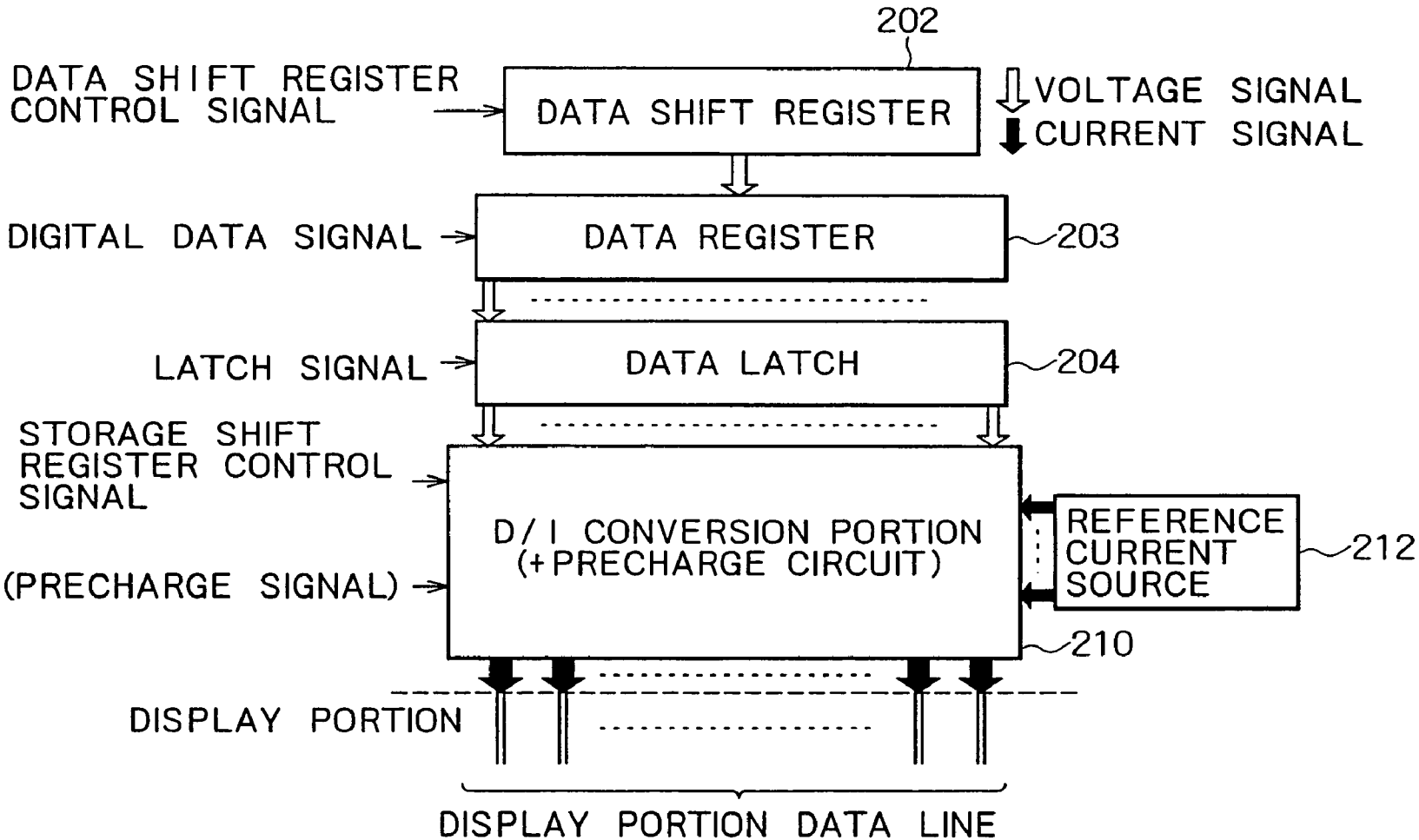
FIG. 41 is a block diagram showing the constitution of a semiconductor device for driving a current load device according to a twentieth embodiment of the present invention.

Next, FIG. 41 shows the twentieth embodiment of the present invention. In the twentieth embodiment, a reference current source 212 for preparing reference current is encased in a horizontal driving circuit 200, in the eighteenth embodiment.

In the first to twentieth embodiments of the present invention, a transistor is explained referring to TFT, but a more general transistor may be employed, and a plurality of horizontal driving circuits 200 may be used with respect to a single display portion. Further, all transistors are prepared by TFTS whereby the display portion 400, the horizontal driving circuit 200 and the vertical scanning circuit 300 may be formed on the same substrate. In this case, a load (circuit) of the precharge circuit in the embodiment of the present invention is prepared by a load (circuit) having the same constitution as the load of the display portion 400 to enable realizing precharging of higher accuracy.

In the first to twentieth embodiments of the present invention, the light emission display device provided with the luminous element in which the current-brightness characteristics are in a proportional relationship in colors (R, G, B) has been explained referring to the embodiment of the device which is driven in 4096 color display for which 3-bit digital gradation data of 0 gradation to 7 gradations display. However, in case of a single color or also in case of many bits, the similar constitution can be extended without modification. Further, all transistors are of TFTs, but even more general transistors, the present invention can be realized by the similar constitution. Further, as the active matrix type pixel circuit, there is supposed FIG. 4A, but also with respect to the pixel circuits of other current driving system and even with respect to the pixels the simple matrix system, the present invention can be realized by the similar constitution.

While the embodiments as described above have been explained in the light emission display device provided with a light emission display element, they can be also applied to the current load device provided with a more general current load element.

As has been hereinbefore described in detail, according to the present invention, current of high accuracy can be supplied to a cell (circuit) of the current load device. This is because of the fact that a voltage between the gate and the source in the state that reference current flows in a stabilized manner between the drain and source of the transistor within the digital-to-current conversion device is stored whereby current of high accuracy can be stored, without being affected by the unevenness of current/voltage characteristics of the transistors, and current is output by the transistor having current stored therein. Further, the number of transistors for storing and outputting current can be increased or decreased in accordance with the unevenness of current/voltage characteristics in the close area. Where current to be stored is less, and the current value thereof is large, the time for storing can be shortened, and the time for outputting (driving) is extended to enable securing the time for charging and discharging the data line within the current load device and the load of the pixel longer. Accordingly, current of higher accuracy can be supplied to the cell (circuit) of the current load device. Further, the transistor for storing current every output terminal and the transistor for outputting current are provided every output terminal, and are replaced every frame, whereby the storing period is not necessary separately, and the time for outputting (driving) can be extended. As a result, current of higher accuracy can be supplied to the cell (circuit) of the current load device.

Further, the precharge circuit provided with the false load circuit is provided between the output of the digital-to-current conversion device and the current load device whereby even where the output current value is low, current or the pixel (circuit) of the device can be driven at high speed. This is because of the fact that in the initial stage of output, the false load circuit is driven at high speed by the current output of the digital-to-current conversion device, the voltage obtained from the false load circuit is supplied to the cell (circuit) within the current load device by the voltage follower, and the voltage where the current output of the digital-to-current conversion device is applied to the cell (circuit) within the current load device can be applied at high speed, after which the cell (circuit) within the current load device is directly driven by the current output of the digital-to-current conversion device to correct it, which operation is carried out whereby the amount of charging and discharging with constant current of loads of the pixel within the current load device or the signal line can be reduced.

What is claimed is:

1. A semiconductor device for driving a current load device provided with a plurality of cells including a current load element comprising:

a plurality of current outputting circuits and precharge circuits, said precharge circuit has two functions, one is supplying a voltage determined by an output current of said current outputting circuit to each cell of said current load device on a data line within said current load device, through said data line, and the other is supplying a current as said output current of said current outputting circuit to each cell of said current load device on said data line, through said data line.

2. The semiconductor device for driving a current load device according to claim 1, wherein said precharge circuit comprises a false load circuit which is a load equal to a load in said cell within said current load device driven by output current from said current output circuit, and a voltage follower for impedance-converting and outputting a voltage generated when output current of said current outputting circuit was supplied to said false load.

3. The semiconductor device for driving a current load device according to claim 2, wherein the false load circuit of said precharge circuit is a load equal to a current load element in said cell or a circuit load equal to a cell circuit load for holding and supplying current in said cell.

4. The semiconductor device for driving a current load device according to claim 2, wherein a voltage obtained by supplying output current of said current outputting circuit to said false load circuit as precharge operation at the beginning of 1 horizontal period is impedance-converted by the voltage follower within said precharge circuit and applied to a current load element or a cell circuit load within said current load device via the data line of said current load device, after which as current driving operation, output current of said current outputting circuit is directly supplied to a current load element or a cell circuit load within the cell within said current load device via the data line of said current load device.

5. The semiconductor device for driving a current load device according to claim 2, wherein said precharge circuit has the constitution for canceling an offset voltage of said voltage follower.

6. The semiconductor device for driving a current load device according to claim 5, wherein said operation for canceling an offset voltage of the voltage follower within said precharge circuit is carried out once in or a few frames.

7. The semiconductor device for driving a current load device according to claim 1, wherein said current outputting circuit is a n-bit digital-to-current conversion circuit comprising n 1-bit digital-to-current conversion circuits which stores one current value from n kinds of reference current respectively, and determines whether or not said stored current value is output by 1-bit digital data to be input.

8. A semiconductor device for driving a current load device provided with a plurality of cells including a current load element, comprising:

a plurality of n-bit digital-to-current conversion circuits for storing one or a plurality of reference current values and outputting current in accordance with n-bit digital data;

a current storing shift register for outputting a scanning signal in synchronism with storing operation of said reference current in said n-bit digital-to-current conversion circuit carried out in order;

an n-bit data latch for transmitting n-bit digital data to an n-bit data selector; and an n-bit data selector for transmitting n-bit digital data from said n-bit data latch to said n-bit digital-to-current conversion circuit in operation of outputting current and not transmitting said n-bit digital data to said n-bit digital-to-current conversion circuit in operation of storing currents.

9. The semiconductor device for driving a current load device provided with a plurality of cells including a current load element according to claim 8, comprising a circuit for producing said reference current.

10. The semiconductor device for driving a current load device according to claim 9, wherein said n-bit digital-to-current conversion circuit comprises n 1-bit digital-to-current conversion circuits which stores one current value from n kinds of reference current respectively, and determines whether or not said stored current value is output by 1-bit digital data to be input.

11. The semiconductor device for driving a current load device provided with a plurality of cells including a current load element according to claim 8, comprising a precharge circuit for carrying out the precharge operation for outputting a voltage before outputting current.

12. The semiconductor device for driving a current load device according to claim 11, wherein said precharge circuit is the precharge circuit according to claim 1.

13. The semiconductor device for driving a current load device provided with a plurality of cells including a current load element according to claim 8, comprising:

a plurality of n-bit data registers for holding one n-bit digital data to be input serially and outputting the former to said data latch; and a data holding shift register for outputting a signal in synchronism with the holding operation of the n-bit digital data of each said n-bit data register carried out in order.

14. The semiconductor device for driving a current load device provided with a plurality of cells including a current load element according to claim 8, comprising:

an output selector for connecting an output of said current outputting circuit or said precharge circuit with any one of a plurality of data lines within the current load device.

15. The semiconductor device for driving a current load device provided with a plurality of cells including a current load element according to claim 14, wherein a plurality of data lines are selected and driven in order in 1 horizontal period by said output selector whereby the current load device is driven by said current outputting circuits or said precharge circuits, whose number is less than the number of data lines.

* * * * *